US006650201B2

(12) United States Patent
Jang

(10) Patent No.: US 6,650,201 B2
(45) Date of Patent: Nov. 18, 2003

(54) DIELECTRIC FILTER FOR FILTERING OUT UNWANTED HIGHER ORDER FREQUENCY HARMONICS AND IMPROVING SKIRT RESPONSE

(76) Inventor: Sei-Joo Jang, c/o S. M. Choi, Dongbu Haeoreum, Apt. 101-1109, 716 Yoksam-Dong, Kangnam-Ku, Seoul (KR)

( * ) Notice: Subject to any disclaimer, the term of this patent is extended or adjusted under 35 U.S.C. 154(b) by 0 days.

(21) Appl. No.: 09/754,587

(22) Filed: Jan. 4, 2001

(65) Prior Publication Data

US 2002/0067225 A1 Jun. 6, 2002

Related U.S. Application Data

(63) Continuation-in-part of application No. 09/697,452, filed on Oct. 26, 2000.

(51) Int. Cl.[7] ..... H01P 1/213
(52) U.S. Cl. ..... 333/134; 333/202; 333/206
(58) Field of Search ..... 333/134, 206, 333/202, 222

(56) References Cited

U.S. PATENT DOCUMENTS 4,477,785 A * 10/1984 Atia ..... 333/202
5,578,975 A * 11/1996 Kazama et al. ..... 333/202
5,614,875 A * 3/1997 Jang et al. ..... 333/202
5,986,520 A * 11/1999 Abeno et al. ..... 333/134

FOREIGN PATENT DOCUMENTS

JP 59-185404 * 10/1984 ..... H01P/1/212
JP 1-53604 * 3/1989 ..... H01P/1/212
JP 9-205302 * 8/1997 ..... H01P/1/20

* cited by examiner

*Primary Examiner*—Robert Pascal
*Assistant Examiner*—Joseph Chang
(74) *Attorney, Agent, or Firm*—John J. Elnitski, Jr.

(57) ABSTRACT

The present invention is a filter and a method of making a filter to remove unwanted frequency harmonics associated with current filters. The filter is made up of resonators, such that the filter resonates a design frequency. Whereby, at least two resonators are coupled together between an input and an output and at least one of the resonators is of a different design from other resonators, such that the resonator of a different design resonates the same design frequency as the other resonators and resonates different higher order harmonic frequencies than the other resonators. The present invention also provides methods of improving skirt response for a filter, as well as other response properties of the filter. One way to improve the filter's properties is where at least one of the resonators in a filter is reversed in orientation as compared to the other resonators. Another way is where at least one of the resonators is reversed in orientation electronically by employing electrode coupling on a top and bottom surface of the filter.

59 Claims, 58 Drawing Sheets

(a) RE-ENTRANT CAVITY TRANSMISSION RESPONSE
(b) COAXIAL CAVITY TRANSMISSION RESPONSE $\eta = 2$ $\eta = 3$

#1 ; COAXIAL
#2 ; COAXIAL
#3 ; COAXIAL

#1 ; COAXIAL
#2 ; RE-ENTRANT
#3 ; COAXIAL

#1 ; RE-ENTRANT
#2 ; COAXIAL
#3 ; COAXIAL RESONATOR

DIELECTRIC FILTER FOR FILTERING OUT UNWANTED HIGHER ORDER FREQUENCY HARMONICS AND IMPROVING SKIRT RESPONSE

This application is a continuation-in-part application of U.S. Ser. No. 09/697,452 filed on Oct. 26, 2000.

BACKGROUND

It is known to use two or more coaxial dielectric ceramic resonators coupled together to create a filter for use in mobile and portable radio transmitting and receiving devices, such as microwave communication devices. Likewise, two or more re-entrant dielectric ceramic resonators can be coupled together to form such a filter. Resonators in a filter are designed to resonate just one frequency and this frequency is known as the resonate frequency of the resonator. FIG. 1 shows an example of a three-pole filter using three quarter-wavelength coaxial dielectric ceramic resonators coupled together. The coupling method shown in FIG. 1 is a known technique of coupling resonators by providing an aperture or IRIS between the resonators. IRIS is a passage between resonators that allows electrical and magnetic fields of the resonate frequency to pass from one resonator to another. The filter includes an input and an output. The input is usually radio frequencies signals from an antenna or signal generator. The filter only allows the resonate frequency of the resonators and its harmonics to pass through the filter and on to the output. The number of resonators used determines the characteristics of the passing signal, such as bandwidth, insertion loss, skirt response and spurious frequency response. The disadvantage to such filters is that the resonators not only allow the first harmonic of design frequency to pass, but also allow the other associated higher order harmonics of that frequency to pass through the filter. These higher order harmonics are known to interfere with other electronic devices.

It is an object of the present invention to a filter to prevent the passage of higher order harmonics of a design frequency.

It is an object of the present invention to provide a method of coupling resonators.

SUMMARY OF THE INVENTION

The present invention is a filter and a method of making a filter to remove unwanted frequency harmonics associated with current filters. The filter is made up of resonators, such that the filter resonates a design frequency. Whereby, at least two resonators are coupled together between an input and an output and at least one of the resonators is of a different design from other resonators, such that the resonator of a different design resonates the same design frequency as the other resonators and resonates different higher order harmonic frequencies than the other resonators. The present invention also provides methods of improving skirt response for a filter, as well as other response properties of the filter. One way to improve the filter's properties is where at least one of the resonators in a filter is reversed in orientation as compared to the other resonators. Another way is where at least one of the resonators is reversed in orientation electronically by employing electrode coupling on a top and bottom surface of the filter.

BRIEF DESCRIPTION OF THE DRAWINGS

FIG. 115 is a top schematic view of another three-pole monoblock advanced dielectric filter according to the present invention;

FIG. 116 is a top schematic view of another three-pole monoblock advanced dielectric filter according to the present invention;

FIG. 117 is a top schematic view of another three-pole monoblock advanced dielectric filter according to the present invention;

FIG. 118 is a perspective, top and bottom schematic view of two four-pole advanced dielectric filters forming a duplexer filter according to the present invention;

FIG. 119 is a perspective, top and bottom schematic view of another two four-pole advanced dielectric filters forming a duplexer filter according to the present invention;

FIG. 120 is a perspective, top and bottom schematic view of another two four-pole advanced dielectric filters forming a duplexer filter according to the present invention;

FIG. 121 is a perspective, top and bottom schematic view of another two four-pole advanced dielectric filters forming a duplexer filter according to the present invention;

FIG. 122 is a perspective, top and bottom schematic view of two three-pole advanced dielectric filters forming a duplexer filter according to the present invention;

FIG. 123 is a perspective, top and bottom schematic view of another two three-pole advanced dielectric filters forming a duplexer filter according to the present invention;

FIG. 124*a* is a perspective schematic view of another two three-pole advanced dielectric filters forming a duplexer filter according to the present invention;

FIGS. 124*b–e* are top schematic views of different versions of two three-pole advanced dielectric filters forming a duplexer filter according to the present invention; and FIGS. 125*a–e* are schematic views of different antenna, TX and RX coupling configurations that can be used duplexers employing advanced dielectric filters.

DETAILED DESCRIPTION OF THE INVENTION

Figure 1:
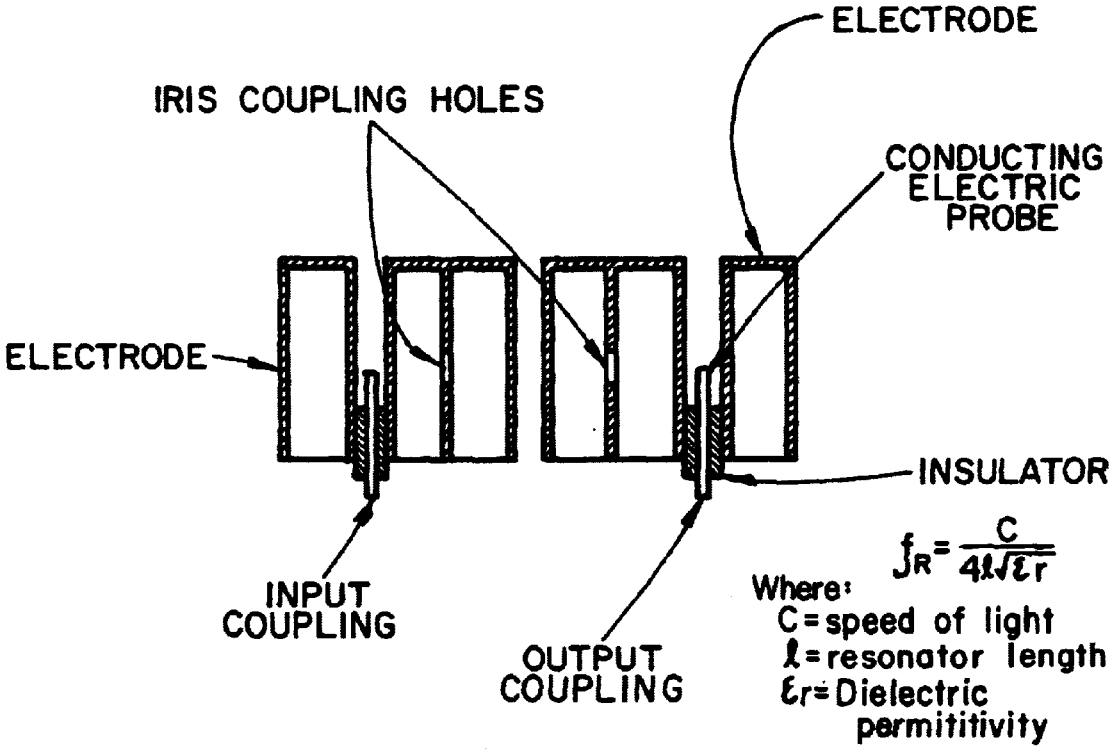
FIG. 1 is a schematic cross-sectional view of a three-pole filter using coaxial resonators according to prior art.
Figure 2:
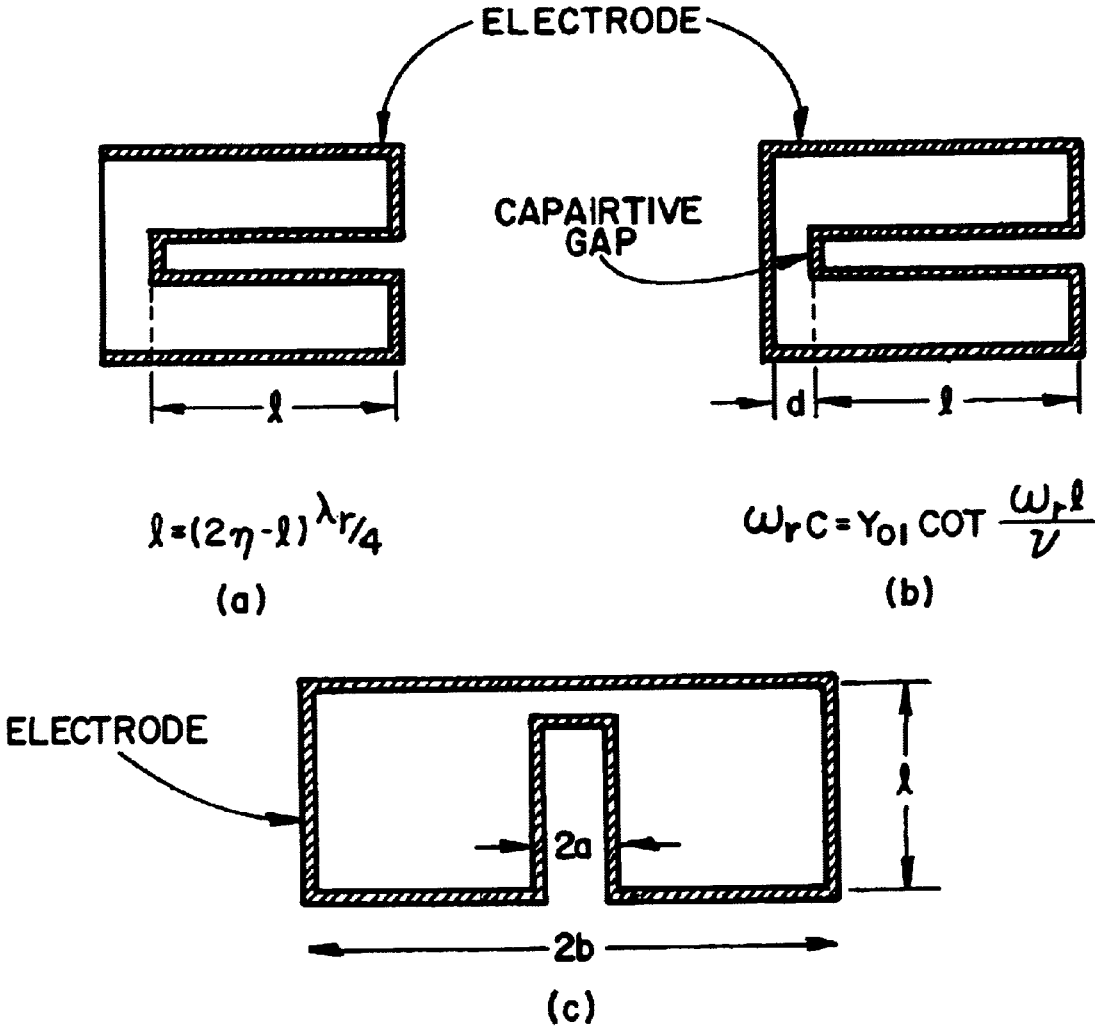
FIG. 2 is a schematic cross-sectional view of three different re-entrant resonators according to prior art.
Figure 3:
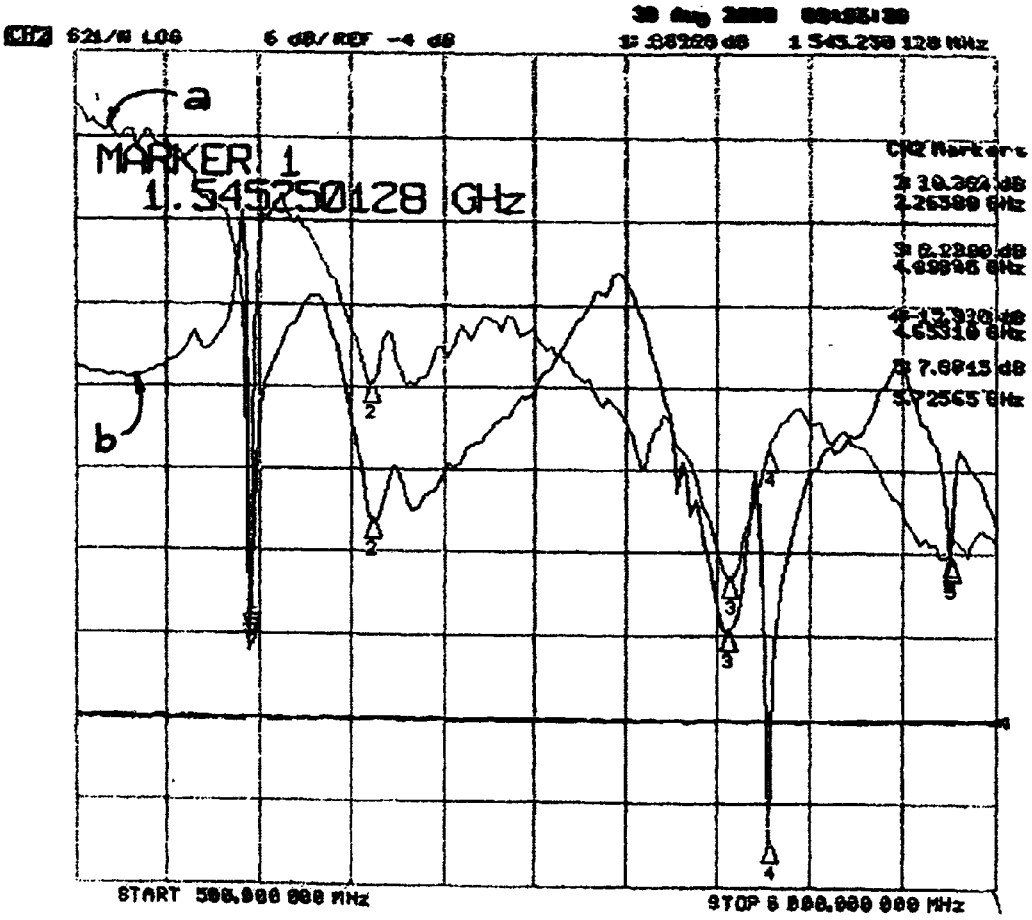
FIG. 3 is a plot of a coaxial dielectric ceramic resonator and a re-entrant dielectric ceramic resonator designed for the same resonate frequency.

The present invention is a filter and a method of making a filter to remove unwanted frequency harmonics associated with current filters of the prior art. The present invention provides methods of improving skirt response for a filter, as well as other response properties of the filter. The present invention is also a method of coupling resonators. Coaxial dielectric ceramic resonators are designed to resonate a frequency based on the equation shown in FIG. 1. FIG. 2 shows three other different design examples of dielectric ceramic resonators along with their associated resonate frequency design equation. The resonators of FIG. 2 are sometimes referred to as re-entrant dielectric ceramic resonators. FIG. 3 shows a plot of a coaxial dielectric ceramic resonator and a re-entrant dielectric ceramic resonator designed for the same resonate frequency. As can be seen from FIG. 3, the higher order harmonics frequencies for the coaxial and re-entrant resonators are different. A resonator of a particular design will only allow the design frequency and the higher order harmonic frequencies associated with the resonator to pass to the next resonator in a filter. Since the higher order harmonic frequencies are not the same, as shown by the plot in FIG. 3, the harmonic frequencies of a coaxial dielectric ceramic resonator will not pass through a re-entrant dielectric ceramic resonator designed for the same resonate frequency. It is also true that the higher order harmonic frequencies of the re-entrant dielectric ceramic resonator will not pass through a coaxial dielectric ceramic resonator designed for the same resonate frequency. Further, the higher order harmonic frequencies of a re-entrant dielectric ceramic resonator will not pass through a different re-entrant dielectric ceramic resonator having a different resonate frequency design equation, yet designed for the same resonate frequency. Therefore, making a filter from different types of dielectric ceramic resonators that resonate the same first harmonic of a desired frequency provides a filter that outputs only that first harmonic of the desired frequency.

Figure 4:
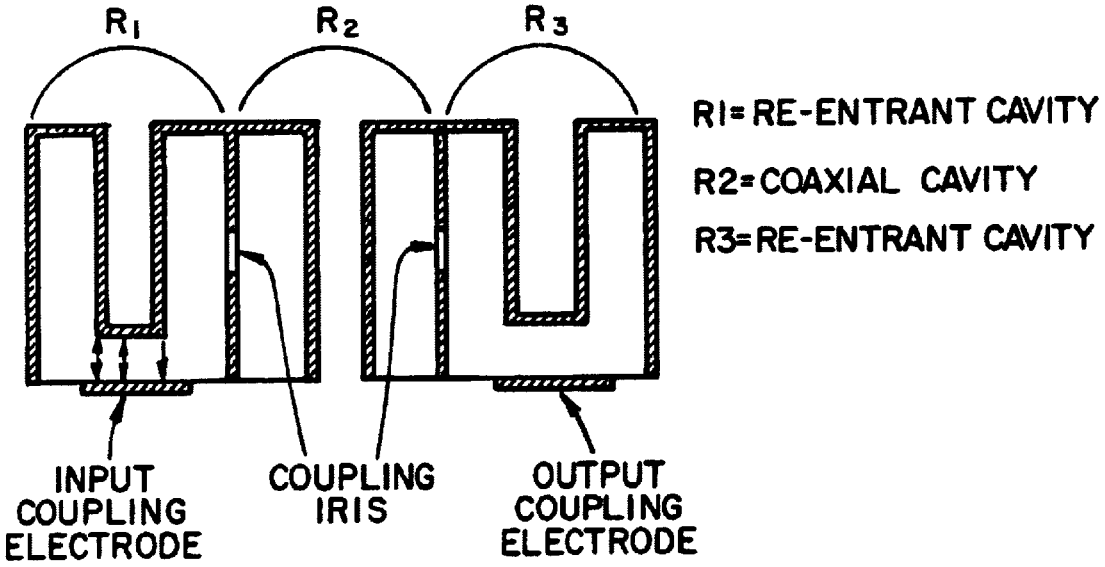
FIG. 4 is a schematic cross-sectional view of a three-pole filter using coaxial and re-entrant resonators coupled by using IRIS coupling according to present invention.
Figure 5:
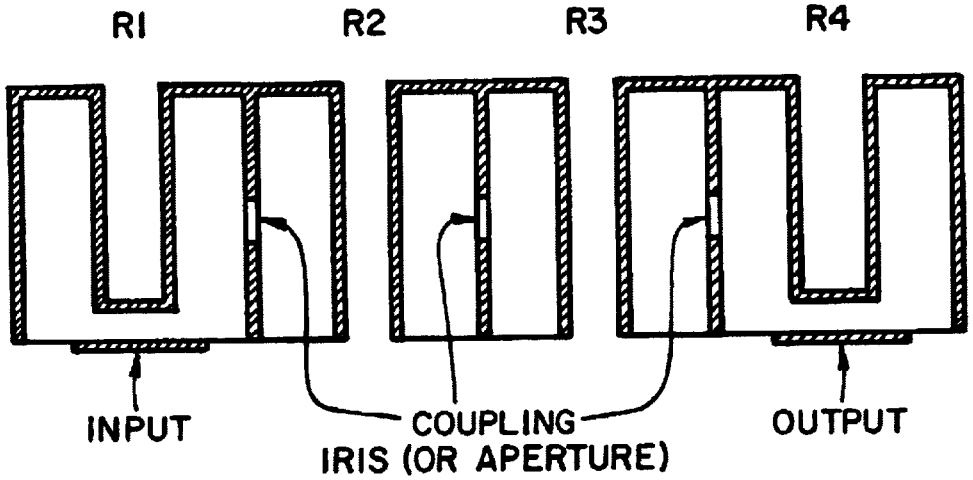
FIG. 5 is a schematic cross-sectional view of a four-pole filter using coaxial and re-entrant resonators coupled by using IRIS coupling according to present invention.
Figure 6:
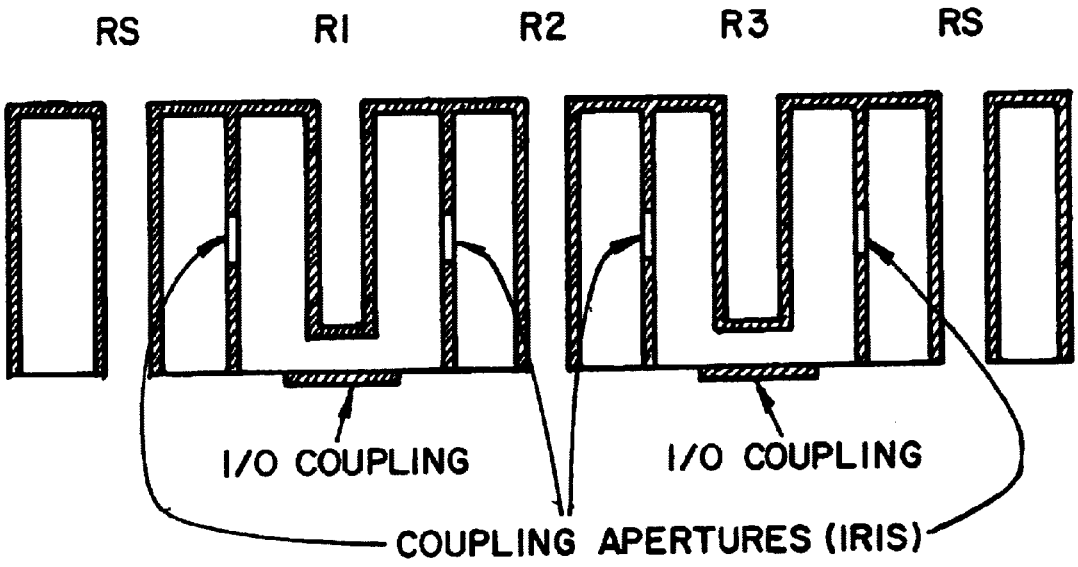
FIG. 6 is a schematic cross-sectional view of a three-pole filter of FIG. 4 with the addition of two coaxial resonators to improve Skirt response according to present invention.
Figure 7:
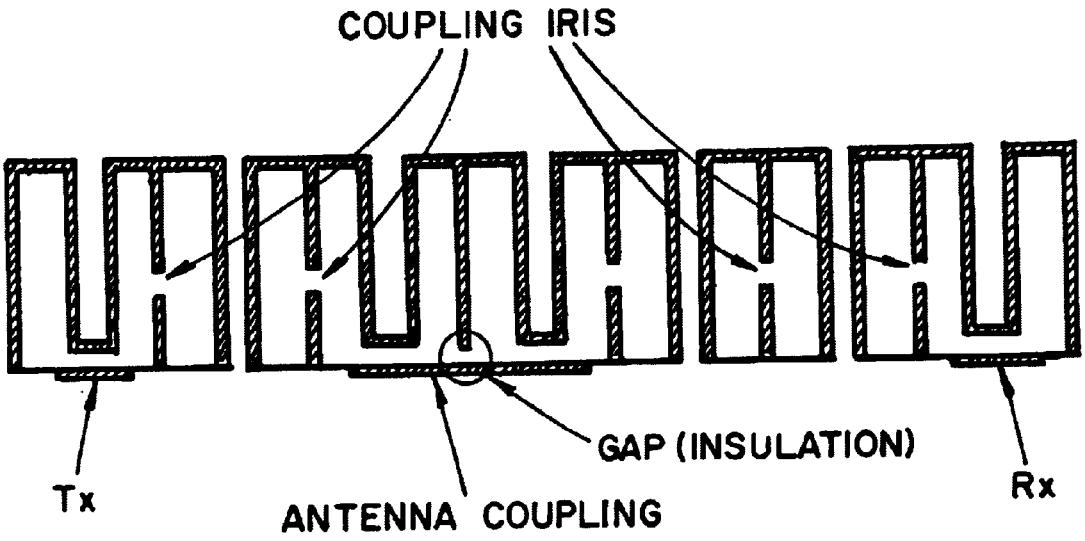
FIG. 7 is a schematic cross-sectional view of a duplexer filter employing electrode coupling for an antenna according to present invention.
Figure 8:
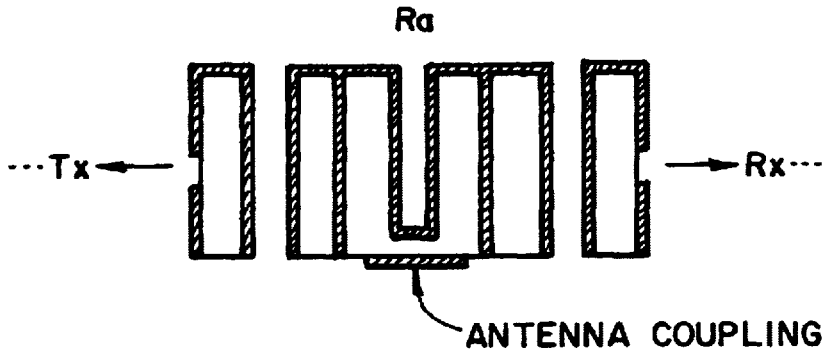
FIG. 8 is a schematic cross-sectional view of another duplexer filter employing electrode coupling for an antenna according to present invention.
Figure 9:
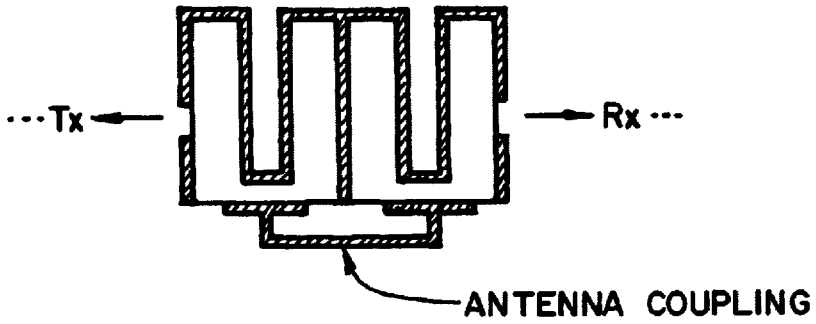
FIG. 9 is a schematic cross-sectional view of another duplexer filter employing electrode coupling for an antenna according to present invention.
Figure 10:
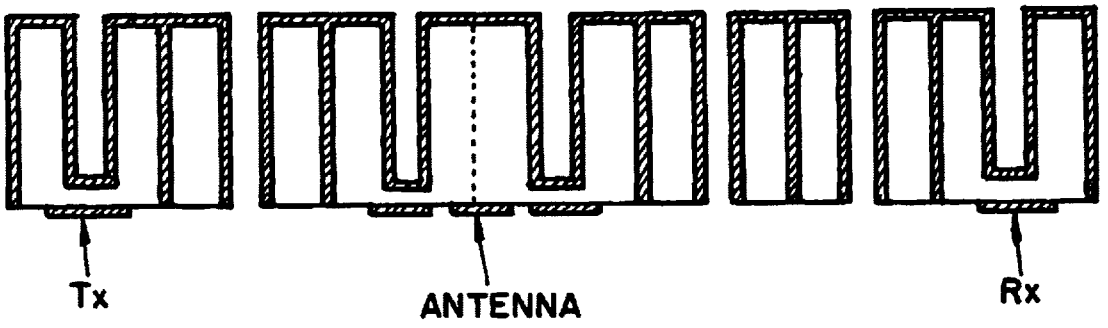
FIG. 10 is a schematic cross-sectional view of another duplexer filter employing electrode coupling for an antenna according to present invention.
Figure 11:
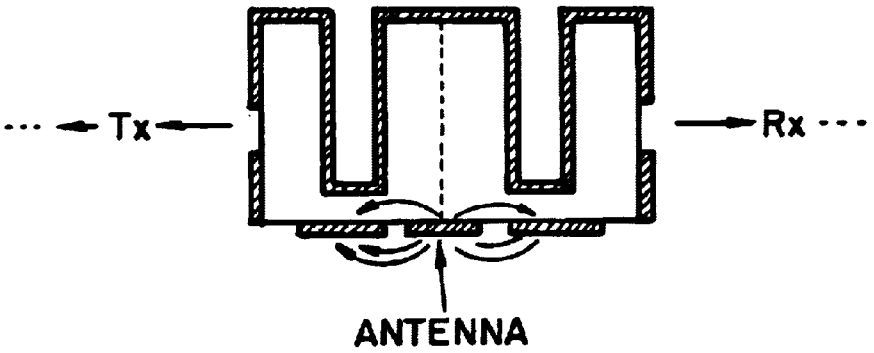
FIG. 11 is a schematic cross-sectional view of another duplexer filter employing electrode coupling for an antenna according to present invention.
Figure 12:
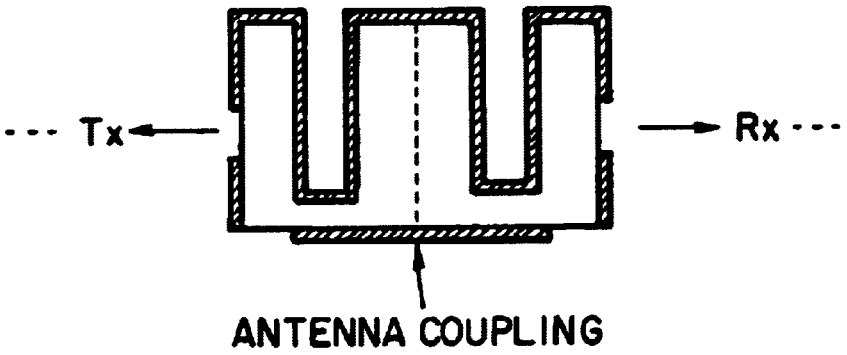
FIG. 12 is a schematic cross-sectional view of another duplexer filter employing electrode coupling for an antenna according to present invention.

The following are examples of different filters configurations using the above disclosure. All of the examples employ a coaxial dielectric ceramic resonator shown in FIG. 1 and the re-entrant dielectric ceramic resonator shown in FIG. 2, whereby both resonators resonate the same first harmonic frequency. These examples depict schematically the coaxial and re-entrant resonators of a filter and are not specific examples of resonators or filters. The examples shown can be interchanged with other combinations of coaxial and re-entrant resonators, so long as they all resonate the same first harmonic frequency. The filter configurations shown as examples can be made up of a combination of individual resonators to act as a filter or multiple resonators formed from a single block of material to act as a filter. FIG. 4 shows a three-pole filter having two re-entrant resonators flanking a coaxial resonator. Note that electrode coupling is employed between the reentrant resonators and input and output electrodes, whereas FIG. 1 shows electric probes in the coaxial resonators for input and output. This simplifies surface mounting of the filter to a circuit board. FIG. 5 shows a four-pole configuration. FIG. 6 shows the three-pole configuration of FIG. 4 flanked by two coaxial resonators to improve Skirt response of the filter. Resonators added to the ends of a filter to improve Skirt response are referred to as band stop resonators. FIG. 7 shows a duplexer filter having a transmitting side that leads to an antenna for output from a device to which the filter is connected and a receiving side with leads to the antenna for input to the same device. In FIG. 7, the antenna has one electrode coupled to two resonators of the filter. FIGS. 8–12 show other antenna coupling methods. FIG. 8 shows the antenna having one electrode coupled to one resonator. FIG. 9 shows two electrodes emanating from one antenna, where each electrode is coupled to a resonator. FIG. 10 shows antenna having an electrode connected between two resonators and this electrode being coupled in a new way to two other electrodes, whereby these electrodes are each coupled to a resonator. FIG. 11 shows a close up view of FIG. 10. FIG. 12 shows an antenna have a large electrode that is coupled to two resonators.

Figure 13:
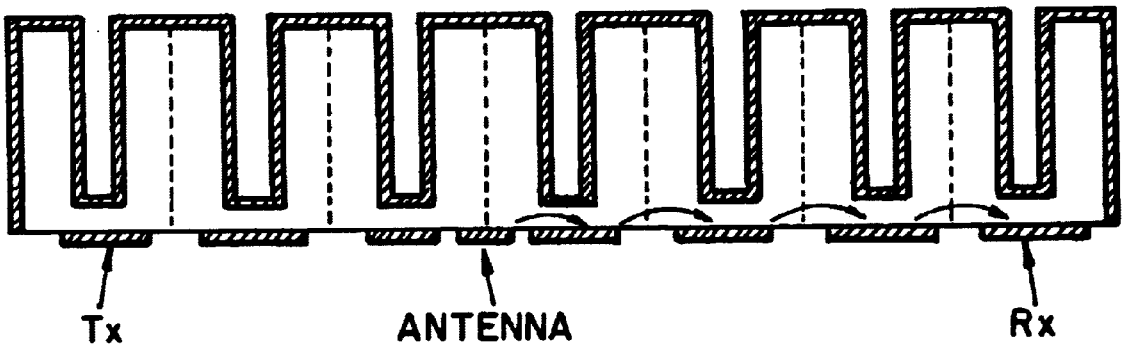
FIG. 13 is a schematic cross-sectional view of a duplexer filter employing electrode coupling between the resonators of the filter according to present invention.
Figure 14:
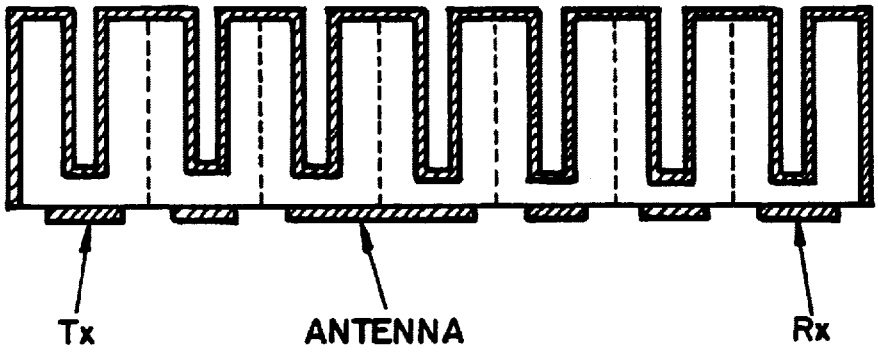
FIG. 14 is a schematic cross-sectional view of a duplexer filter employing electrode coupling between the resonators of the filter according to present invention.
Figure 15:
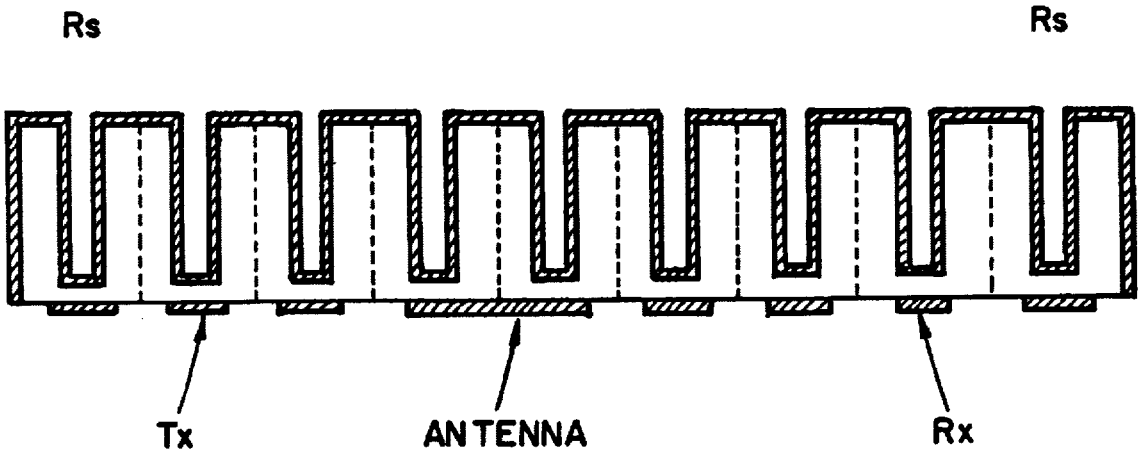
FIG. 15 is a schematic cross-sectional view of another duplexer filter employing electrode coupling between the resonators of the filter according to present invention.
Figure 16:
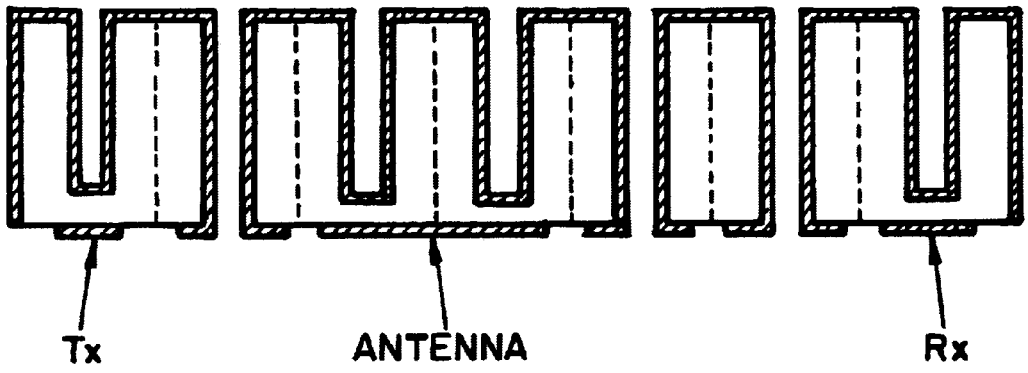
FIG. 16 is a schematic cross-sectional view of another duplexer filter employing electrode coupling between the resonators of the filter according to present invention.
Figure 17:
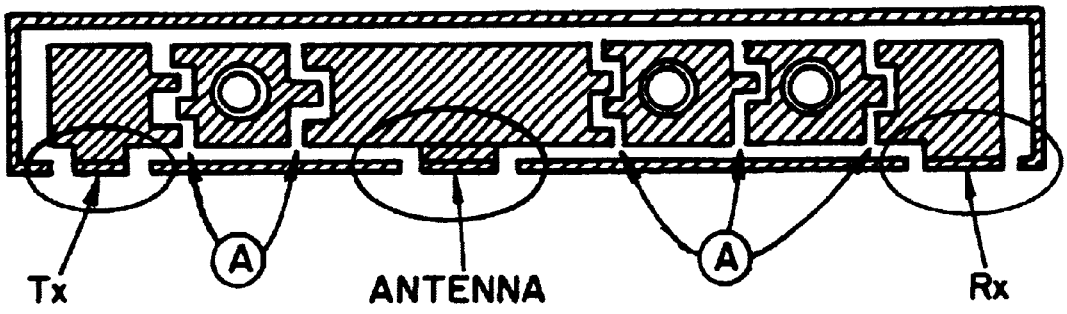
FIG. 17 is a schematic bottom view of FIG. 16.
Figure 18:
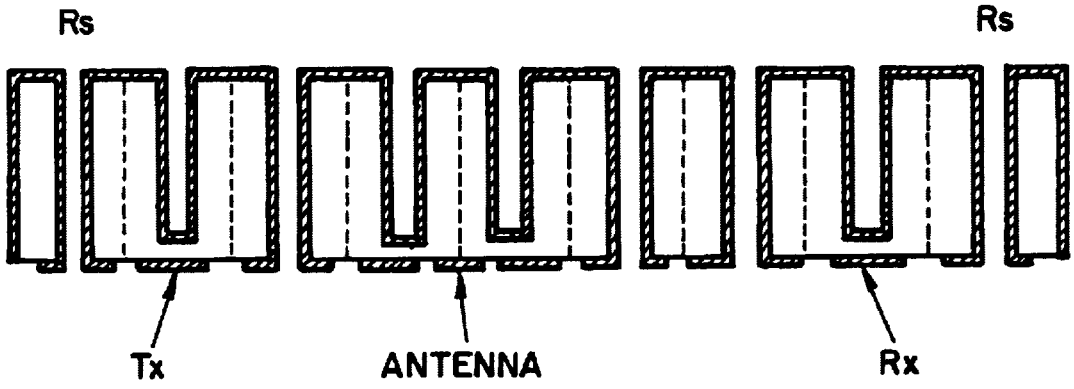
FIG. 18 is a schematic cross-sectional view of another duplexer filter employing electrode coupling between the resonators of the filter according to present invention.
Figure 19:
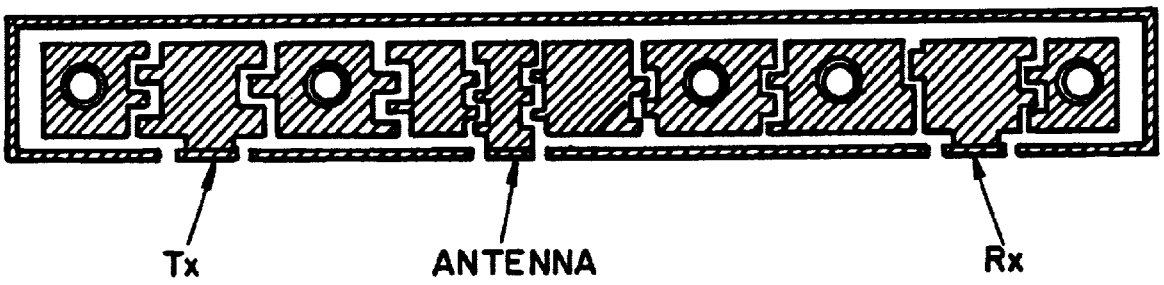
FIG. 19 is a schematic bottom view of FIG. 18.
Figure 20:
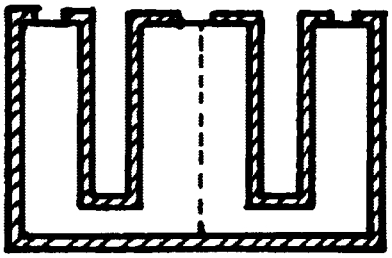
FIG. 20 is a schematic cross-sectional view of re-entrant resonators employing electrode coupling between the resonators at the top of the filter according to present invention.
Figure 21:
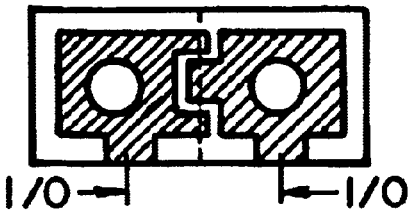
FIG. 21 is a schematic top view of FIG. 20.
Figure 22:
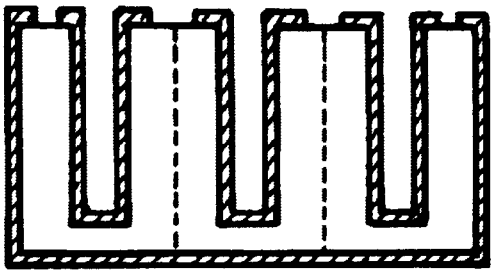
FIG. 22 is a schematic cross-sectional view of another filter of re-entrant resonators employing electrode coupling between the resonators at the top of the filter according to present invention.
Figure 23:
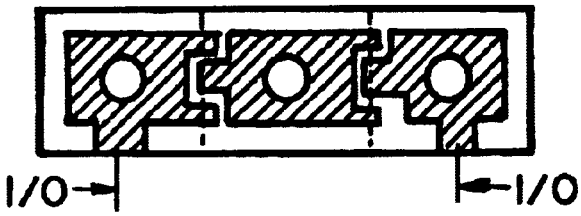
FIG. 23 is a schematic top view of FIG. 22.
Figure 24:
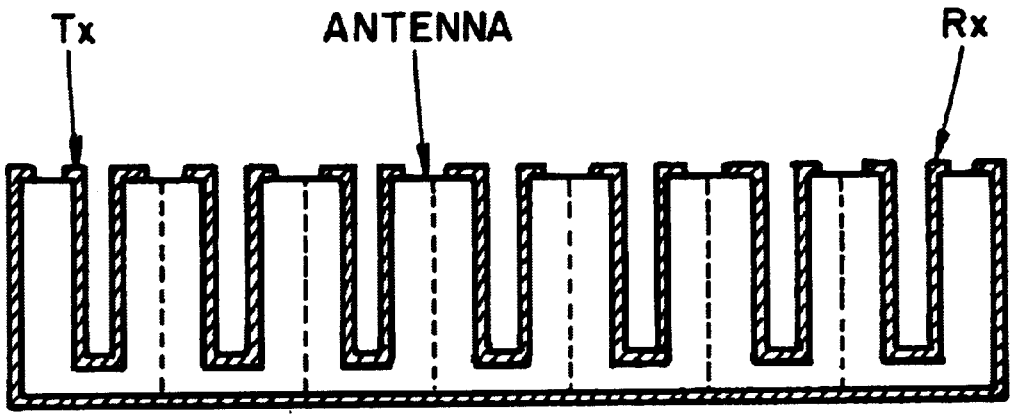
FIG. 24 is a schematic cross-sectional view of another filter of re-entrant resonators employing electrode coupling between the resonators at the top of the filter according to present invention.
Figure 25:
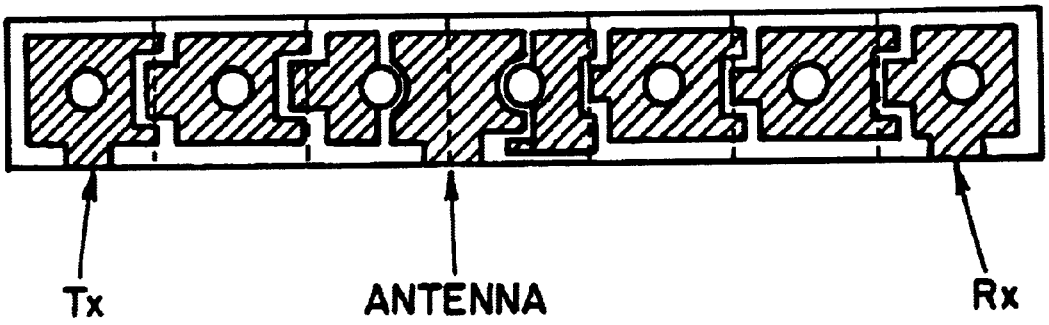
FIG. 25 is a schematic top view of FIG. 24.
Figure 26:
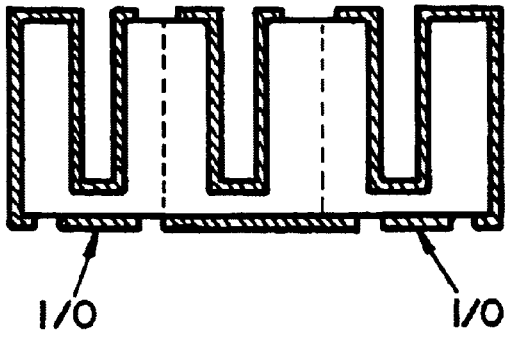
FIG. 26 is a schematic cross-sectional view of a filter of re-entrant resonators employing electrode coupling between the resonators at the top and bottom of the filter according to present invention.
Figure 27:
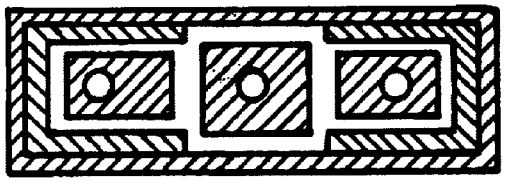
FIG. 27 is a schematic top view of FIG. 26.
Figure 28:
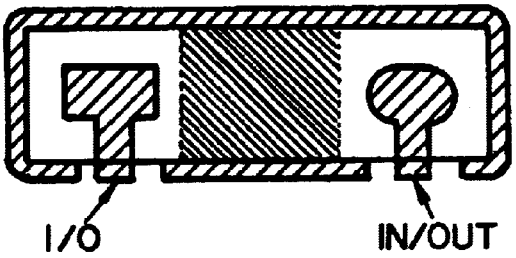
FIG. 28 is a schematic bottom view of FIG. 26.
Figure 29:
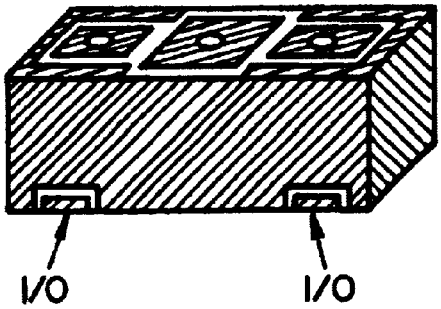
FIG. 29 is a three-dimensional top view of FIG. 26.
Figure 30:
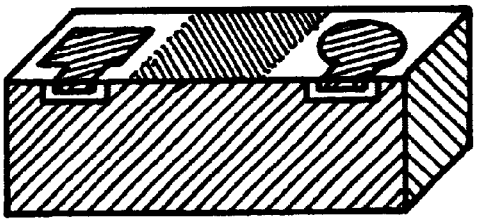
FIG. 30 is a three-dimensional bottom view of FIG. 26.
Figure 31:
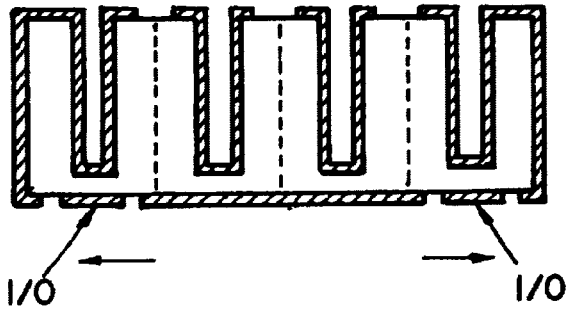
FIG. 31 is a schematic cross-sectional view of a filter of re-entrant resonators employing electrode coupling between the resonators at the top and bottom of the filter according to present invention.
Figure 32:
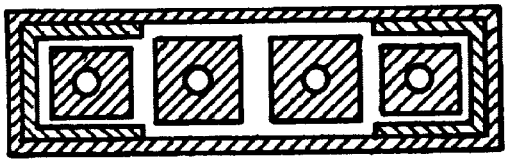
FIG. 32 is a schematic top view of FIG. 31.
Figure 33:
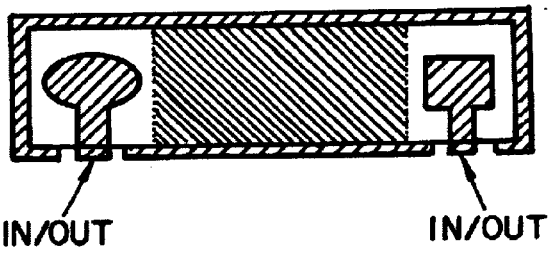
FIG. 33 is a schematic bottom view of FIG. 31.
Figure 34:
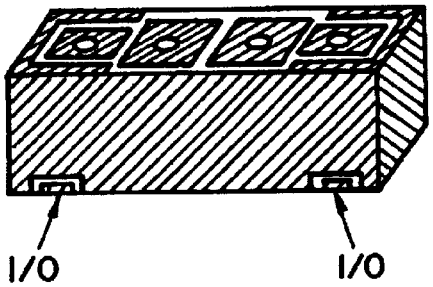
FIG. 34 is a three-dimensional top view of FIG. 31.
Figure 35:
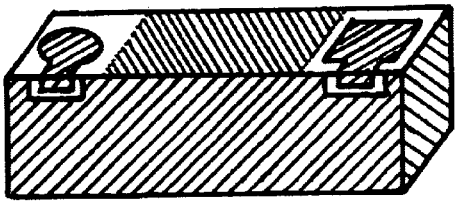
FIG. 35 is a three-dimensional bottom view of FIG. 31.
Figure 36:
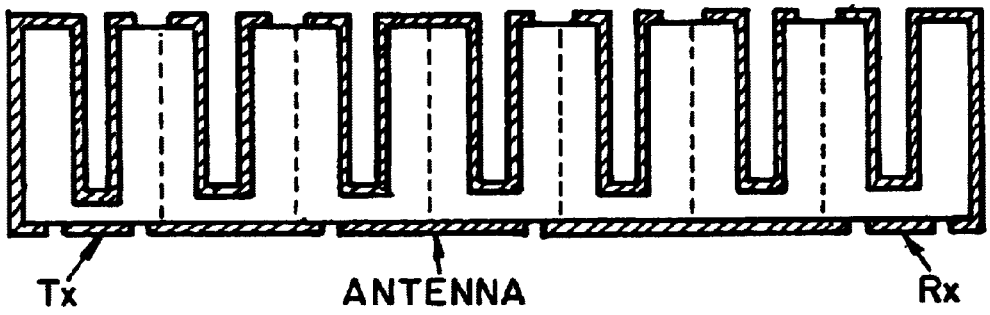
FIG. 36 is a schematic cross-sectional view of a filter of re-entrant resonators employing electrode coupling between the resonators at the top and bottom of the filter according to present invention.
Figure 37:
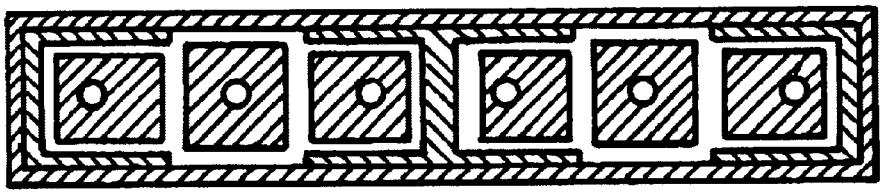
FIG. 37 is a schematic top view of FIG. 36.
Figure 38:
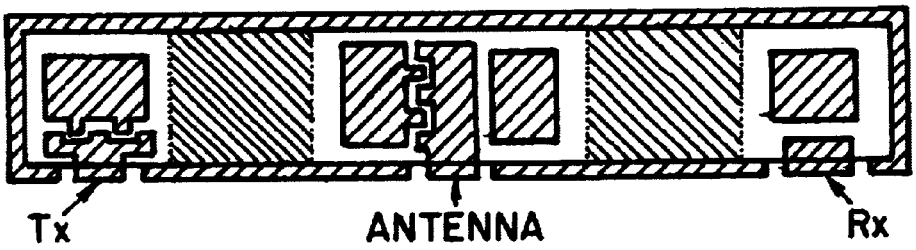
FIG. 38 is a schematic bottom view of FIG. 36.
Figure 39:
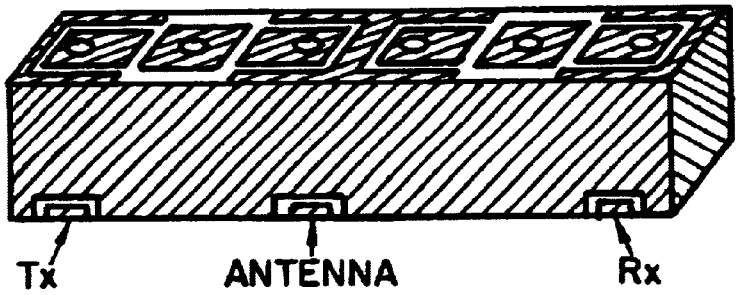
FIG. 39 is a three-dimensional top view of FIG. 36.
Figure 40:
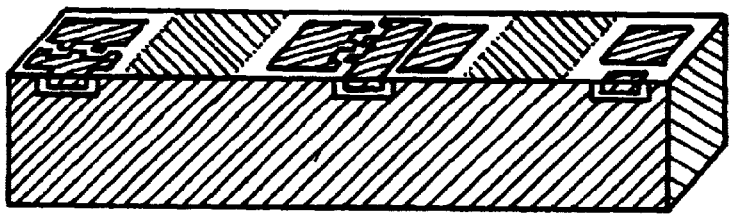
FIG. 40 is a three-dimensional bottom view of FIG. 36.
Figure 41:
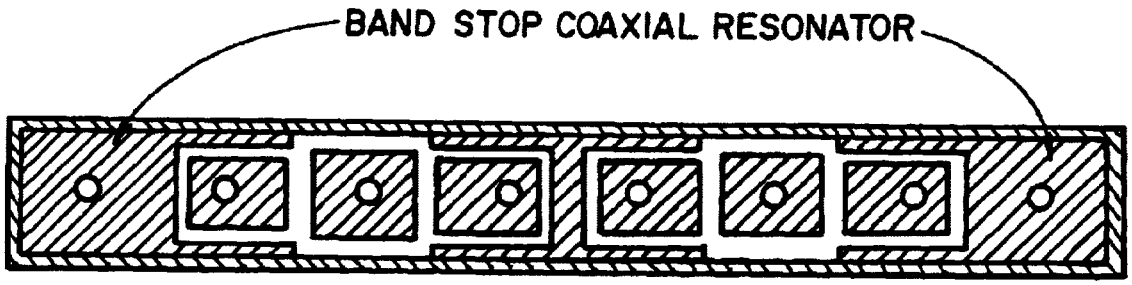
FIG. 41 is a schematic top view of a filter of re-entrant resonators with coaxial resonators at the ends to improve Skirt response and employs electrode coupling between the resonators at the top and bottom of the filter according to present invention.
Figure 42:
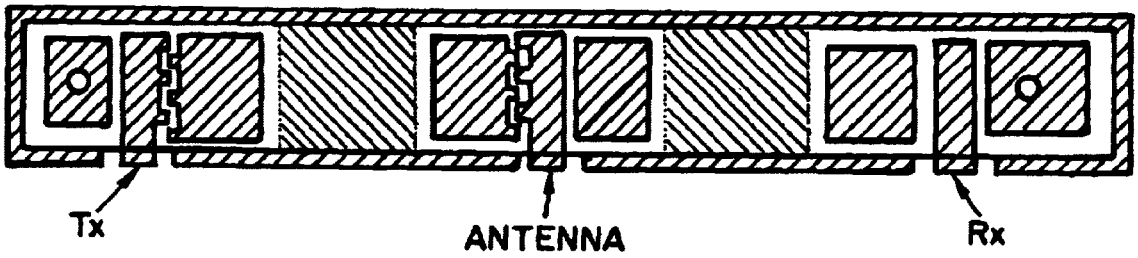
FIG. 42 is a schematic bottom view of FIG. 41.
Figure 43:
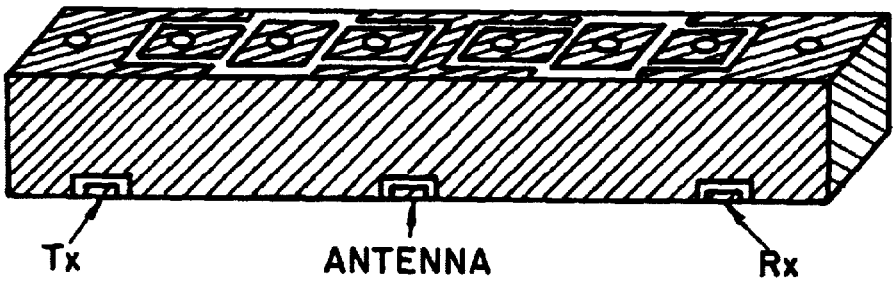
FIG. 43 is a three-dimensional top view of FIG. 41.
Figure 44:
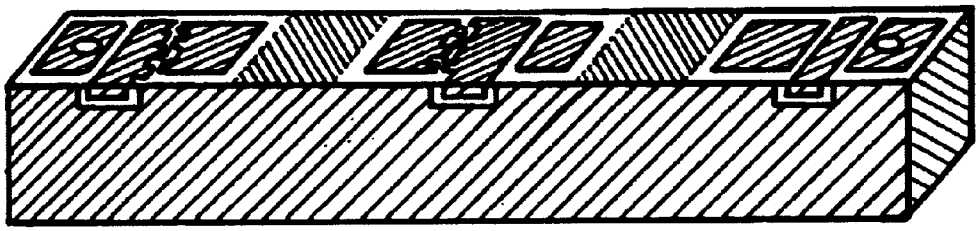
FIG. 44 is a three-dimensional bottom view of FIG. 41.
Figure 45:
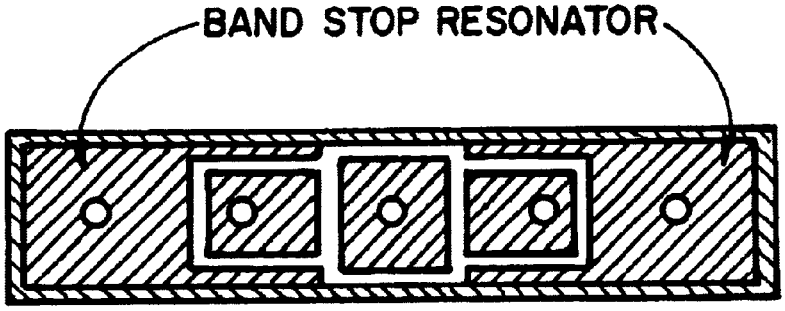
FIG. 45 is a schematic top view of the filter of FIG. 27 with coaxial resonators at the ends to improve Skirt response and employs electrode coupling between the resonators at the top and bottom of the filter according to present invention.
Figure 46:
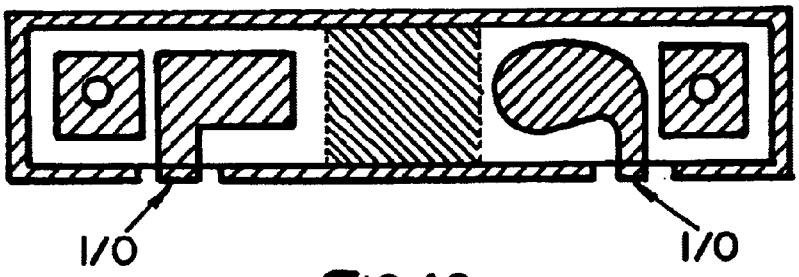
FIG. 46 is a schematic bottom view of FIG. 45.
Figure 47:
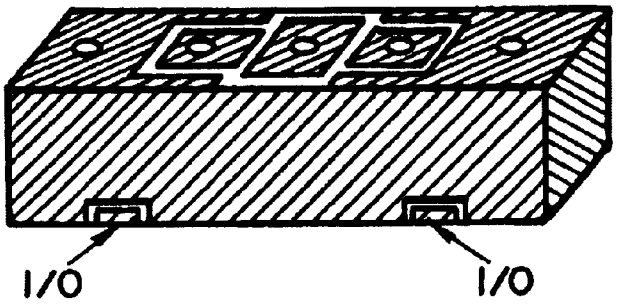
FIG. 47 is a three-dimensional top view of FIG. 45.
Figure 48:
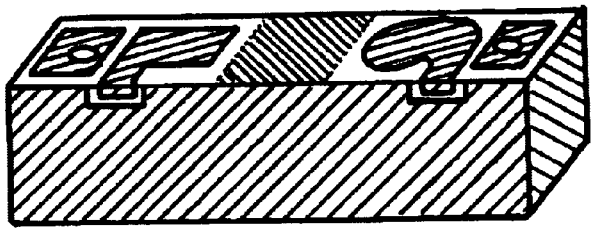
FIG. 48 is a three-dimensional bottom view of FIG. 45.
Figure 49:
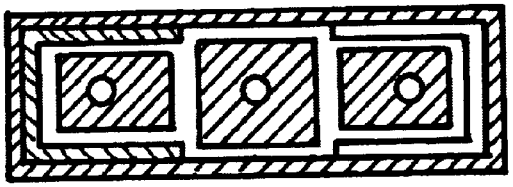
FIG. 49 is a schematic top view of a filter of coaxial and re-entrant resonators which employs electrode coupling between the resonators at the top and bottom of the filter according to present invention.
Figure 50:
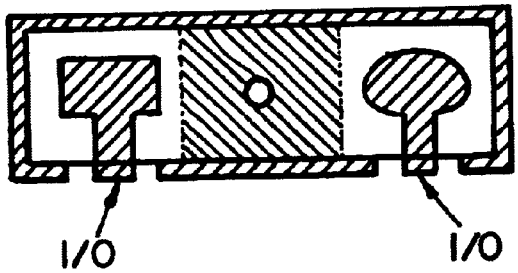
FIG. 50 is a schematic bottom view of FIG. 49.
Figure 51:
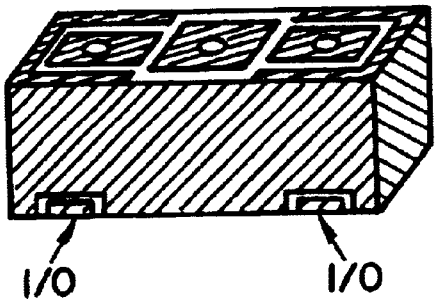
FIG. 51 is a three-dimensional top view of FIG. 49.
Figure 52:
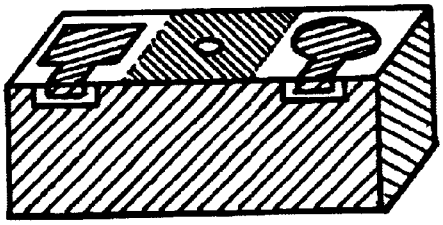
FIG. 52 is a three-dimensional bottom view of FIG. 49.
Figure 53:
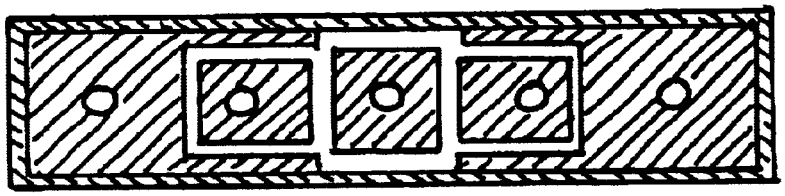
FIG. 53 is a schematic top view of a filter of coaxial and re-entrant resonators with coaxial resonators at the ends to improve Skirt response, where the filter employs electrode coupling between the resonators at the top and bottom of the filter according to present invention.
Figure 54:
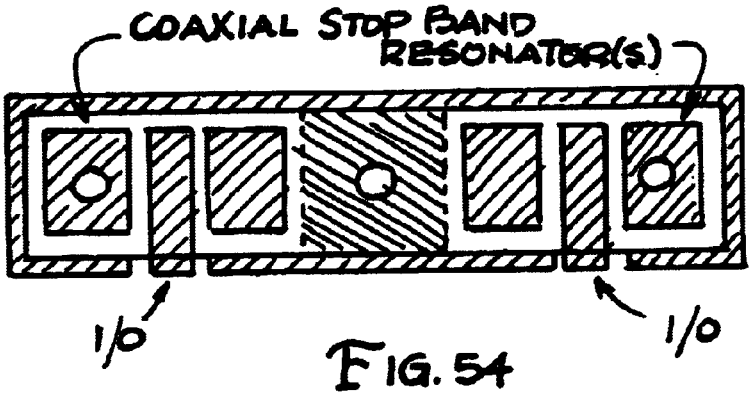
FIG. 54 is a schematic bottom view of FIG. 53.
Figure 55:
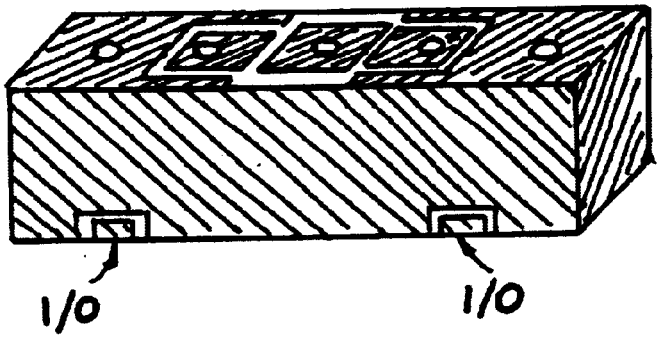
FIG. 55 is a three-dimensional top view of FIG. 53.
Figure 56:
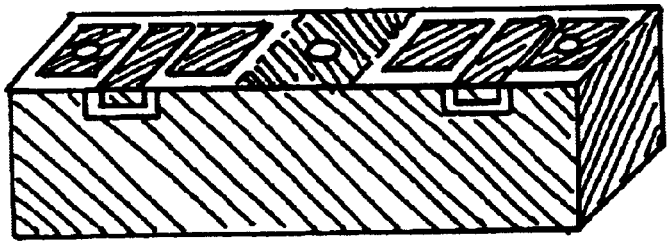
FIG. 56 is a three-dimensional bottom view of FIG. 53.
Figure 57:
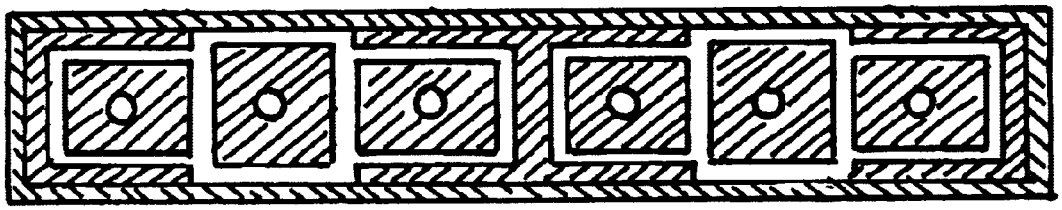
FIG. 57 is a schematic top view of a duplexer filter of coaxial and re-entrant resonators, where the filter employs electrode coupling between the resonators at the top and bottom of the filter according to present invention.
Figure 58:
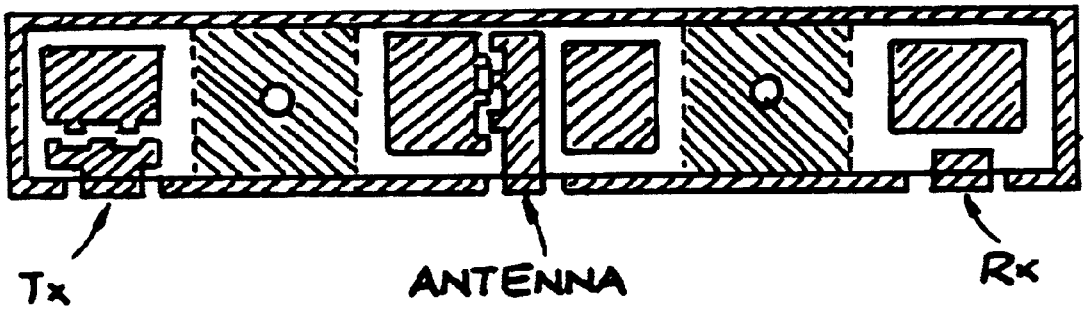
FIG. 58 is a schematic bottom view of FIG. 57.
Figure 59:
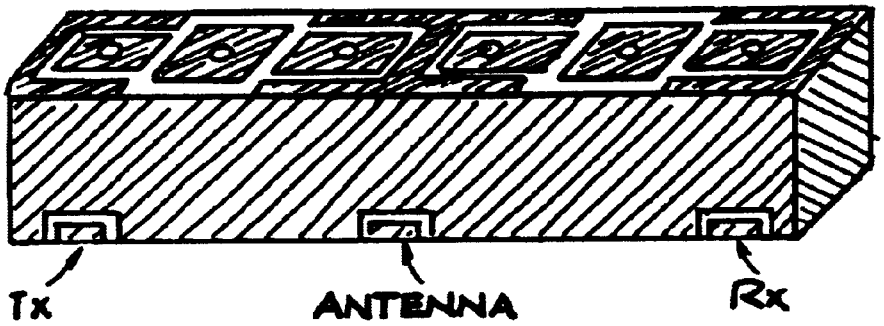
FIG. 59 is a three-dimensional top view of FIG. 57.
Figure 60:
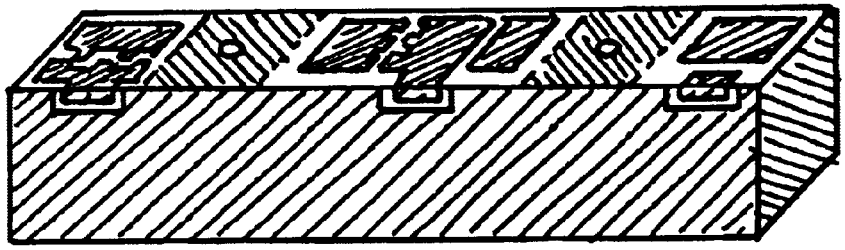
FIG. 60 is a three-dimensional bottom view of FIG. 57.
Figure 61:
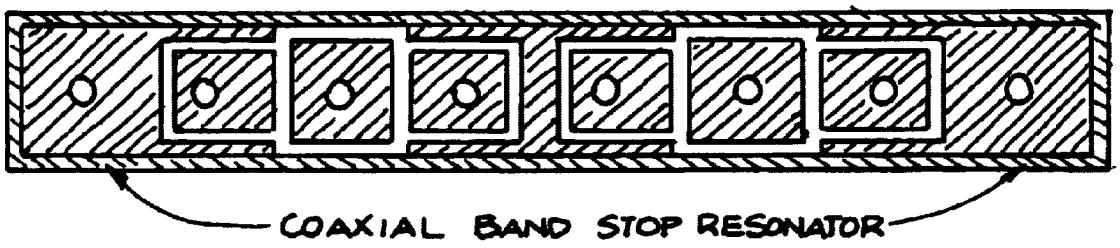
FIG. 61 is a schematic top view of a duplexer filter of coaxial and re-entrant resonators with coaxial resonators at the ends to improve Skirt response, where the filter employs electrode coupling between the resonators at the top and bottom of the filter according to present invention.
Figure 62:
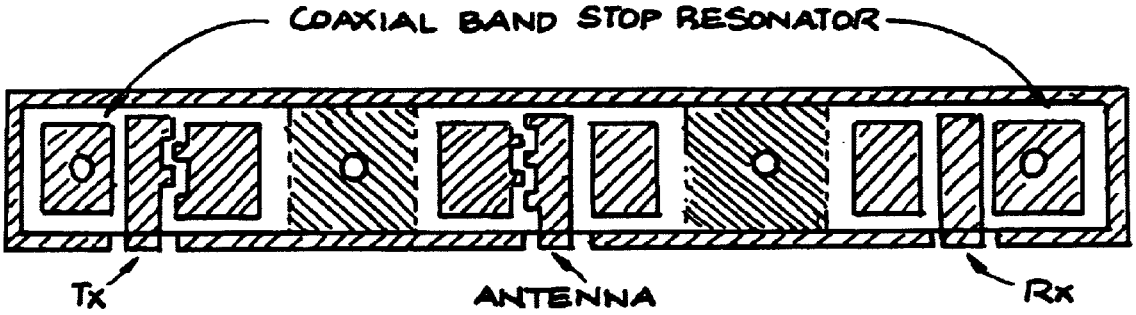
FIG. 62 is a schematic bottom view of FIG. 61.
Figure 63:
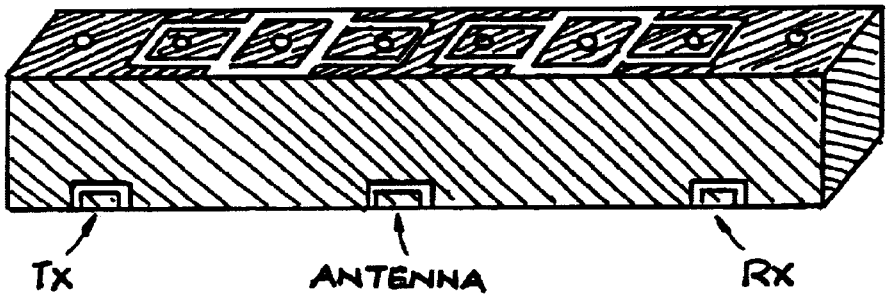
FIG. 63 is a three-dimensional top view of FIG. 61.
Figure 64:
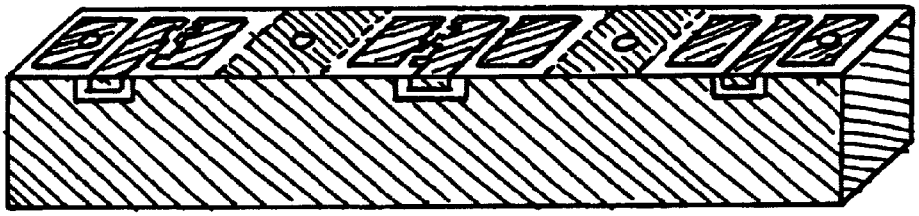
FIG. 64 is a three-dimensional bottom view of FIG. 61.

FIGS. 13–64 show a method of coupling resonators, similar to the antenna coupling of FIG. 10. In FIGS. 13–64, electrode coupling is used, whereby electric and magnetic fields jump from electrode to electrode through the dielectric material of the resonator instead of through IRIS passages. This allows the filter to be made from a monolithic single block of ceramic or other material. FIGS. 13–14 show a duplexer filter, but with different antenna coupling configurations. FIG. 15 shows a duplexer with band stop resonators for improving Skirt response. FIGS. 16–17 show cross-section and bottom views of applying the method of FIGS. 13–15 to form a filter from a monolithic single ceramic block, yet include both re-entrant resonators and coaxial resonators. Here the electrodes of the coaxial resonators are attached to dielectric material common to other electrodes, namely the electrodes of the re-entrant resonators. Whereby, the electric and magnetic fields jump from one electrode to another. FIGS. 18–19 show a version of FIG. 16–17 with additional resonators to improve skirt response. FIGS. 20–25 show the use of re-entrant resonators with all of the electrodes mounted to a top surface of the monolithic single ceramic block. FIGS. 26–44 show a combination of both top and bottom electrodes on a monolithic single ceramic block of re-entrant resonators. FIGS. 45–48 show respectively top, bottom and three-dimensional views of the three-pole configuration of FIG. 27 flanked by two coaxial resonators to improve Skirt response of the filter. FIGS. 49–64 show a monolithic single ceramic block with a mixture of re-entrant resonators and coaxial resonators with top and bottom electrodes.

Figure 65:
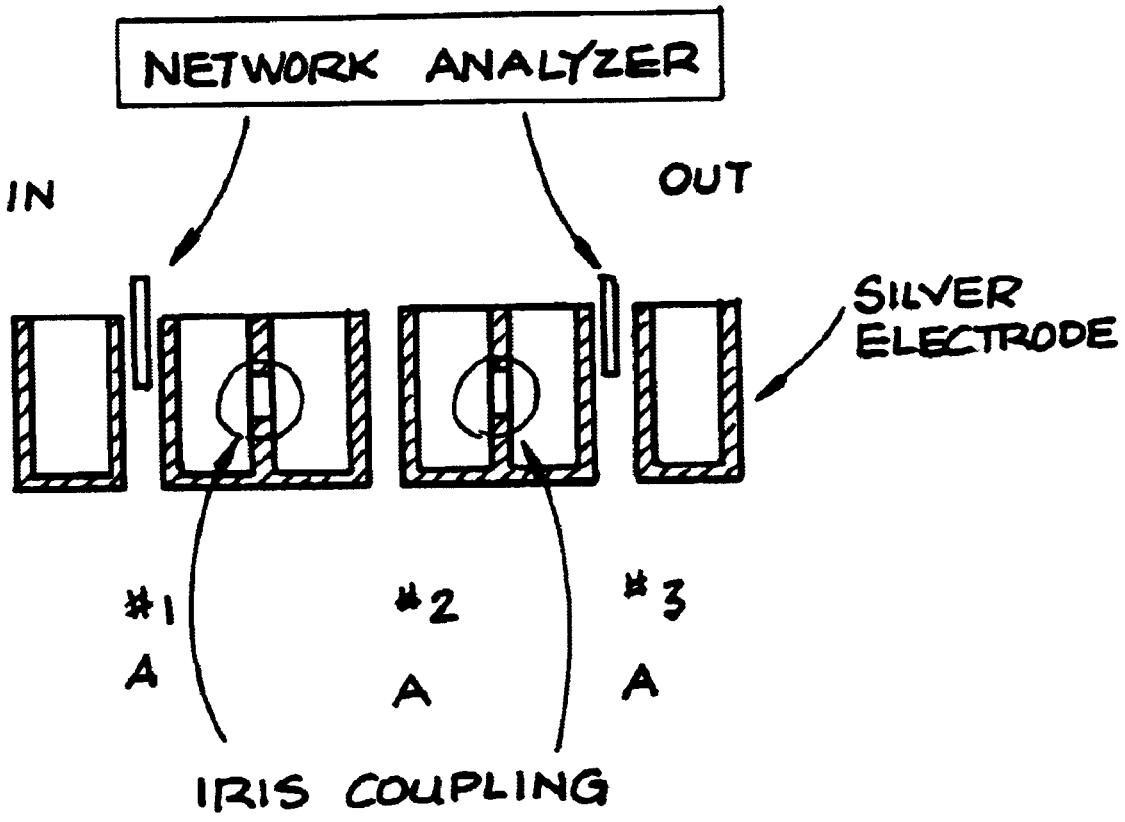
FIG. 65 is a schematic cross-sectional view of a three-pole filter used as a base line according to the present invention.
Figure 66:
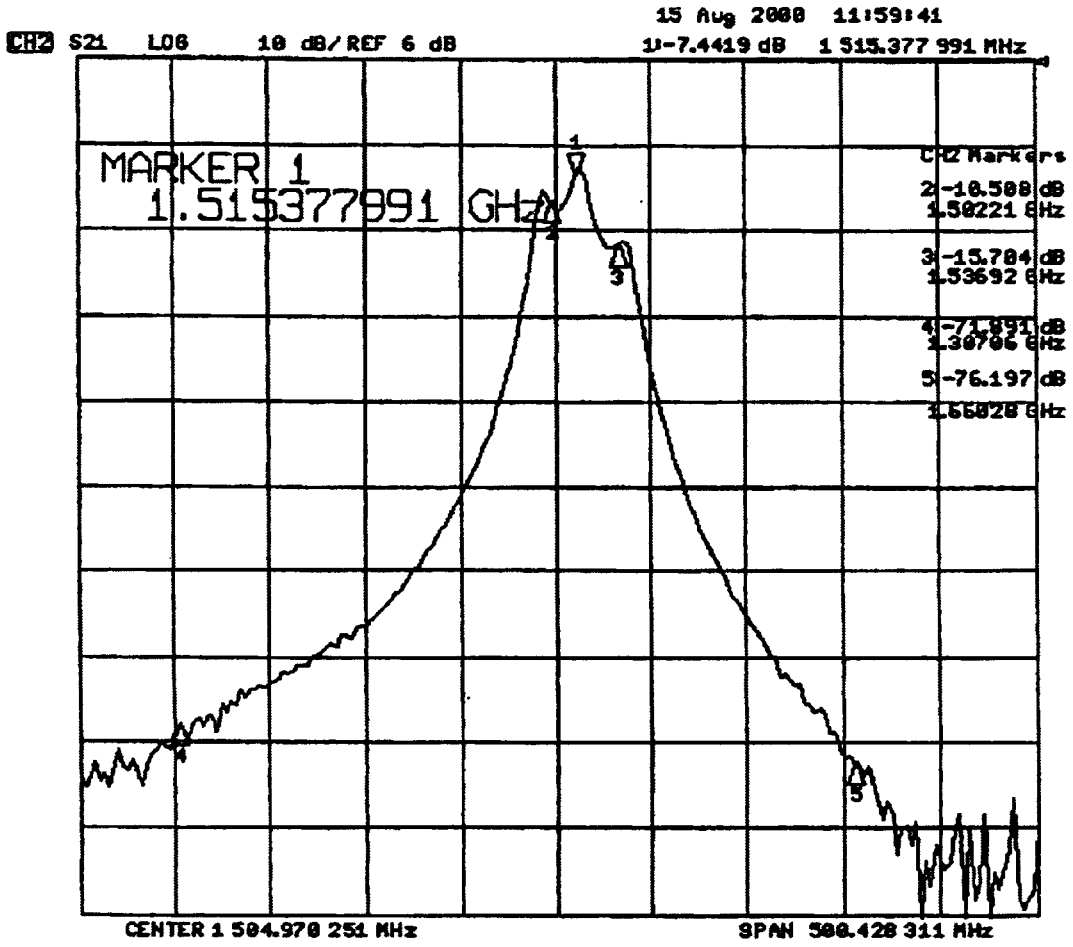
FIG. 66 is a plot of the filter response of the filter of FIG. 65 according to the present invention.
Figure 67:
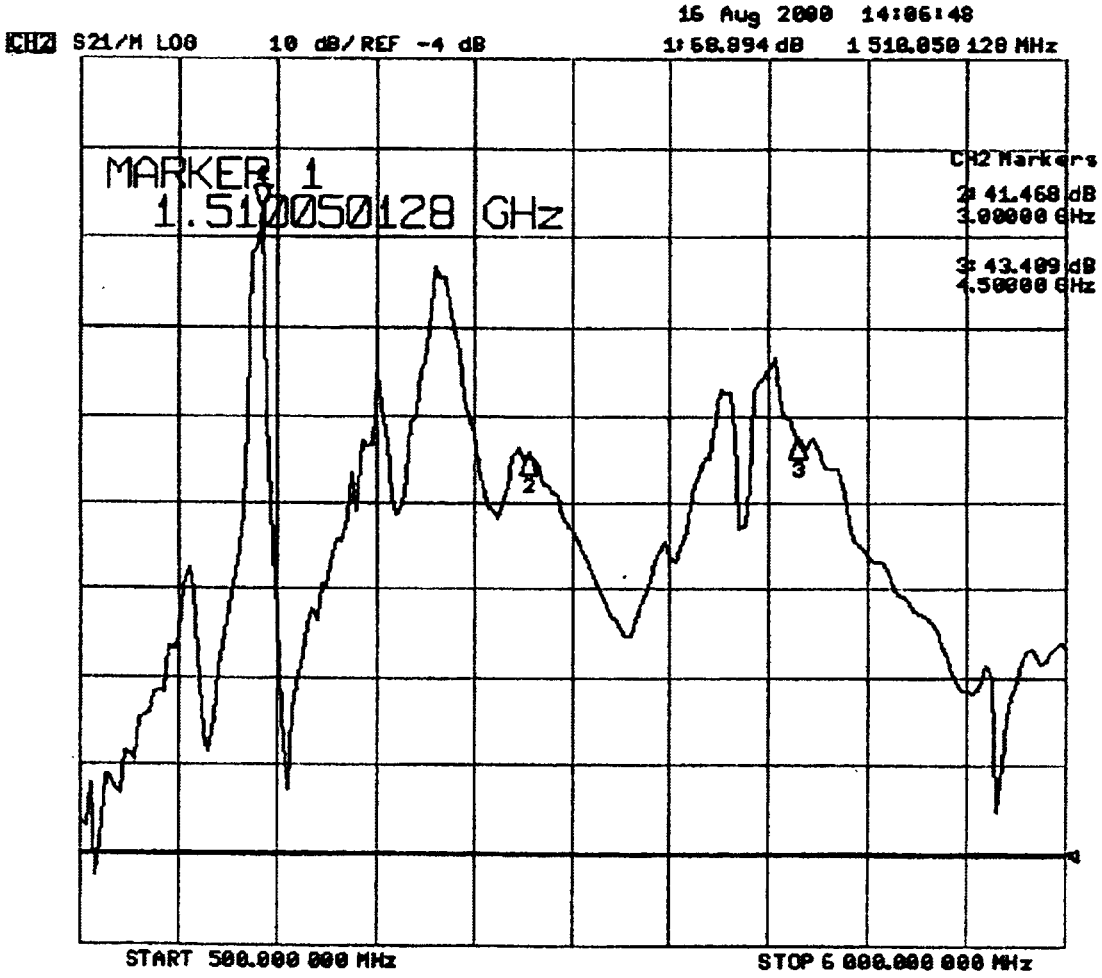
FIG. 67 is a plot of the spurious frequency response of the filter of FIG. 65 according to the present invention.
Figure 68:
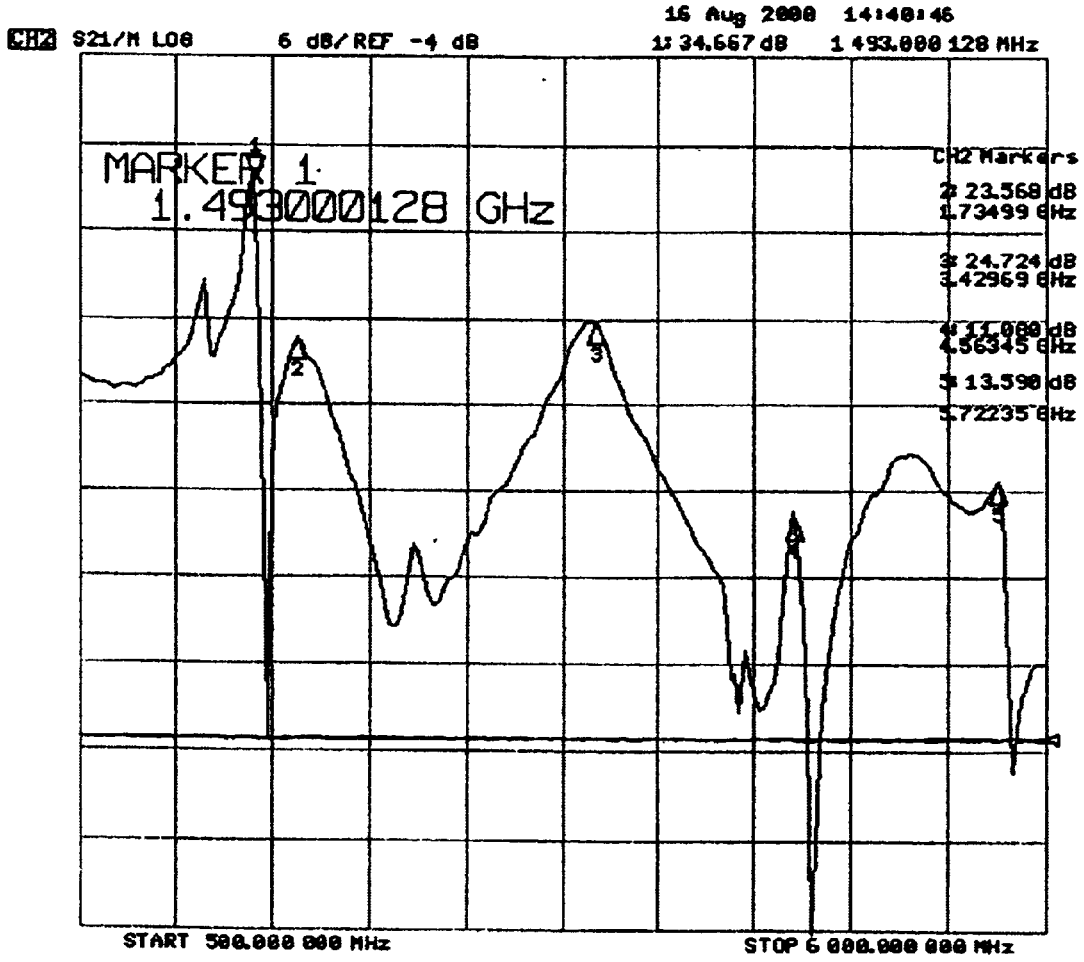
FIG. 68 is a plot of the frequency response of coaxial resonator #1 shown in FIG. 65 according to the present invention.
Figure 69:
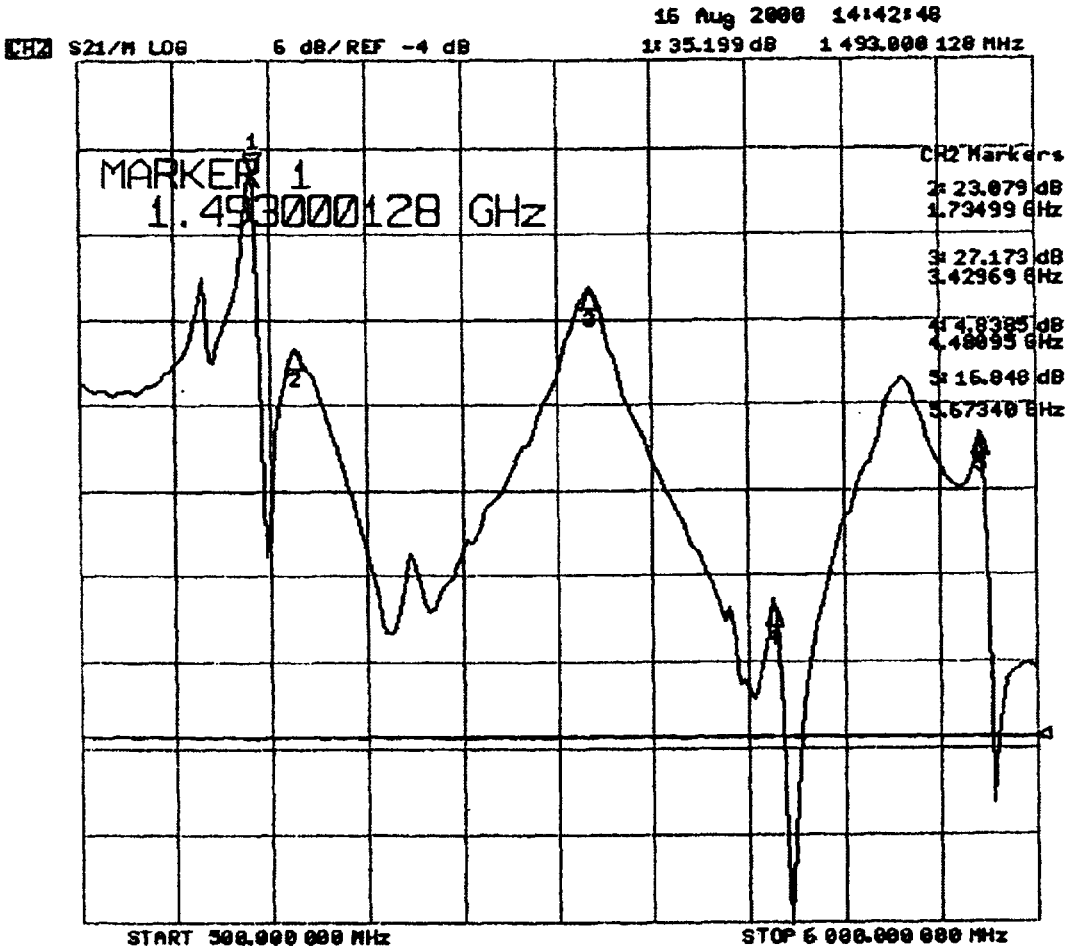
FIG. 69 is a plot of the frequency response of coaxial resonator #2 shown in FIG. 65 according to the present invention.
Figure 70:
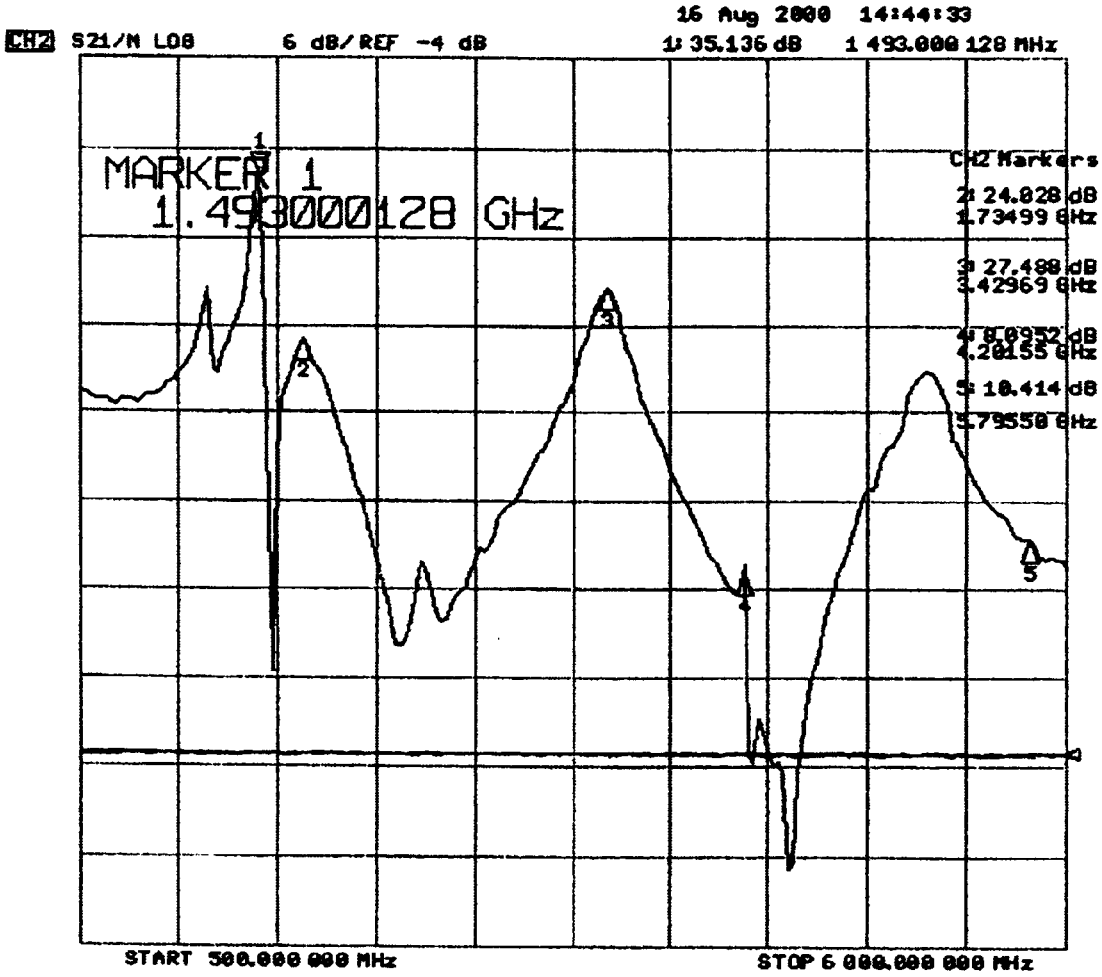
FIG. 70 is a plot of the frequency response of coaxial resonator #3 shown in FIG. 65 according to the present invention.
Figure 71:
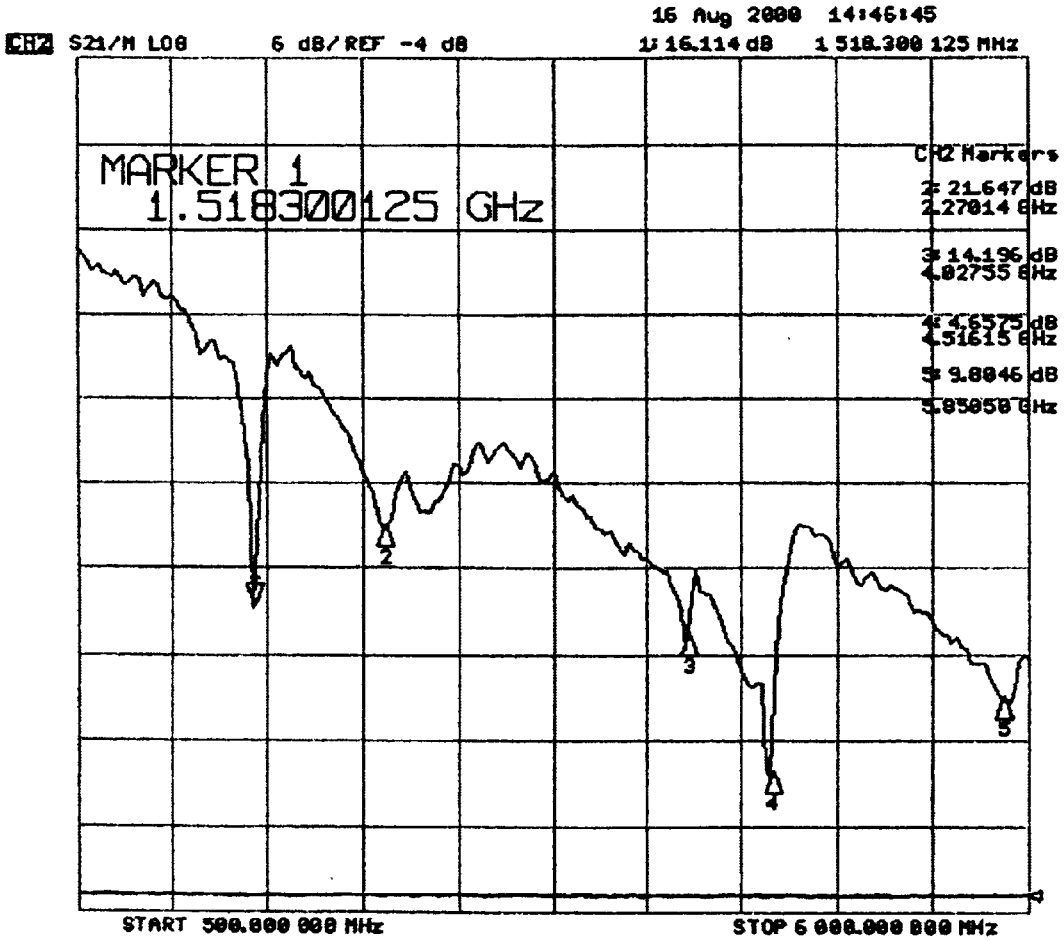
FIG. 71 is a plot of the frequency response of a re-entrant resonator according to the present invention.

The following describes methods to improve spurious frequency response of a filter by using different resonator types and by reversing resonator orientation. FIG. 65 shows a three-pole band pass filter, AAA to use as a base line response. The AAA filter was modeled after commercially available dielectric filters. Notice that all three "A" resonators, #1, #2, #3, are oriented same direction for the AAA filter. Three "A" resonators were selected and adjusted to make the band pass response of FIG. 66. The spurious frequency response of the AAA filter is shown in FIG. 67. Individual frequency response of each of the three resonators, #1, #2, #3, of the AAA filter is shown in FIGS. 68–70. Notice that there are the first and third harmonics of around 1.5 G Hz and 4.5 G Hz, respectively. The rest of the spurious frequency responses of above the first resonant peak are due to the higher order-mode in coaxial resonators, such as TE-mode, which is well known. The higher mode can exist only above the cutoff frequency of resonator. For testing purposes, the cutoff frequency was chosen to equal 1.9 G Hz, so that the most of the spurious frequency response above 1.9 G Hz can be explained as the higher-order-mode, which is unwanted for a band pass filter. FIG. 67 is base line data and other filter responses using different resonator types and reverse resonator orientation methods will be compared to FIG. 67. Also, a re-entrant resonator was used having a frequency response as shown in FIG. 71.

Figure 72:
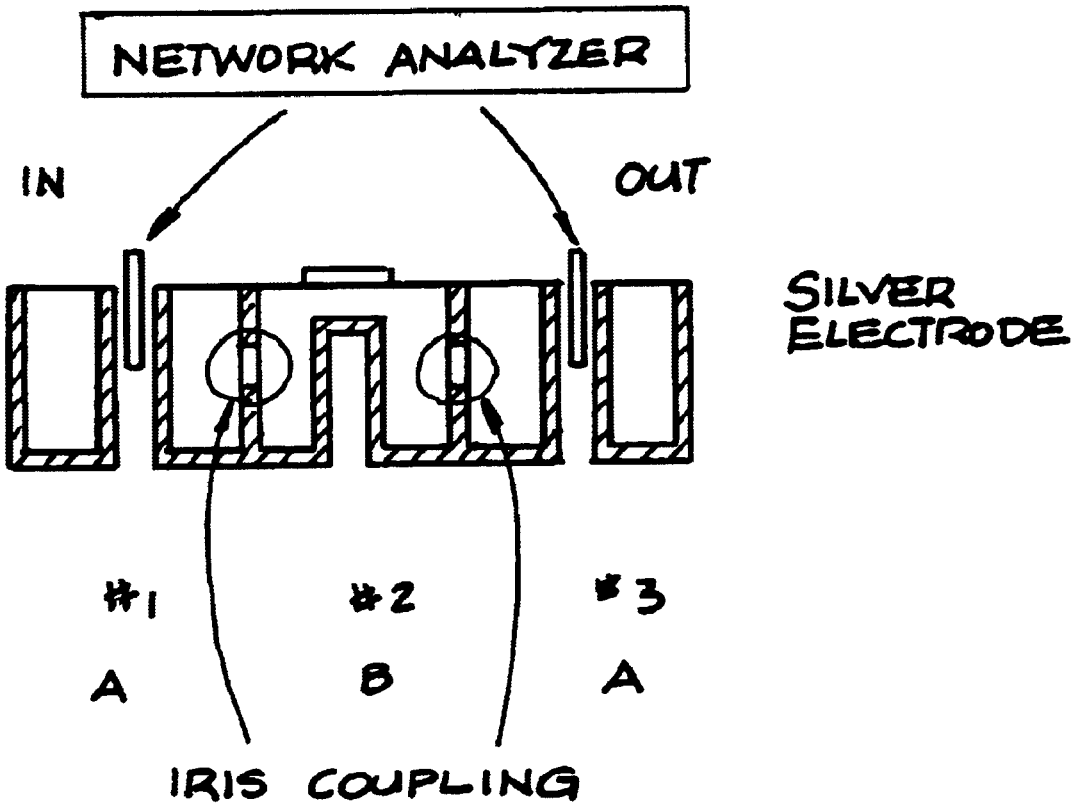
FIG. 72 is a schematic cross-sectional view of a three-pole filter similar to FIG. 65, where the #2 coaxial resonator is replaced by the re-entrant resonator of FIG. 71 according to the present invention.
Figure 73:
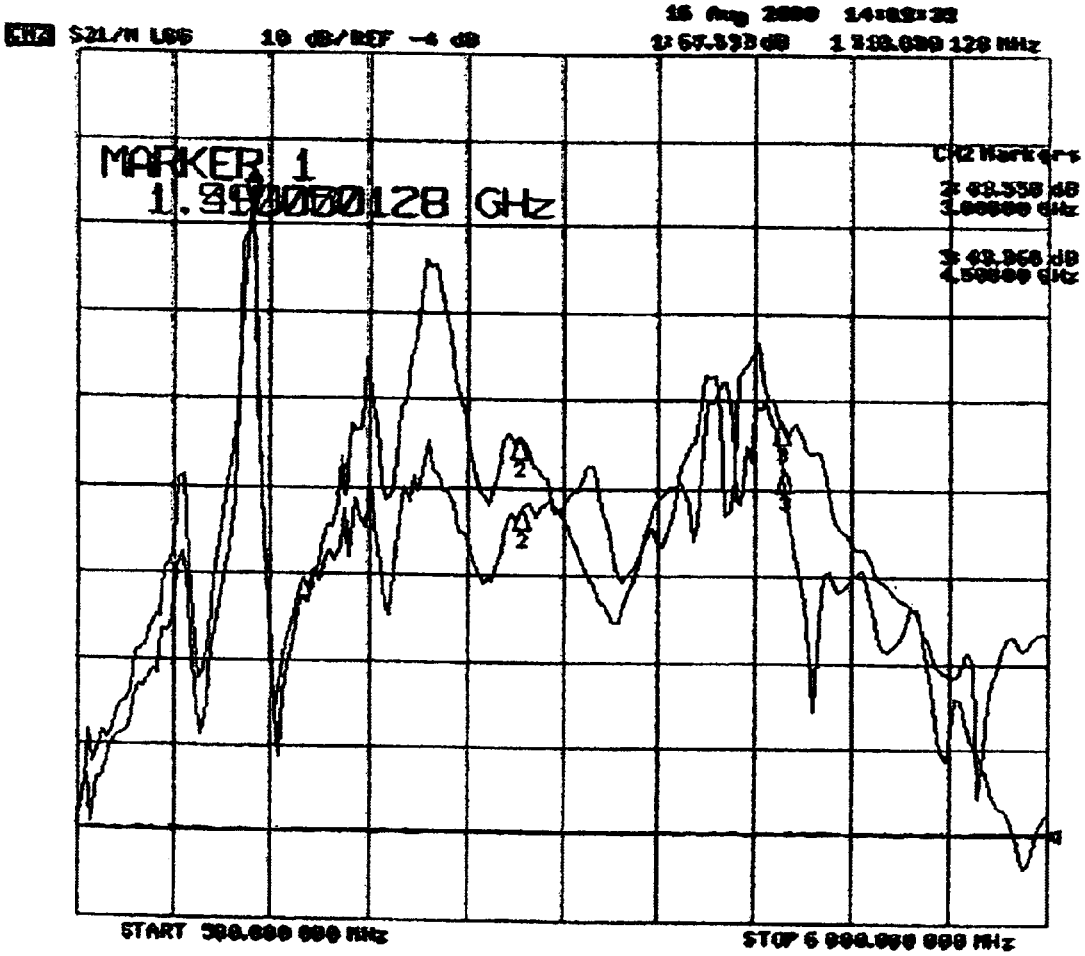
FIG. 73 is a plot of the frequency response of the filter shown in FIG. 72 according to the present invention.

In the data, the resonant peaks appear opposite in direction because of the single resonator coupling to a Network Analyzer, which is a convenient way to make a sample holder. A band pass filter ABA was made as shown in FIG. 72 by replacing the center #2 resonator of FIG. 66 with the re-entrant resonator having the frequency response shown in FIG. 71. The frequency response of the ABA filter is shown in FIG. 73 overlapping the base line data of FIG. 67. By replacing the center coaxial resonator with a re-entrant resonator, the spurious frequency response was improved the over wide range of higher frequency without adversely affecting the main filter characteristics near the first resonant peak.

Figure 74:
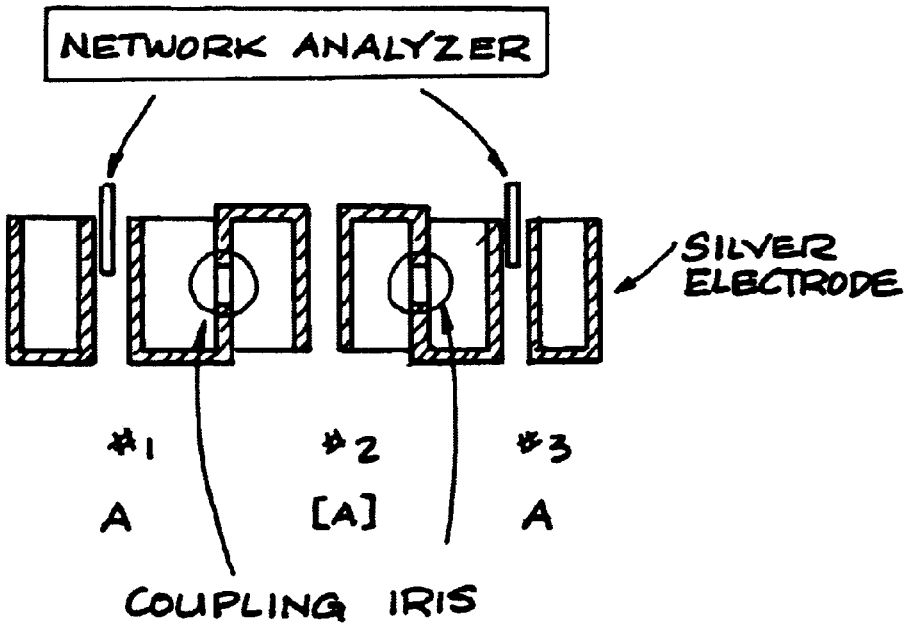
FIG. 74 is a schematic cross-sectional view of a three-pole filter similar to FIG. 65, where the #2 coaxial resonator is reversed in orientation according to the present invention.
Figure 75:
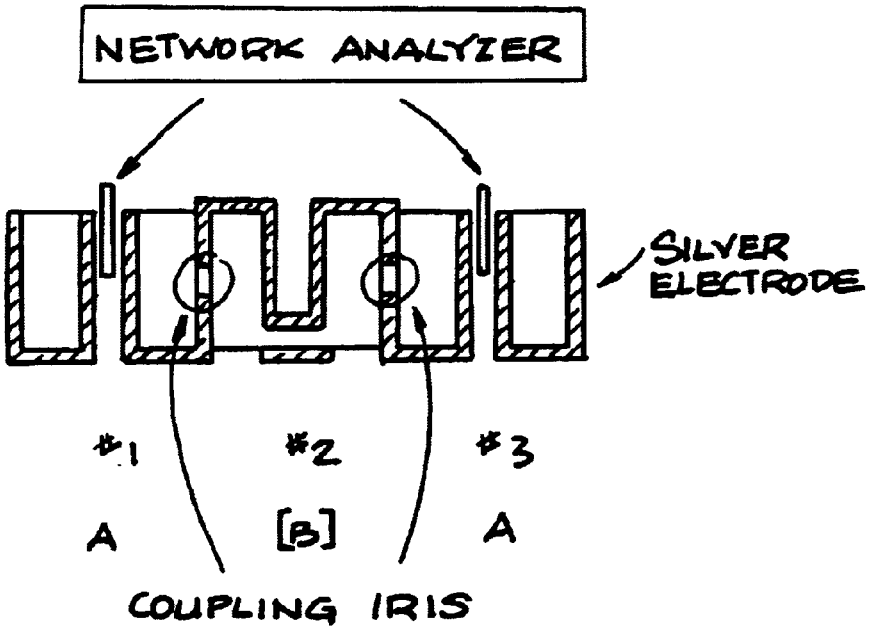
FIG. 75 is a schematic cross-sectional view of a three-pole filter similar to FIG. 72, where the #2 re-entrant resonator is reversed in orientation according to the present invention.
Figure 76:
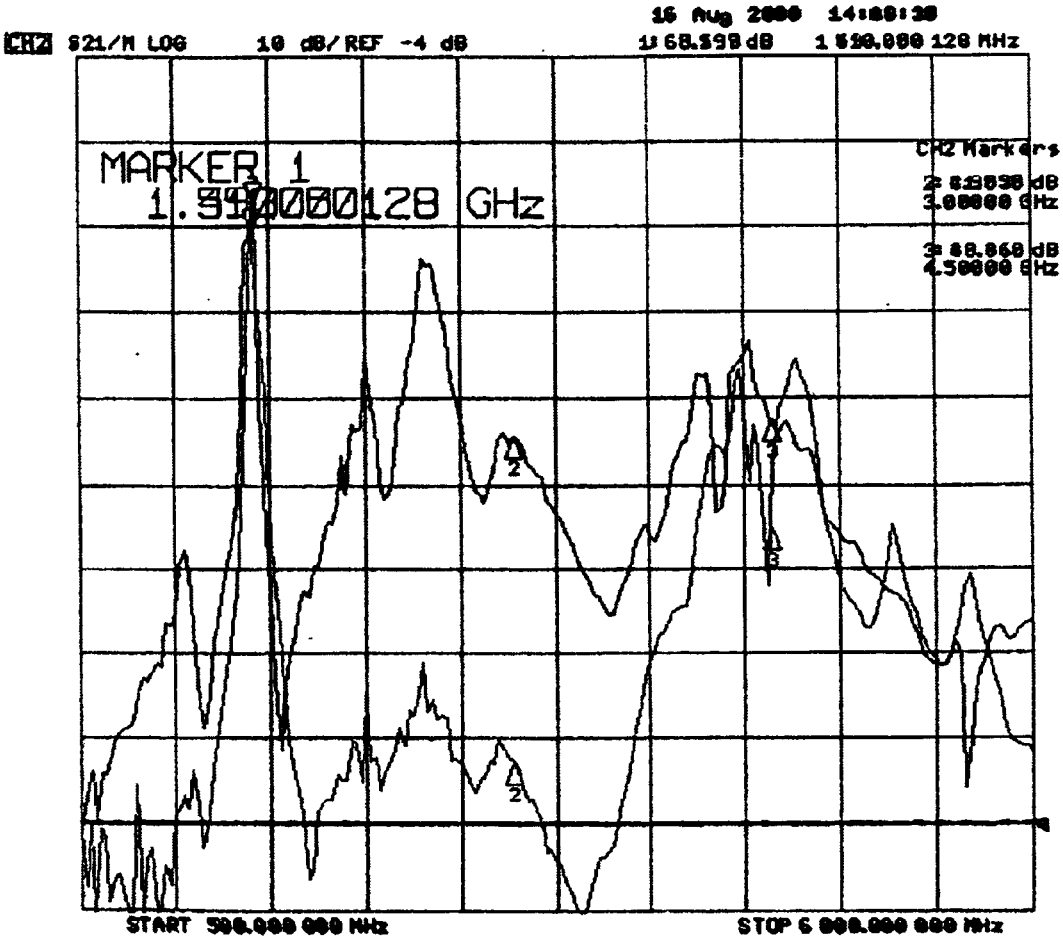
FIG. 76 is a plot of the frequency response of the filter shown in FIG. 74 according to the present invention.
Figure 77:
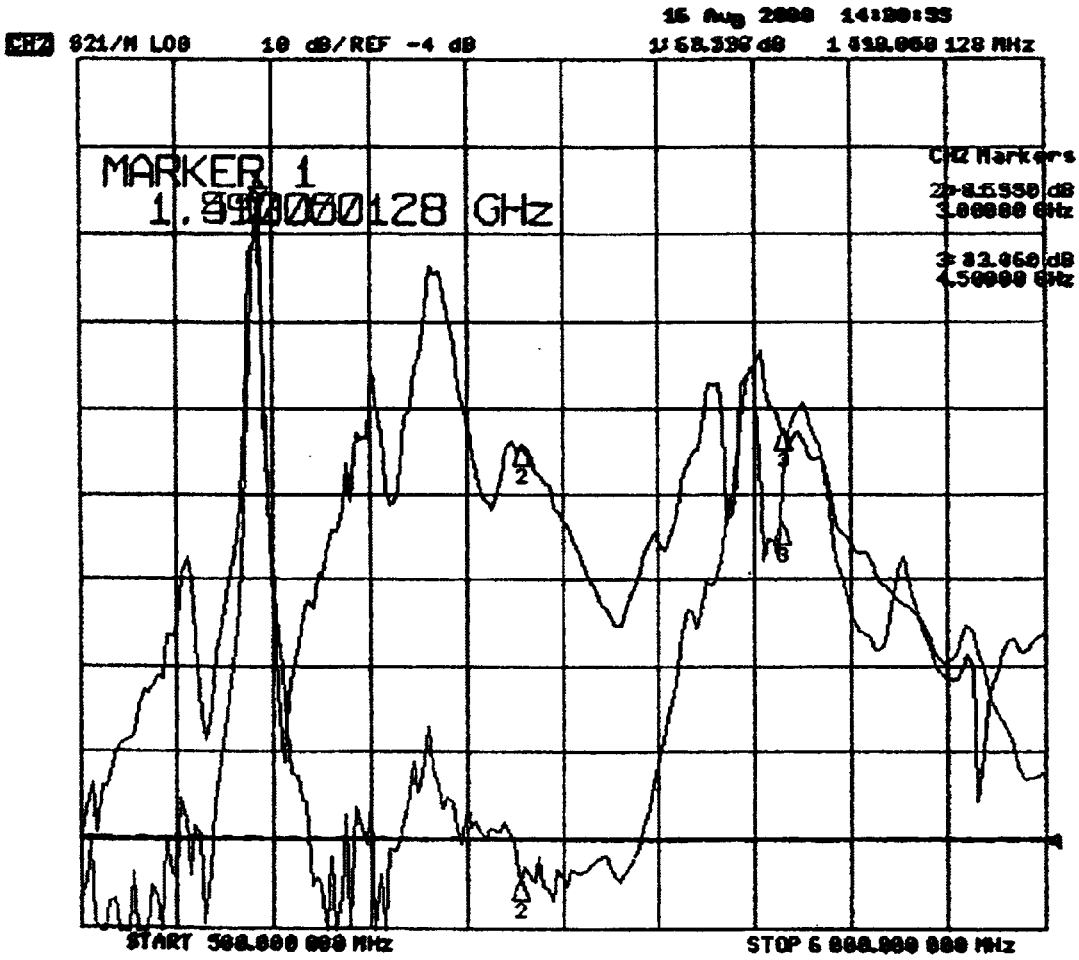
FIG. 77 is a plot of the frequency response of the filter shown in FIG. 75 according to the present invention.

In addition to the above method of mixing resonators to reduce the spurious frequency responses of dielectric filters, a new coupling technique of reversing resonator orientation also improves filter characteristics. Orientation of a resonator is defined by the top of the resonator which has no electrode coating. FIGS. 74–75 show the new coupling method, which is the flipping over of the center resonator in the AAA and ABA filters, as shown in FIGS. 65 and 72, respectively. As can be seen from FIGS. 65 and 72, the resonators are orientated with all of the tops without electrode pointing upward. FIG. 74 shows filter A[A]A and FIG. 75 shows filter A[B]A, whereby the middle resonator of each filter is orientated with the top pointing downward. The same IRIS coupling is used in all of the AAA, ABA, A[A]A and A[B]A filters. The filter characteristics of the A[A]A filter are shown in FIG. 76 overlapping those of the AAA filter response. The filter characteristics of the A[B]A filter are shown in FIG. 77 overlapping those of the AAA filter response. As can been seen from FIGS. 76–77, there is an improvement in frequency responses that were achieved without effecting the main filter characteristics of around 1.5 GHz for the first resonant peak. It is believed that these improvements stem from center resonator having a magnetic field that is opposite as compared to the magnetic fields of the outside resonators of the filter. The filters of FIGS. 74–75 can be made from a monoblock of material. The method reversing the orientation of a resonator in a filter can be applied to any number of POLE filters made, such as four-pole, five-pole and up to the nth-pole.

Figure 78:
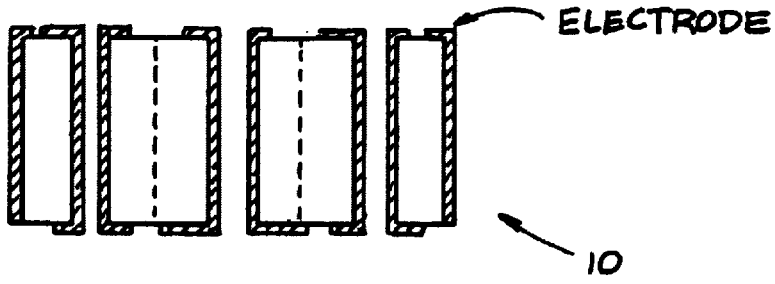
FIG. 78 is a schematic cross-sectional view of a filter employing electrode coupling to reverse resonator orientation in a filter according to present invention.
Figure 79:
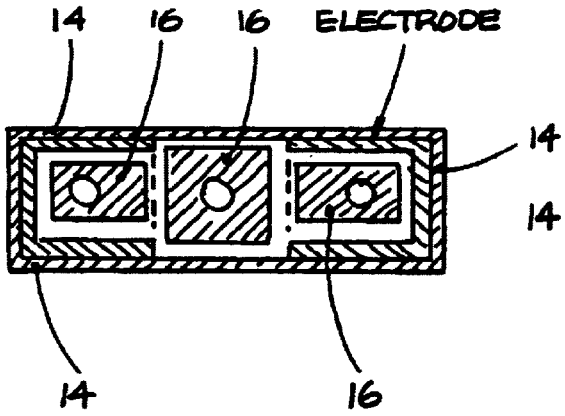
FIG. 79 is a top view of FIG. 78.
Figure 80:
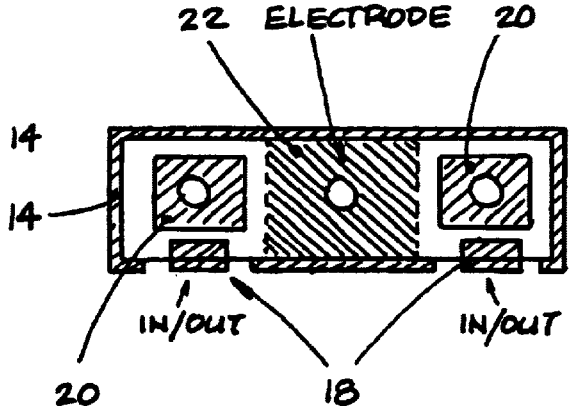
FIG. 80 is a bottom view of FIG. 78.
Figure 81:
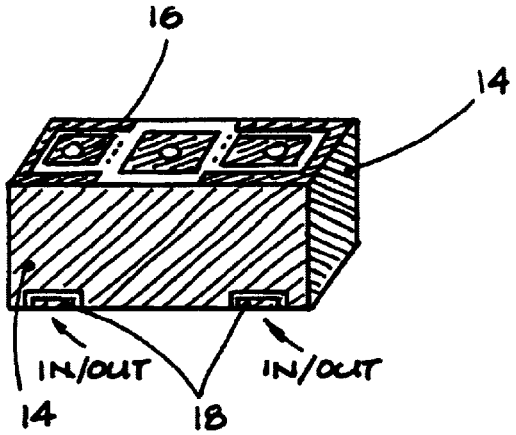
FIG. 81 is a three-dimensional top view of FIG. 78.
Figure 82:
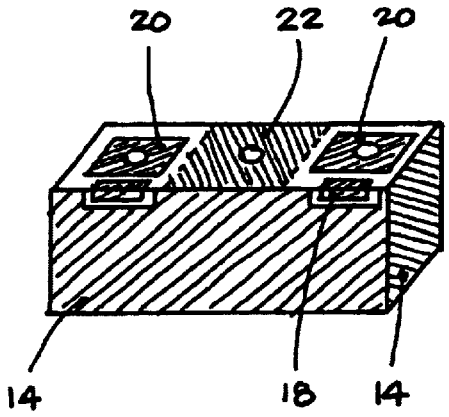
FIG. 82 is a three-dimensional bottom view of FIG. 78.
Figure 83:
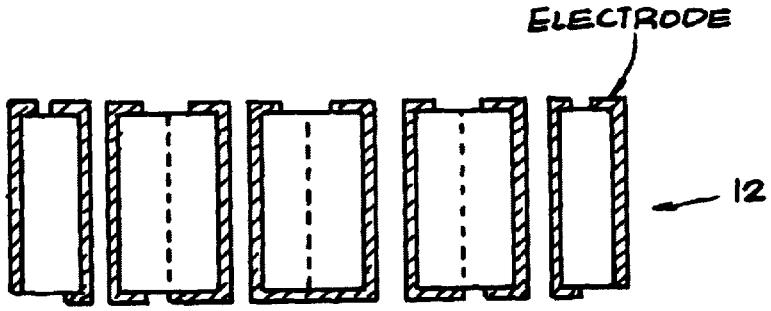
FIG. 83 is a schematic cross-sectional view of a filter employing electrode coupling to reverse resonator orientation in the filter according to present invention.
Figure 84:
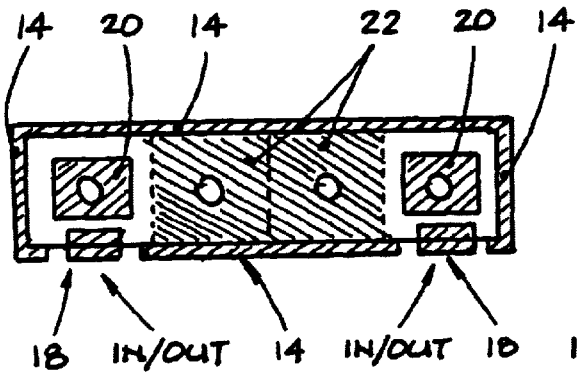
FIG. 84 is a bottom view of FIG. 83.
Figure 85:
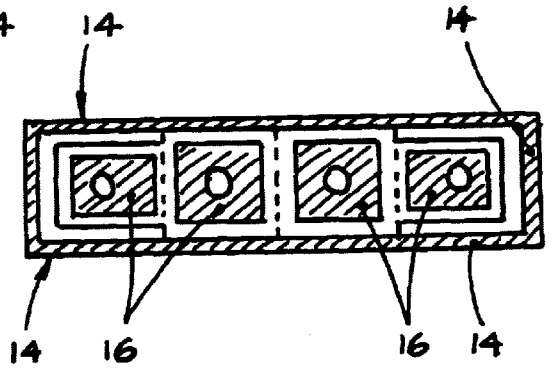
FIG. 85 is a top view of FIG. 83.
Figure 86:
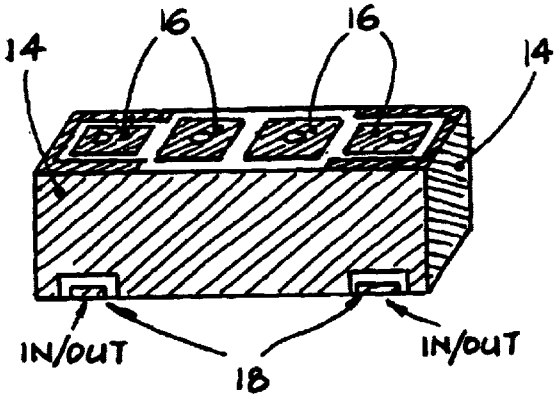
FIG. 86 is a three-dimensional top view of FIG. 83.
Figure 87:
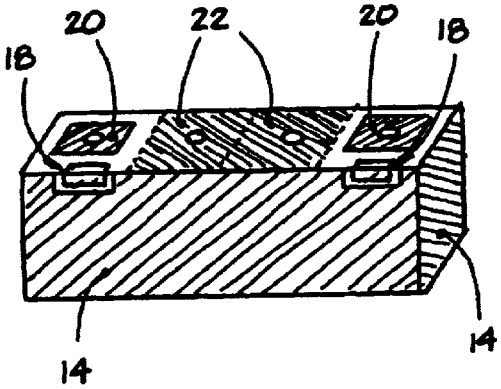
FIG. 87 is a three-dimensional bottom view of FIG. 83.
Figure 88:
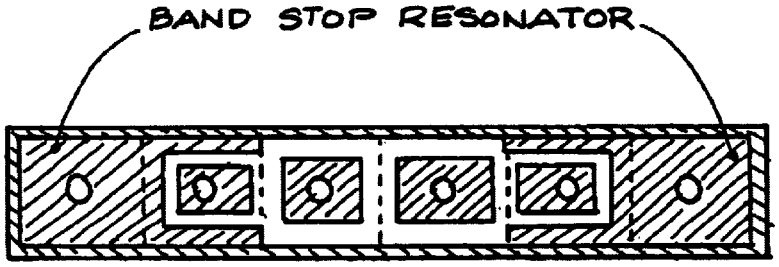
FIG. 88 is a schematic top view of a filter of coaxial resonators with coaxial resonators at the ends to improve Skirt response, where the filter employs electrode coupling to reverse resonator orientation in the filter according to present invention.
Figure 89:
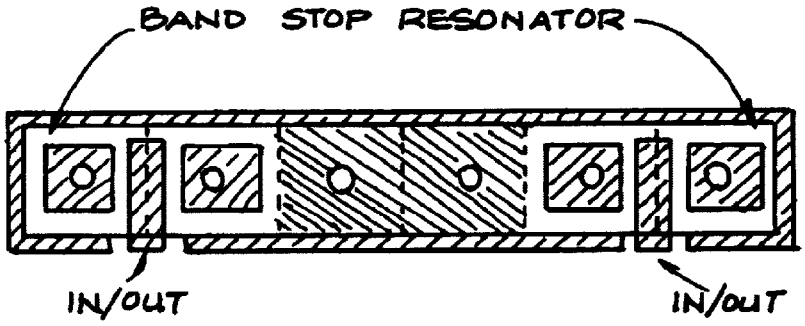
FIG. 89 is a schematic bottom view of FIG. 88.
Figure 90:
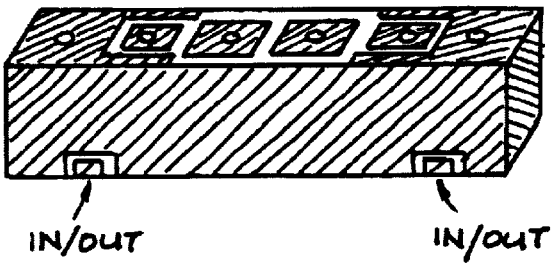
FIG. 90 is a three-dimensional top view of FIG. 88.
Figure 91:
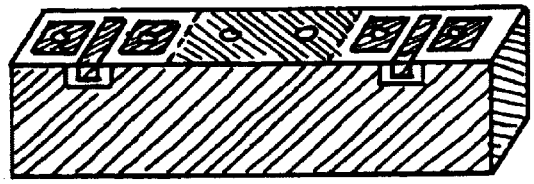
FIG. 91 is a three-dimensional bottom view of FIG. 88.
Figure 92:
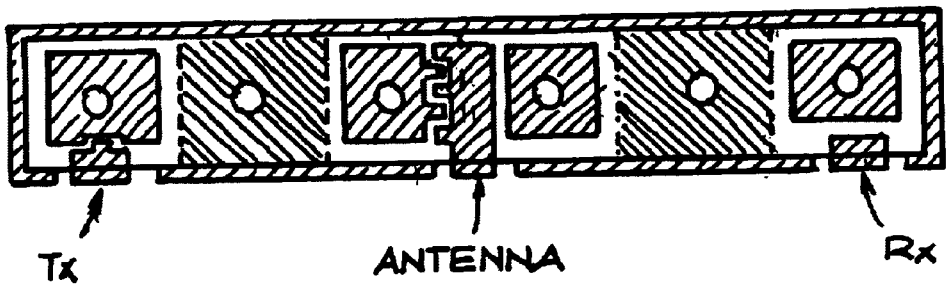
FIG. 92 is a schematic top view of a duplexer filter of coaxial resonators, where the filter employs electrode coupling to reverse resonator orientation in the filter according to present invention.
Figure 93:
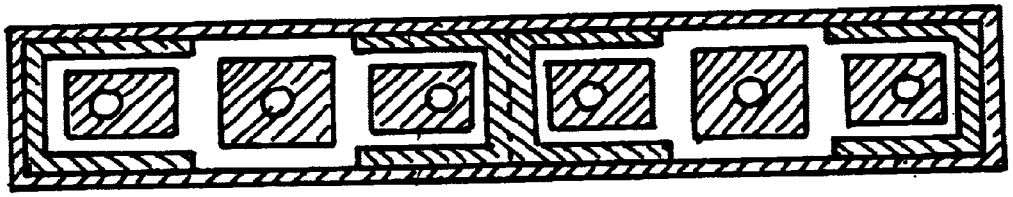
FIG. 93 is a schematic bottom view of FIG. 92.
Figure 94:
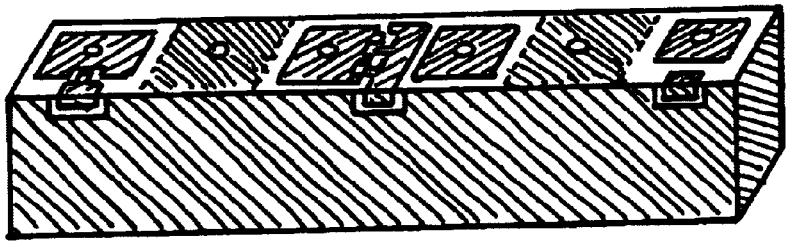
FIG. 94 is a three-dimensional top view of FIG. 92.
Figure 95:
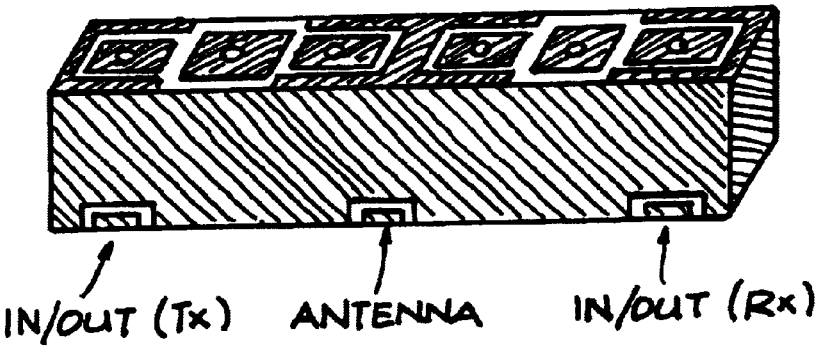
FIG. 95 is a three-dimensional bottom view of FIG. 92.

Another method of reversing orientation of the resonators is the positioning of the electrodes to providing an electronic reversing of resonator orientation, when employing electrode coupling. FIGS. 78 and 83, respectively, show a schematic of a three-pole filter 10 and four-pole filter 12 made from a single block of material that employs electrode coupling. In FIGS. 78 and 83, coaxial type resonators are employ as examples, but other resonator types and combination of resonator types can be used. FIGS. 79, 80, 81, and 82 respectively show a top, bottom and three-dimensional views of FIG. 78. FIGS. 84, 85, 86, and 87 respectively show a top, bottom and three-dimensional views of FIG. 83. As for most filters, there is an outside electrode coating 14 on both filters 10 and 12, which acts similar to a ground. The top view of each filter 10, 12 show coupling electrodes 16, which provide electrode coupling between each resonator. The bottom view of each filter 10, 12 show input/output electrodes 18, coupling electrodes 20 and grounding electrode 22. The grounding electrode 22 covers the bottom of the resonator or resonators to be reversed. The input/output electrodes 18 and coupling electrodes 20 provide coupling between the input/output of a filter and the resonator to which the coupling electrode 20 is attached. The grounding of resonators between resonators that receive the input and output of a signal, as shown in FIGS. 78–87, changes the direction of the electrical field of the signal resonating through the filter. This changing of the direction of the electric field is similar to reversing the orientation of a resonator in a filter, as described above. As other examples which employ the reversing of resonators using the positioning of electrodes, FIGS. 88–91 and 92–95 respectively show views of four-pole filter with two band stop resonators and of a six-pole duplexer filter. FIGS. 49–64 show a monolithic single ceramic block with a mixture of reentrant resonators and coaxial resonators with top and bottom electrodes. The band pass filter of FIG. 49 and duplexer filters of FIGS. 57–61 also contain the orientation reversed resonators by positioning coupling electrodes similar to the filters made of all coaxial type resonators as shown in FIGS. 78–95.

Figure 96:
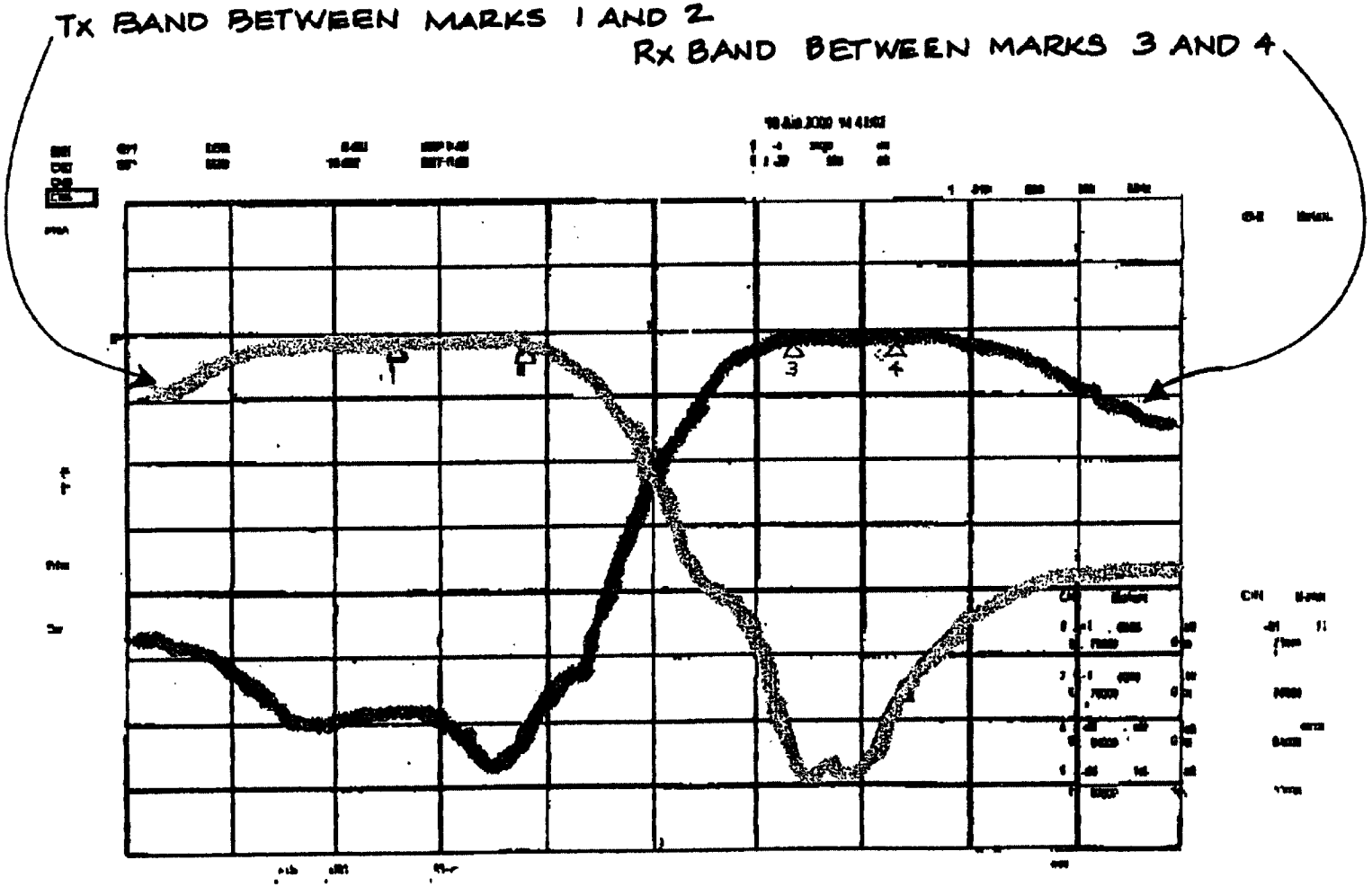
FIG. 96 is a frequency response plot of a typical filter.

Another embodiment of the present invention is an advanced dielectric filter having a sharp cutoff characteristic in the transition band, without the additional band stop resonators of common filters. The advanced dielectric filter also has improved spurious frequency response due to resonator arrangement and coupling methods presented above in other embodiments of the invention. It is known that the transition band lies between the end of the pass band and the beginning of the stop band of a dielectric filter having a band stop resonator on each end. As discussed above, additional resonators are used to improve the skirt frequency response, i.e., a sharp cutoff characteristic in the transition band of dielectric filters. FIG. 96 shows a plot, whereby only one side of each the Tx and Rx band pass has an improved skirt frequency response due to the arrangement of resonators in duplexer filter. Typically for a filter having the response as plotted in FIG. 96, two band stop filters are required to obtain a sharp cutoff frequency response for both transition bands of the filter. The advance dielectric filter of the present invention will remove the need for additional resonators to perform the band stop function.

Figure 97:
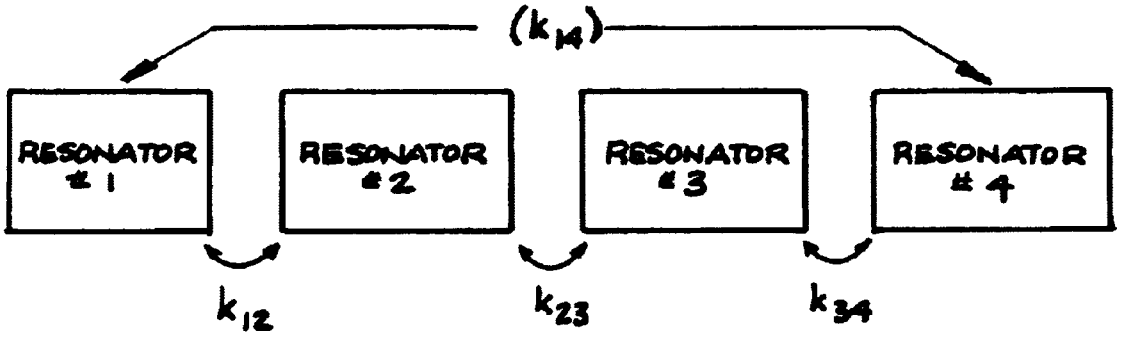
FIG. 97 is a schematic of an elliptic function filter.
Figure 98:
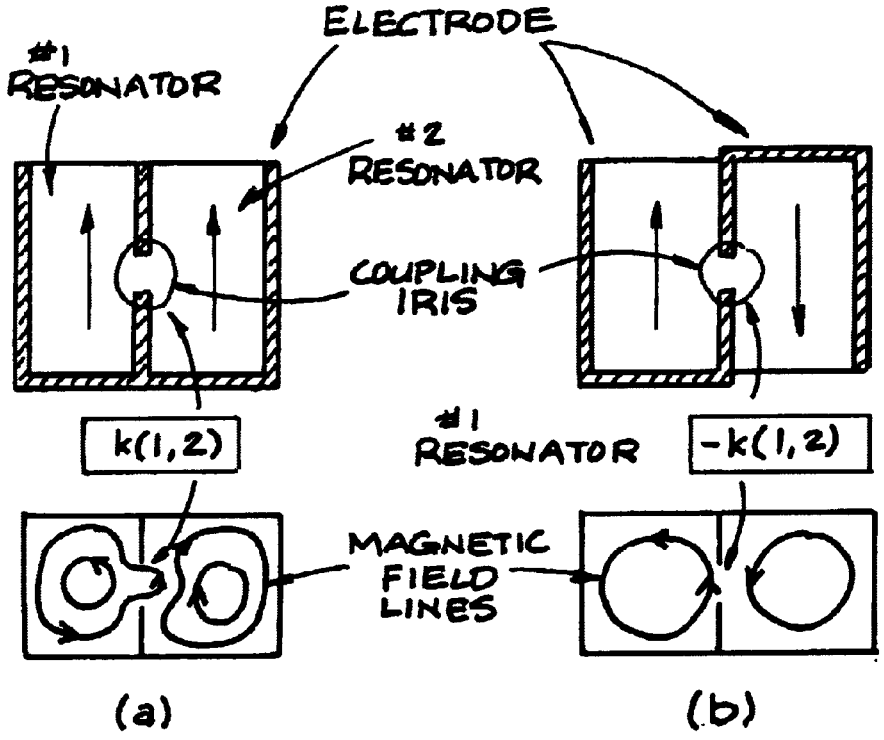
FIG. 98*a* is a schematic of positively coupled resonators.
FIG. 98*b* is a schematic of negatively coupled resonators.

It is well known that an elliptic function filter exhibits a higher rate of cutoff response in the transition band. Using this theory of elliptic function filters, a practical way to build an advanced dielectric filter is to introduce negative coupling, "–k(i.j)", between the input and output resonators, as shown in FIG. 97. FIG. 97 shows a schematic for a 4-pole filter and FIG. 98 shows a comparison of positively coupled resonators (FIG. 98*a*) and negatively coupled resonators (FIG. 98*b*). One of the necessary conditions to make the elliptic function filter theory work is to introduce new methods of coupling and arranging resonators of a dielectric filter to allow coupling of the input and output resonators. The other necessary condition of the elliptic function filter theory is having negative coupling between the input resonator and the output resonator.

Figure 99:
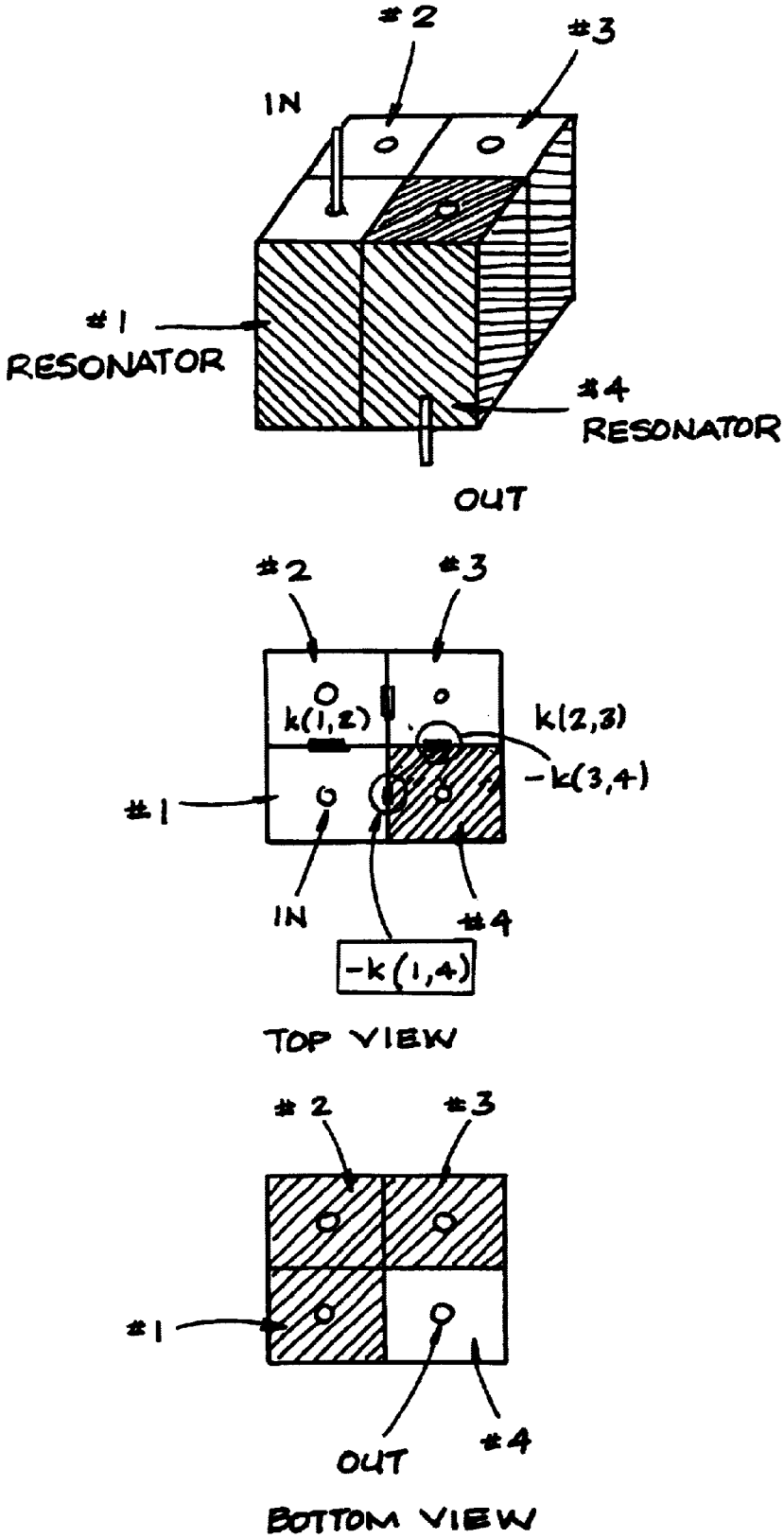
FIG. 99 is a perspective, top and bottom schematic view of an advanced dielectric filter according to the present invention.
Figure 100:
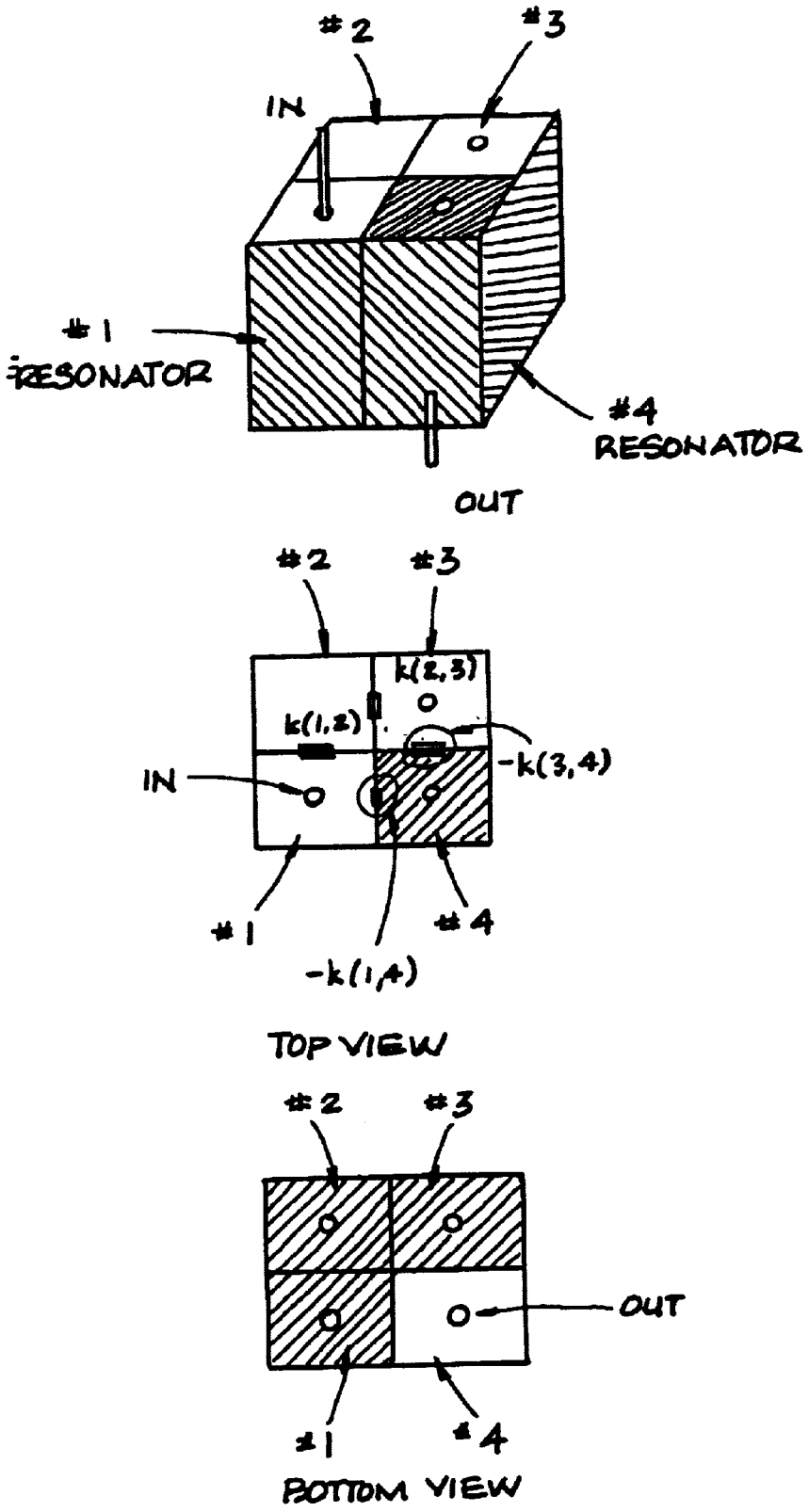
FIG. 100 is a perspective, top and bottom schematic view of another advanced dielectric filter according to the present invention.
Figure 101:
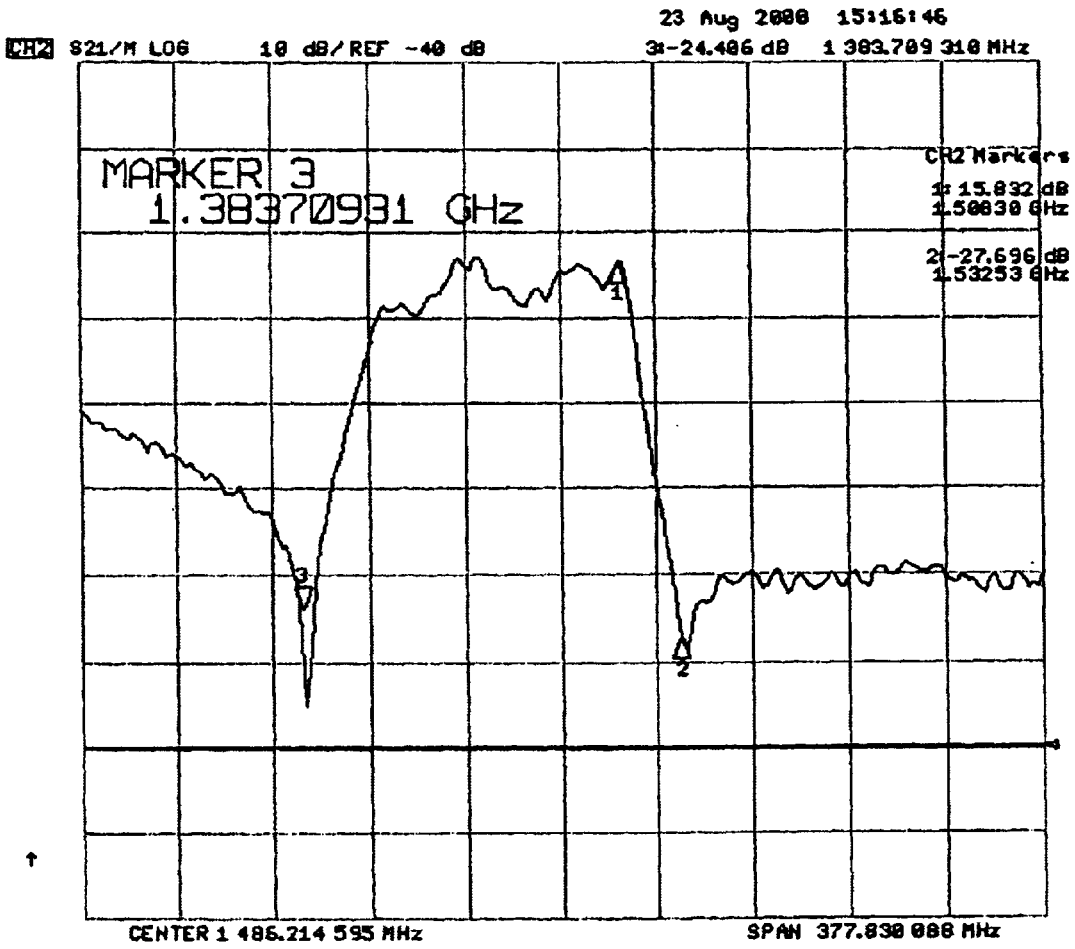
FIG. 101 is a plot of the characteristic of a filter as shown in FIG. 99.

FIG. 99 shows a four-pole version of the advance dielectric filter, whereby input resonator #1 and output resonator #4 are located next to each other and coupled together. The coupling of the input and output resonators usually requires a weak coupling as compared to couplings between the other resonators in the filter. FIG. 99 shows the #1 and #4 resonators in a reverse orientation to each other for the necessary negative coupling between them. By making the filter as show in FIG. 99, not only is the elliptic function filter theory "–k(1,4)" obtained, but also the unwanted higher order mode harmonics can be depressed, as discussed in other embodiments of the present invention. FIG. 100 shows the filter of FIG. 99 with the #2 resonator being of the re-entrant type to further improve the spurious frequency response of the filter. Both filters of FIGS. 99–100 employ IRIS coupling, whereby the weaker coupling between the #1 and #4 resonators can be accomplished by using a smaller IRIS opening. FIG. 101 shows the characteristics of the filter shown in FIG. 99, whereby a high rate of cutoff attenuation on both ends of the pass band is clearly shown.

Figure 102:
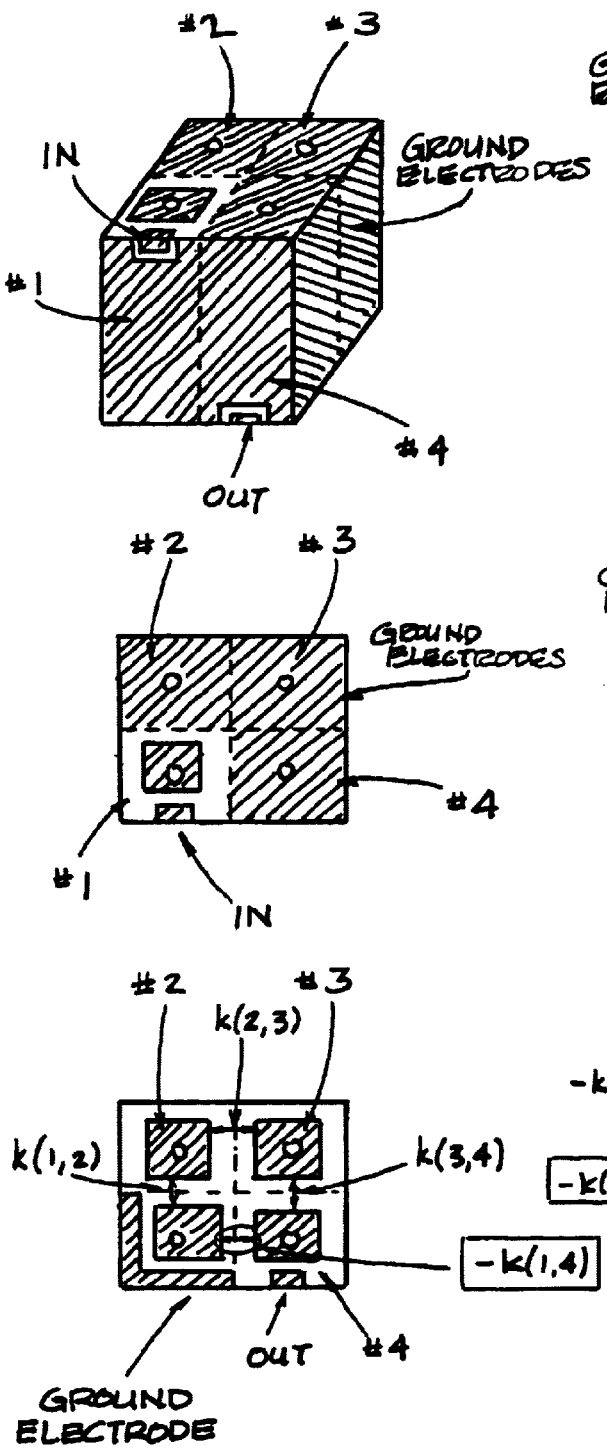
FIG. 102 is a perspective, top and bottom schematic view of a monoblock advanced dielectric filter according to the present invention.
Figure 103:
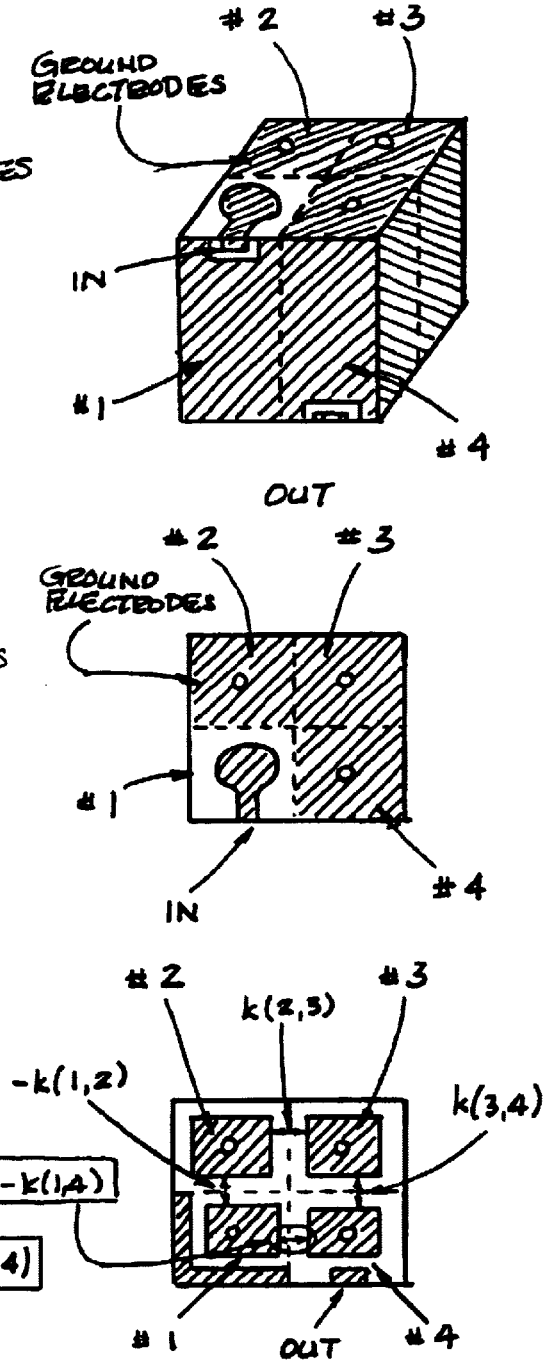
FIG. 103 is a perspective, top and bottom schematic view of another monoblock advanced dielectric filter according to the present invention.

The four-pole filters of FIGS. 99–100 are shown as monoblock shaped filters in FIGS. 102–103. FIG. 102 shows a filter of all coaxial resonators and the filter of FIG. 103 includes the use of a re-entrant type for the #2 resonator. Couplings between resonators of FIGS. 102–103 are achieved by the conducting electrodes, as discussed above in other embodiments of the present invention. Whereby, the weaker coupling between the #1 and #4 resonators can be accomplished by increasing the distance between the electrodes of the #1 and #4 resonators, as compared to the distance between the electrodes which couple the other resonators of the filter. The reversing of the #4 resonator as compared to the #1 resonator can be achieved by orientating the input opposite of the output (FIG. 102) or by using the electrode coupling methods described above in other embodiments of the present invention (FIG. 103). FIGS. 104*a–b* and 105*a–b* show an alternative method of providing the necessary weak coupling between the #1 and #4 resonators by using an inductive coupling groove. The inductive coupling groove is a small groove between two coupled resonators. The inductive coupling groove can be quite useful, since it can be located any place between #1 and #4 resonators, such as, on the top or bottom or side surfaces.

Figure 106:
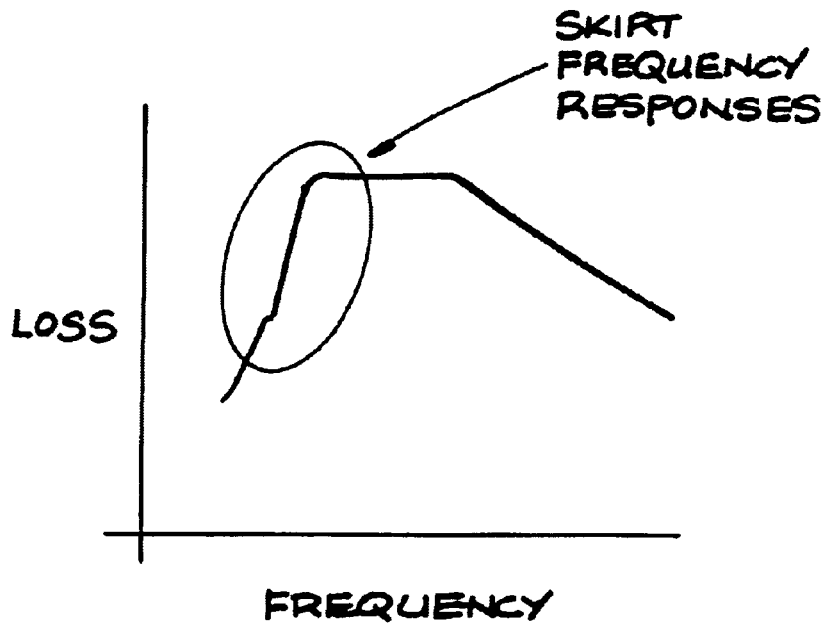
FIG. 106 is a plot of examples show only one steep cutoff attenuation rate.
Figure 106:
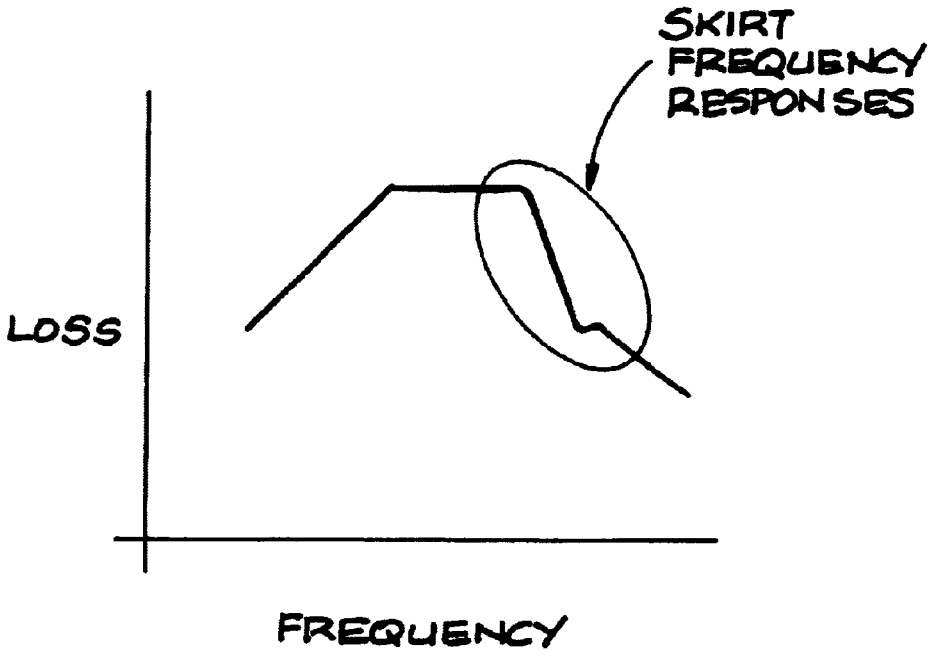
Figure 107:
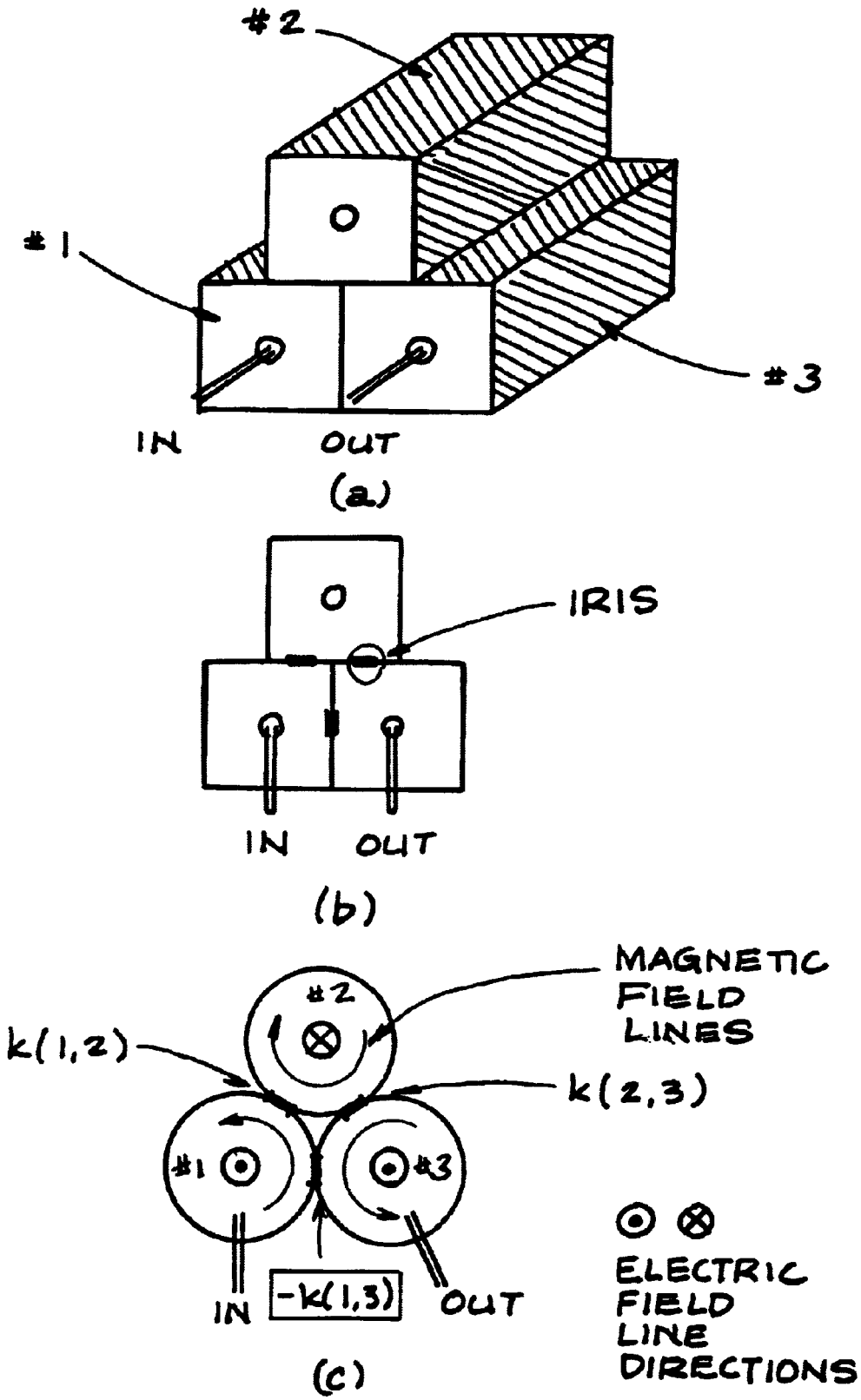
FIG. 107*a* is a perspective schematic view of a three-pole advanced dielectric filter according to the present invention.
FIG. 107*b* is a front schematic view of the three-pole advanced dielectric filter of FIG. 107*a;*
FIG. 107*c* is a schematic of the magnetic fields of the three-pole advanced dielectric filter of FIG. 107*a;*
Figure 108:
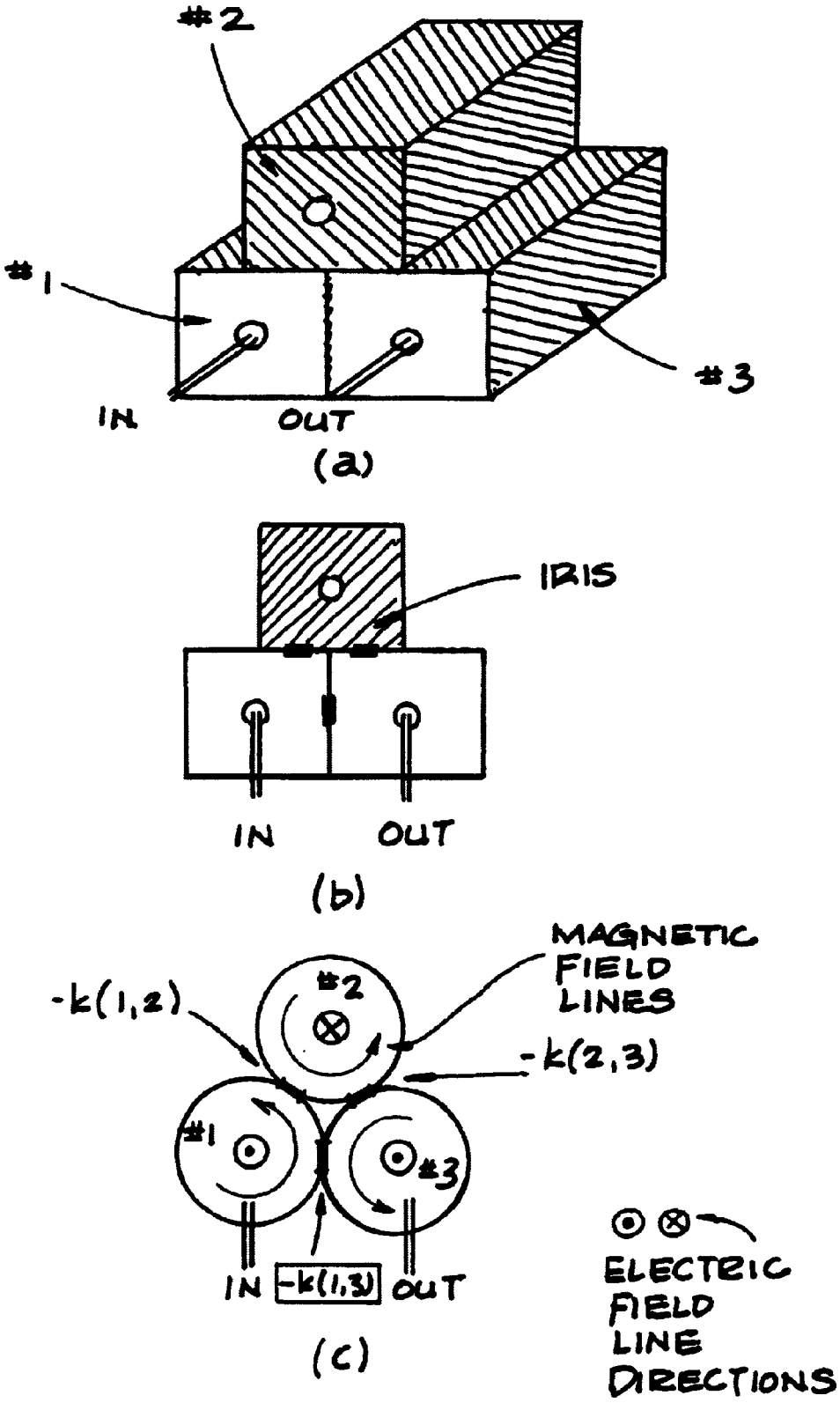
FIG. 108*a* is a perspective schematic view of a three-pole advanced dielectric filter according to the present invention.
FIG. 108*b* is a front schematic view of the three-pole advanced dielectric filter of FIG. 108*a;*
FIG. 108*c* is a schematic of the magnetic fields of the three-pole advanced dielectric filter of FIG. 108*a;*
Figure 109:
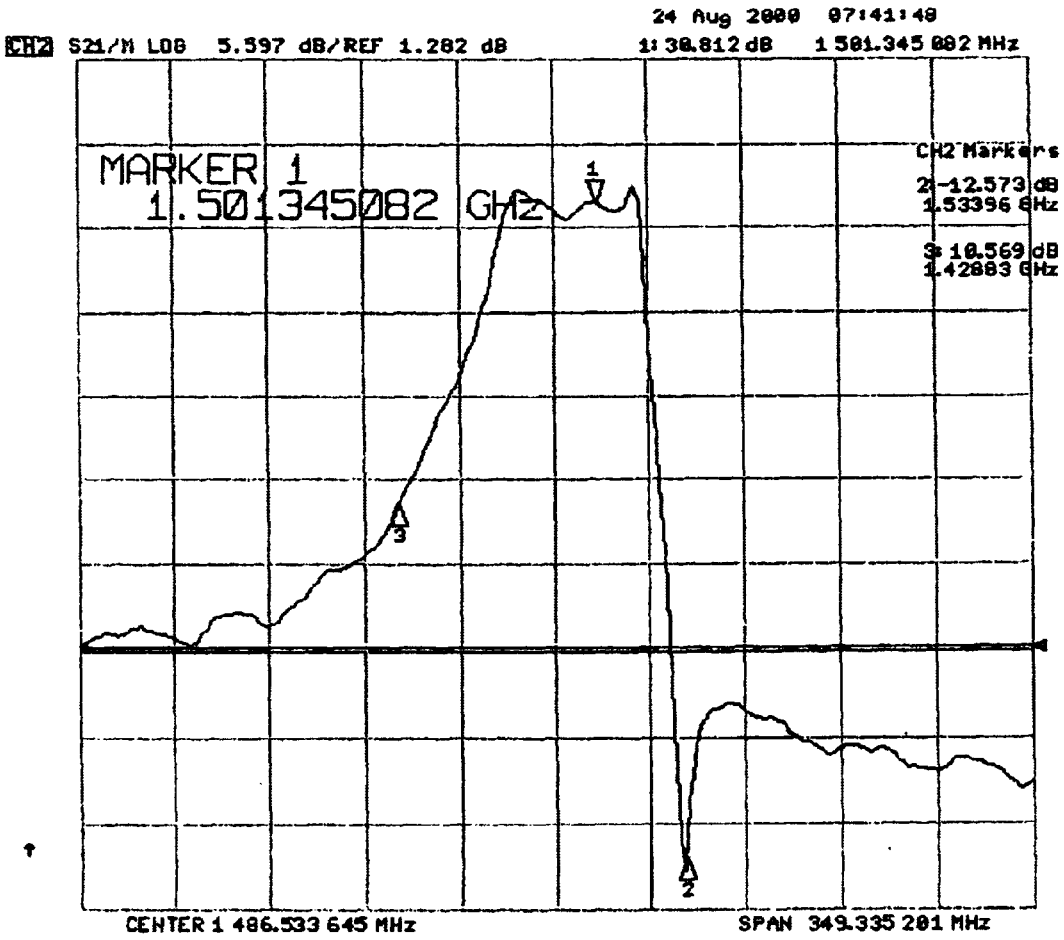
FIG. 109 is a plot of the filter characteristics for the filter type shown in FIG. 107.
Figure 110:
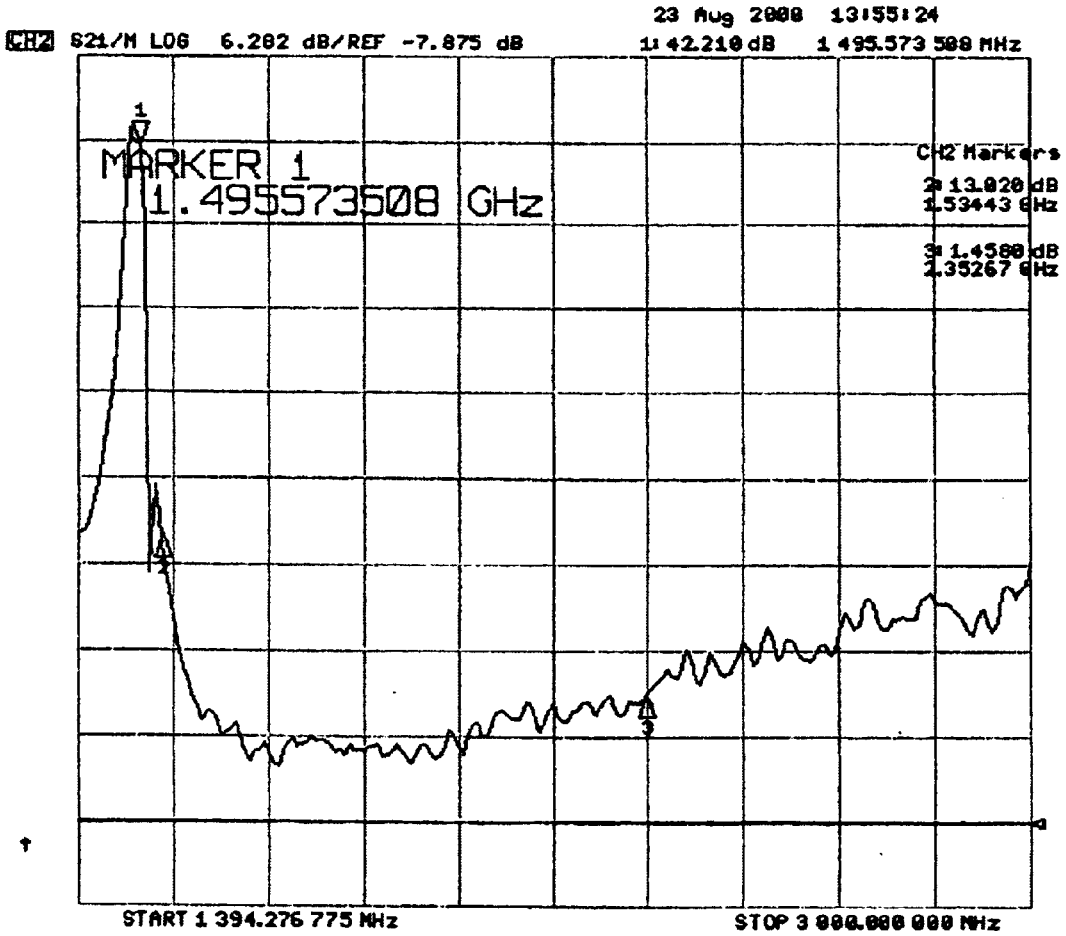
FIG. 110 is another plot of the filter characteristics for the filter type shown in FIG. 107.
Figure 111:
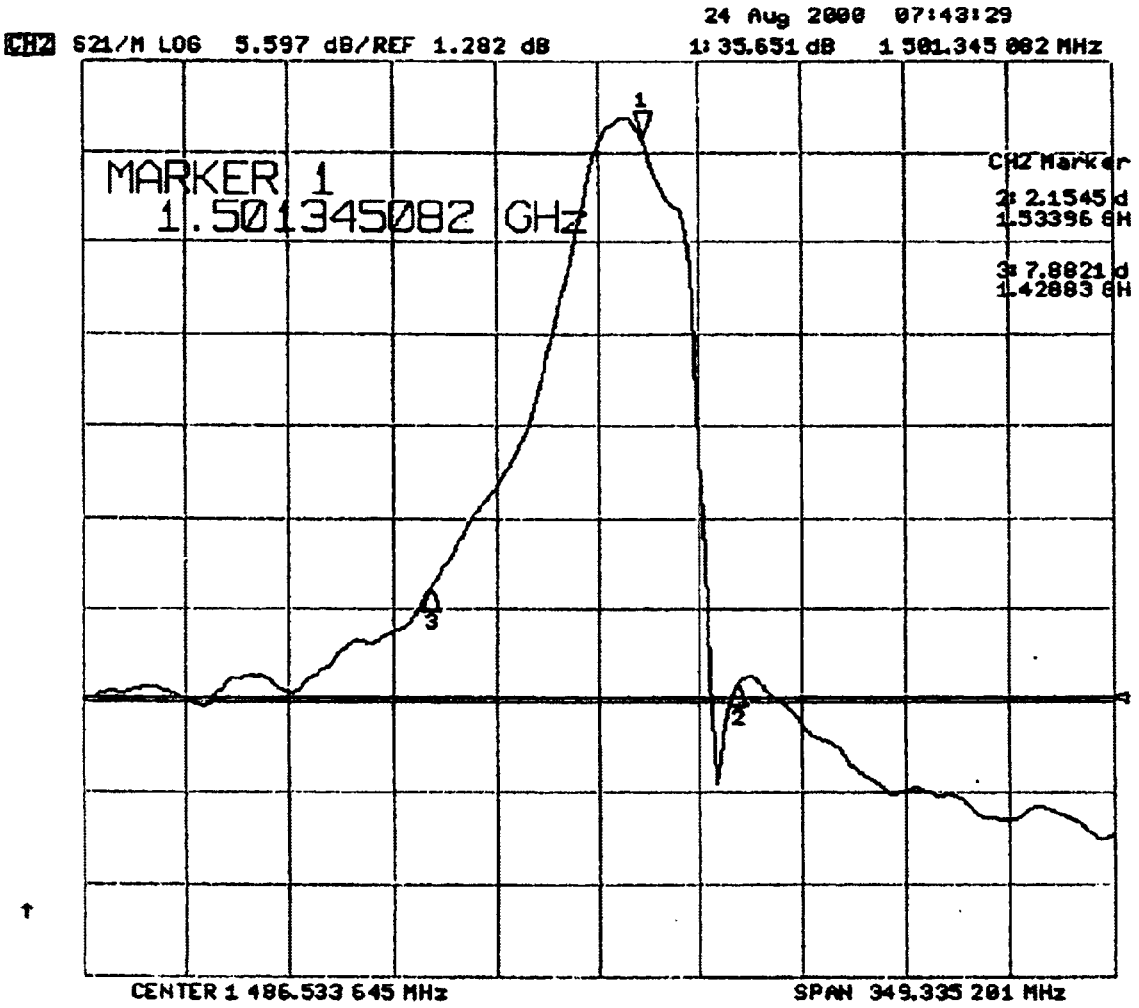
FIG. 111 is a plot of the filter characteristics for the filter type shown in FIG. 108.
Figure 112:
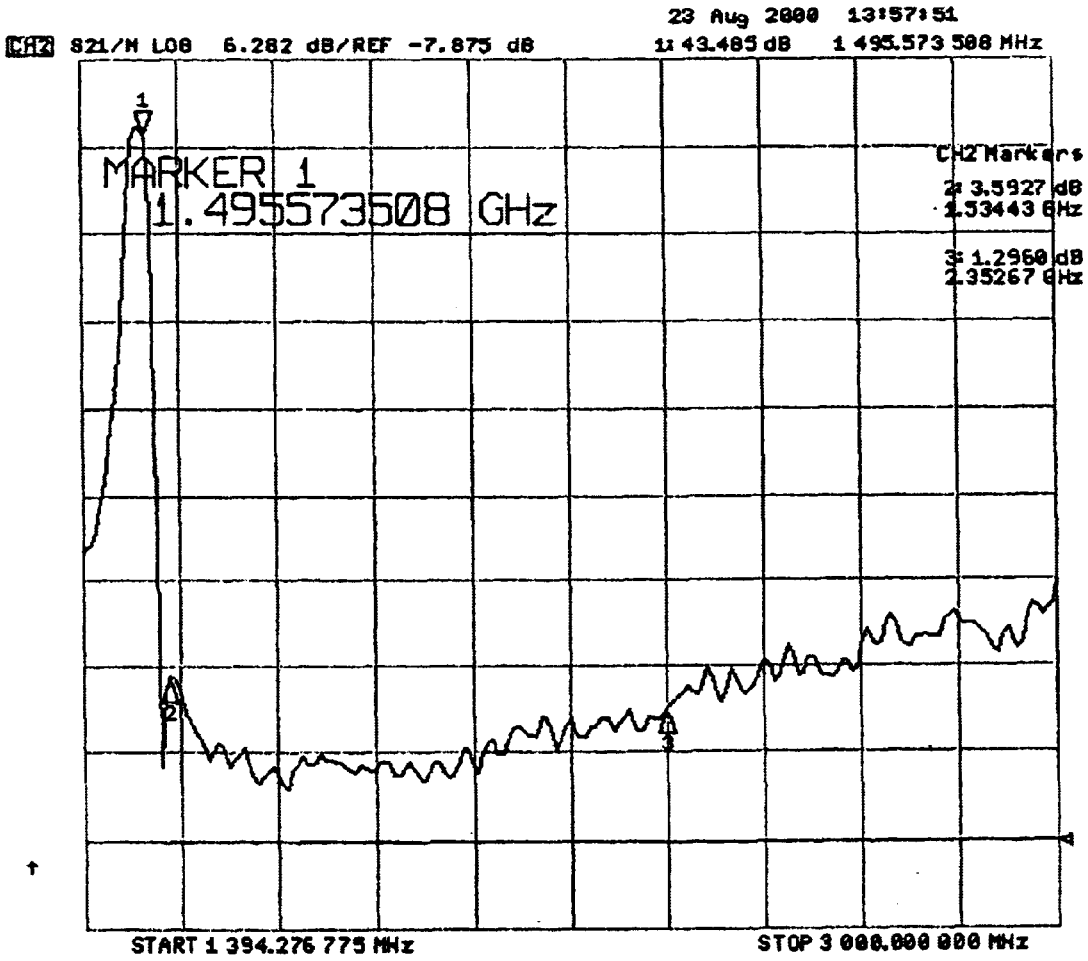
FIG. 112 is another plot of the filter characteristics for the filter type shown in FIG. 108.
Figure 113:
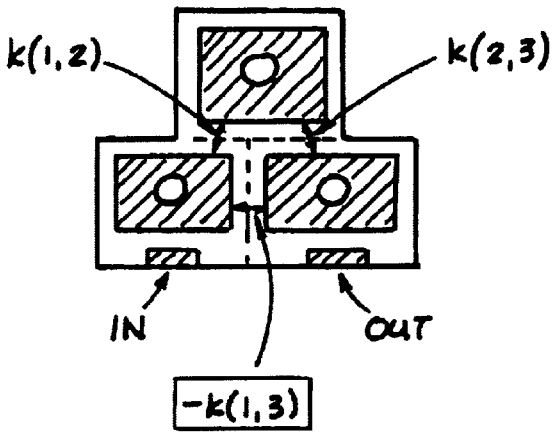
FIG. 113 is a perspective and top schematic view of a three-pole monoblock advanced dielectric filter according to the present invention.
Figure 114:
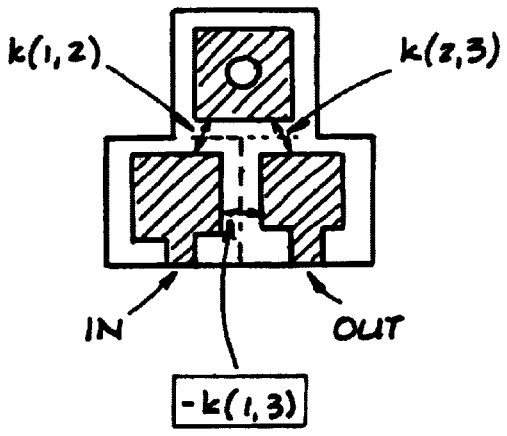
FIG. 114 is a perspective and top schematic view of another three-pole monoblock advanced dielectric filter according to the present invention.

FIG. 101 shows high cutoff attenuation rates of both sides of the pass band the type of filters shown in FIGS. 99–100 and 102–103. However for some applications, one wishes to have a band pass filter showing only one steep cutoff attenuation rate, as shown in FIG. 106. The filter characteristics of FIG. 106 can be obtained with a three-pole advanced dielectric filter of FIGS. 107(*a–c*)–108(*a–c*). FIGS. 107–108 show an advanced dielectric filter made of three discrete dielectric filters coupled by IRIS couplings of k(1,2), k(2,3) and k(1,3). The main difference between the filters of FIGS. 107 and 108 is that all three resonators are oriented same direction in FIG. 107, and the #2 resonator is oriented in the opposite direction relative to the #1 and #3 resonators in FIG. 108. A main distinction, which should be noted for advance dielectric filters of the present invention, is the characteristics associated with having an odd number of resonators. With an advance dielectric filter having an odd number of resonators, the last resonator need not be flip over to make the negative coupling between the input #1 resonator and output #3 resonator of FIGS. 107–108. As shown in FIGS. 107*c* and 108*c*, the magnetic coupling between the first and the last resonators becomes negative automatically for an odd number of resonators in a filter. In fact, the flipping over of either the input or output resonators will destroy the desired negative coupling for all filters having an odd number of resonators. However in order to depress the unwanted higher order mode harmonics, any of the resonators between the input and output resonators could be flipped over, as described above in the other embodiments of the present invention. FIG. 108*a–c* shows such a case, where the #2 resonator is flipped over. The filter characteristics of FIG. 107 are shown in FIGS. 109–110 and filter characteristics of FIG. 108 are shown in FIGS. 111–112. It is clearly seen that a high cutoff attenuation rate at one side of the pass band is demonstrated, as shown in FIGS. 108–112. Also, the different kinds of resonators can be mixed for a specific response, as described above in the other embodiments of the present invention.

Figures 104, 105:
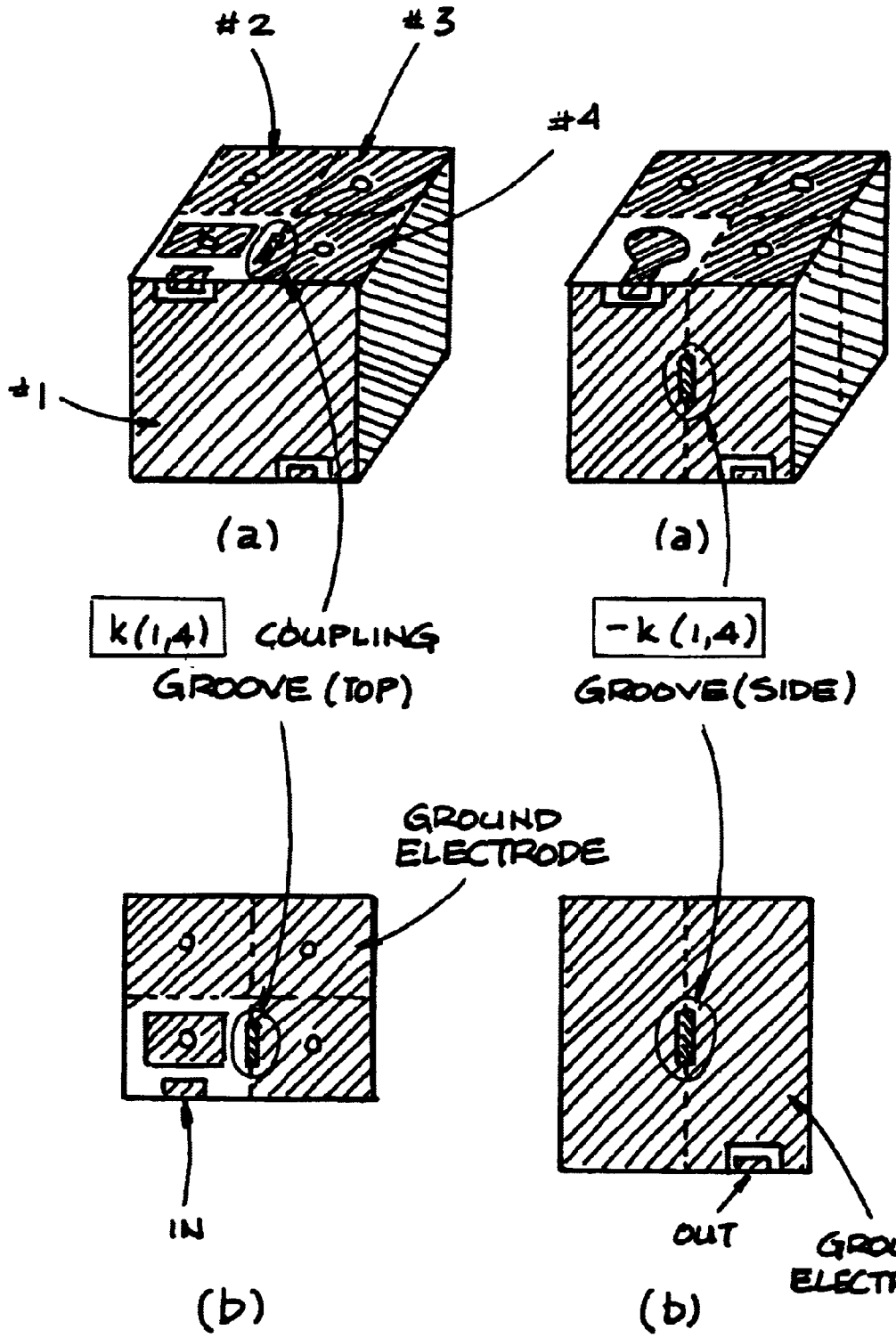
FIG. 104 is a schematic of an alternative method of providing a weak coupling in an advanced dielectric filter.
FIG. 105 is a schematic of an alternative method of providing a weak coupling in an advanced dielectric filter.
Figure 115:
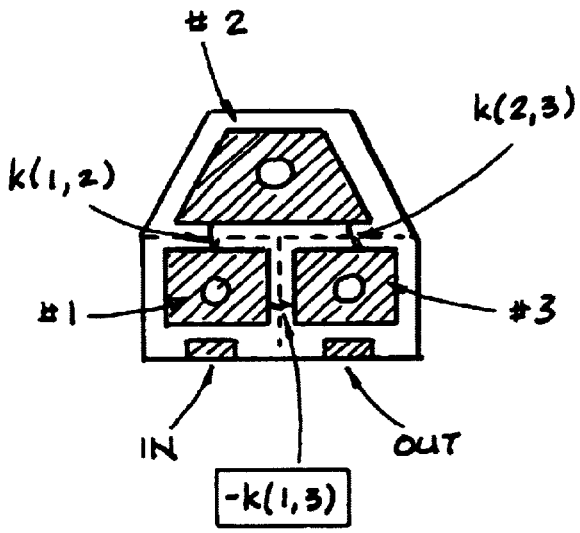
Figure 116:
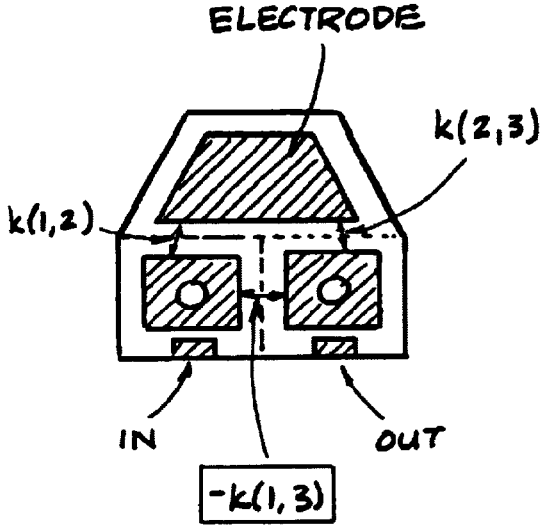
Figure 117:
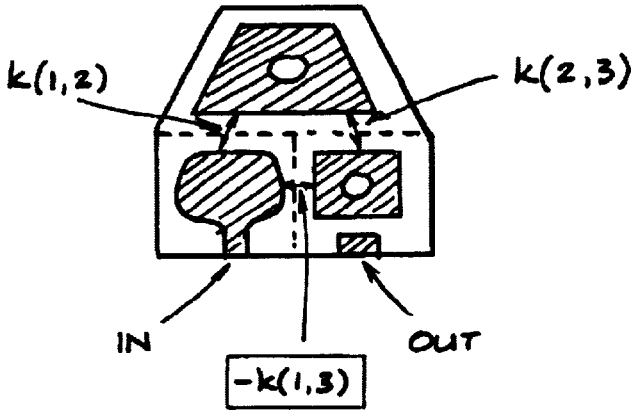

Monoblock three-pole advanced dielectric filters are shown in FIGS. 113–117, whereby FIGS. 115–117 show different combinations of resonator types. Also, FIGS. 115–117 show a slightly different shaped #2 resonator, which may improve the couplings of k(1,2) and k(2,3) and the powder pressing of the filter. The couplings between the resonators can be carried out by the electrodes as shown in FIGS. 113–117. Of course as shown in FIGS. 104–105, the inductive coupling of the input and output resonators using the inductive coupling groove can be used for these filters, instead the electrode coupling method.

Figure 118:
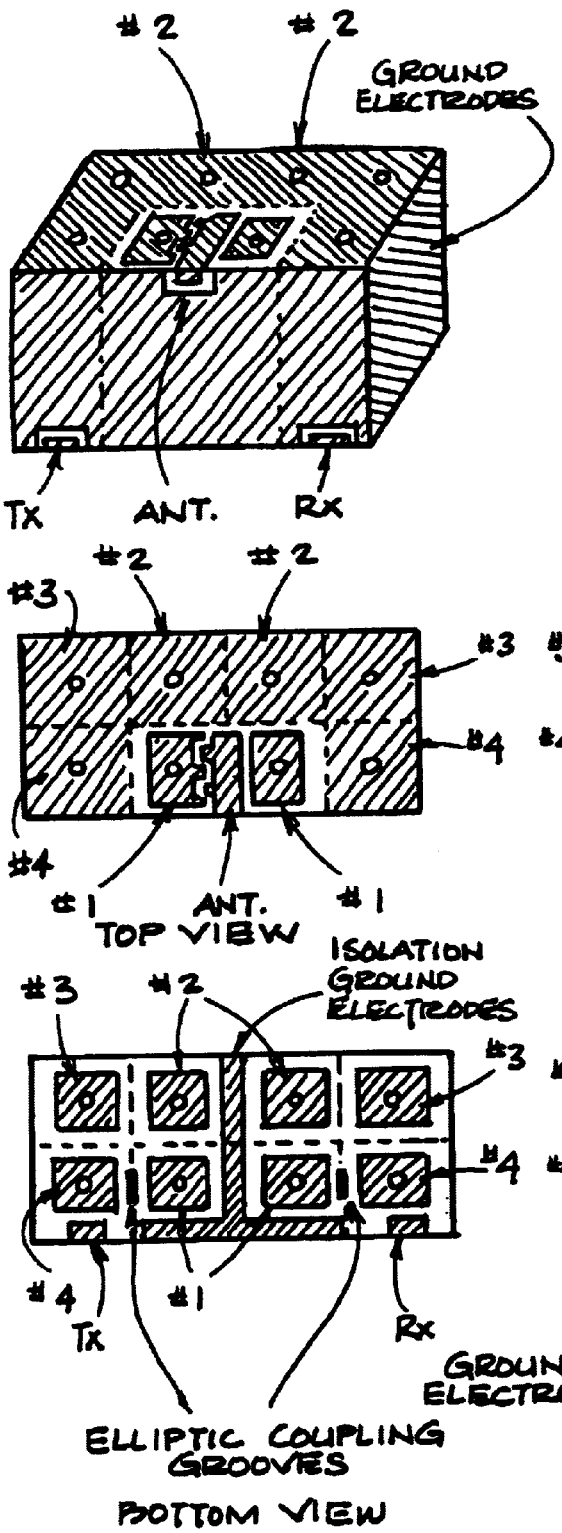
Figure 119:
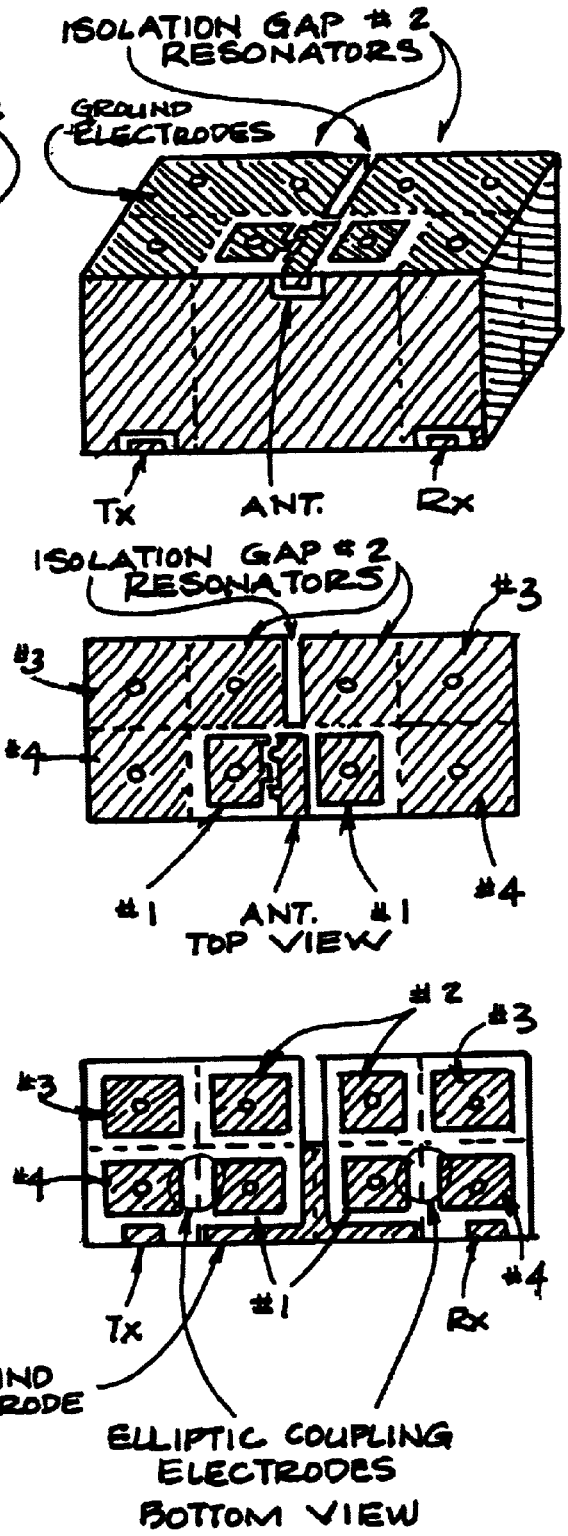
Figures 120, 121:
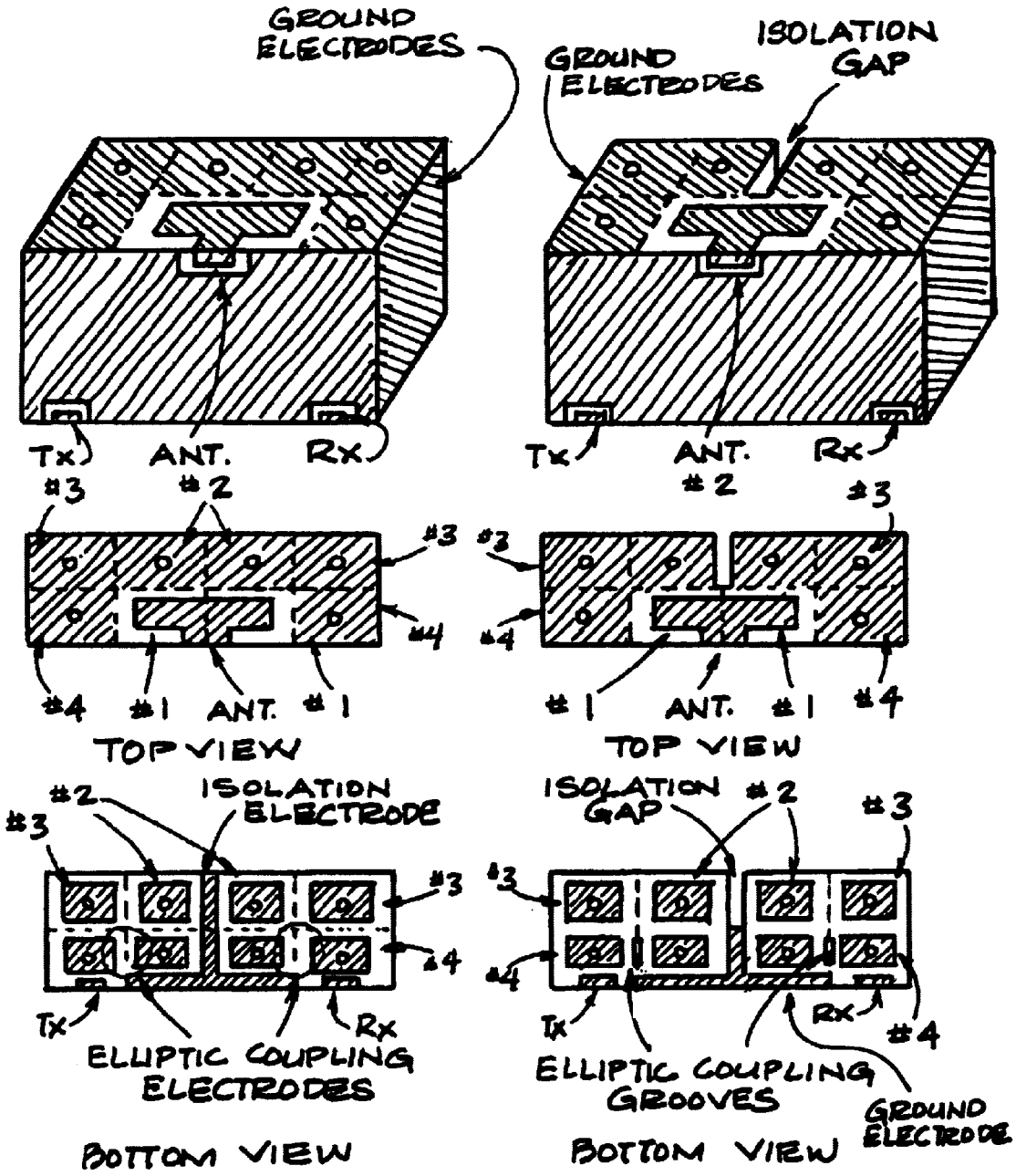

A duplexer filter for transmitting Tx and receiving Rx can be made from two of the advanced dielectric filters described above. FIGS. 118–121 show duplexer filters made of two four-pole advanced dielectric filters of FIGS. 102–105. The weak negative couplings of "–k(1,4)" for both Tx and Rx band pass filters are accomplished using the inductive coupling groove in FIGS. 118 and 121, while in FIGS. 119–120, a conducting electrode is employed. The electrodes of the Antenna are located on the same plane, but on the other side of the Tx and Rx electrodes in FIGS. 118–119. This is required because the #4 resonators are flipped in Tx and Rx band pass filters in order to obtain the negative couplings and depress higher order mode harmonics. Separation or isolation between the two #2 resonators of the Tx and Rx filters is performed by introducing a ground electrode between them (FIGS. 118, 120) or by the physical separation (FIGS. 119, 121). The duplexers of FIGS. 118–119 are shown made of all coaxial type resonators, while the FIGS. 120–121 show duplexers with a #1 resonator of the re-entrant type, where the #1 resonator is flipped over for both Tx and Rx.

Figure 122:
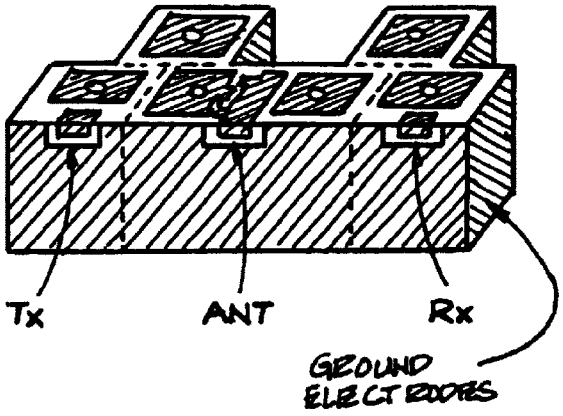
Figure 122:
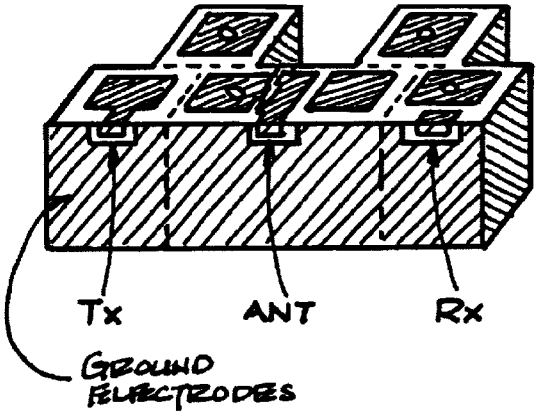
Figure 122:
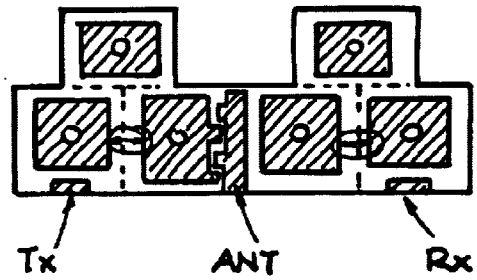
Figure 122:
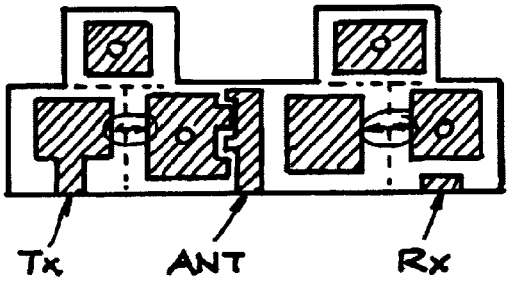
Figure 122:
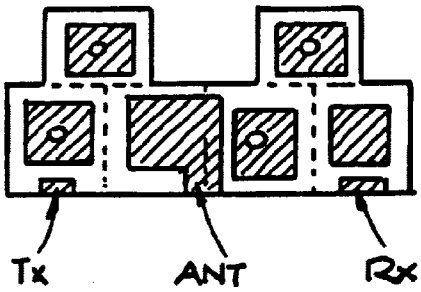
Figure 123:
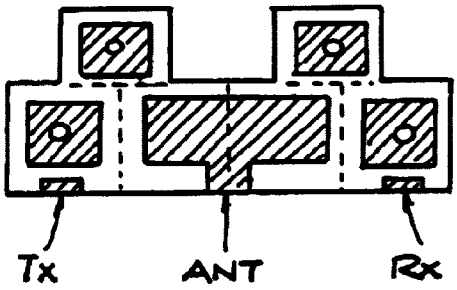
Figure 124:
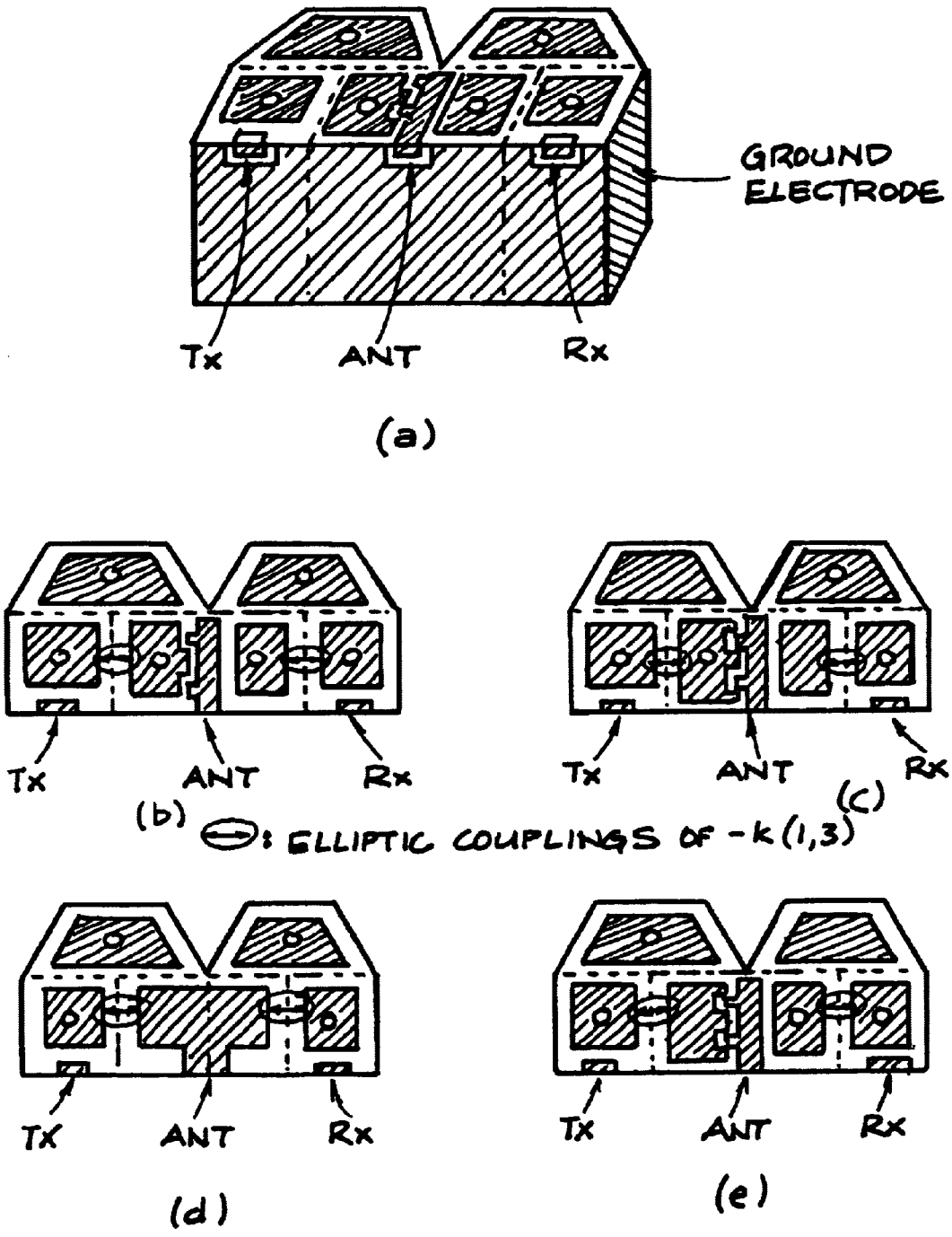
Figure 125:
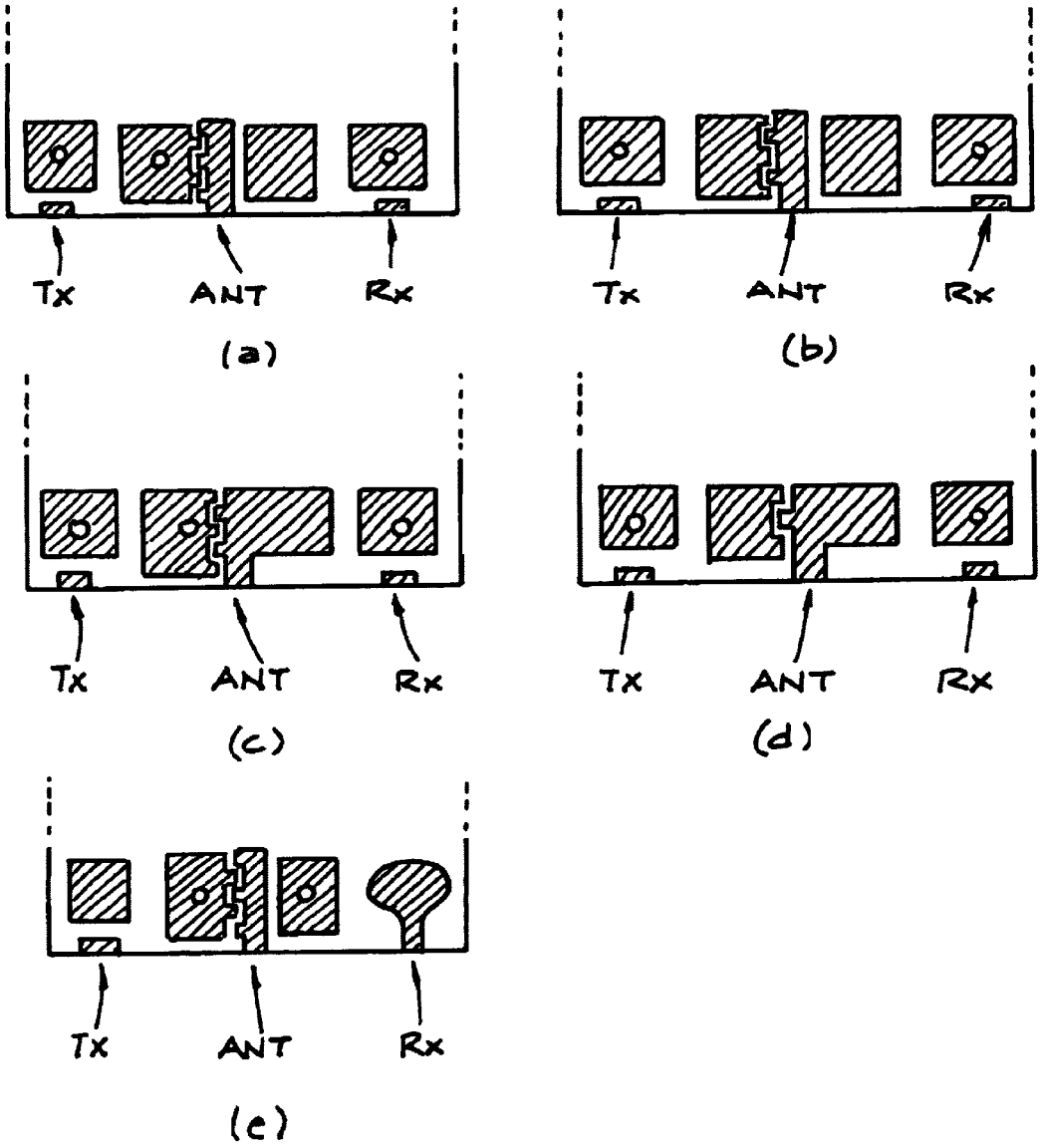

As mentioned above, only one side of a high cutoff attenuation rate of pass band may be desired for certain applications. FIGS. 122–123 show duplexers made up of two filters of the design show in FIGS. 113–114. Notice that the electrodes of an Antenna, Tx and Rx, are located not only same plane, but also same side. This is because these duplexers are made of two filters having an odd number of resonators. Couplings resonators in FIGS. 122–124 are shown using the electrode coupling method, including the "–k(1,3)" coupling. Of course inductive groove coupling can be used for the weak negative coupling of "–k(1,3)". FIG. 124*a* shows a perspective view of a duplexer using two filters of the design shown in FIGS. 115–117 and FIGS. 124*b–e* show different resonator types and coupling configurations. FIGS. 125*a–e* show different antenna, TX and RX coupling configurations that can be used with all the above mentioned duplexers which employ the advanced dielectric filter of the present invention.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. An advanced dielectric filter made up of resonators, such that said filter resonates a design frequency, said filter comprising:

a input resonator connected to an input;

a output resonator connected to an output;

at least one resonator coupled between said input and output resonators;

wherein said input and output resonators are coupled together; and wherein there is at least two resonators coupled between said input and output resonators and wherein said input and output resonators are physically oriented in reverse to each other to negatively coupled said input and output resonators together when there is an even number of resonators between said input and said output which make up said filter.

2. The advanced dielectric filter of claim 1, wherein said coupling of said input and output resonators is a weak coupling as compared to other couplings between resonators of said filter.

3. The advanced dielectric filter of claim 2, wherein said weak coupling is an inductive coupling groove.

4. The advanced dielectric filter of claim 1, wherein at least one of said resonators is of a different design from other said resonators.

5. The advanced dielectric filter of claim 1, wherein at least one of said resonators coupled between said input and output resonators is reversed in orientation as compared to other of said resonators of said filter.

6. The advanced dielectric filter of claim 1, wherein said input and output resonators are reversed in orientation electronically by employing electrode coupling on a top and bottom surface of said filter, instead of physically.

7. The advanced dielectric filter of claim 6, wherein said filter is formed from a single block of dielectric material and includes a top, bottom and sides; wherein said sides are covered by and interconnected by an electrode coating which acts as a ground; wherein each of said resonators includes coupling electrodes which allows electrode coupling between each resonator; wherein said input resonator includes an input electrode; wherein said output resonator includes an output electrode; and wherein positioning of said input electrode, output electrode, coupling electrodes, grounding electrode coating effect an electronic reversing of the orientation of said input and output resonators.

8. The advanced dielectric filter of claim 1, wherein said filter is formed from a single block of dielectric material.

9. An advanced duplexer dielectric filter for a device comprising:

an antenna connection for said filter that serves as an input and output to a device via said filter;

an output connection that serves as a connection from said device to said filter;

an input connection that serves as a connection to said device from said filter;

a first set of at least three resonators coupled together between said input and antenna connections, said first set having a input resonator connected to said antenna connection, a output resonator connected to said input connection, and at least one resonator coupled between said input and output resonators, wherein said input and output resonators are coupled together, wherein there is at least two resonators coupled between said input and output resonators and wherein said input and output resonators are physically oriented in reverse to each other to negatively coupled said input and output resonators together when there is an even number of resonators between said input and antenna connections; and a second set of at least three two resonators between said output and antenna connections, said second set having a input resonator connected to said output connection, a output resonator connected to said antenna connection, and at least one resonator coupled between said input and output resonators, wherein said input and output resonators are coupled together, wherein there is at least two resonators coupled between said input and output resonators and wherein said input and output resonators are physically oriented in reverse to each other to negatively coupled said input and output resonators together when there is an even number of resonators between said output and antenna connections.

10. The advanced duplexer dielectric filter of claim 9, wherein said filter is formed from a single block of dielectric material.

11. The advanced duplexer dielectric filter of claim 9, wherein said coupling of said input and output resonators of said first and second sets is a weak coupling as compared to other couplings between resonators of said filter.

12. The advanced duplexer dielectric filter of claim 11, wherein said weak coupling of said first and second sets is an inductive coupling groove.

13. The advanced duplexer dielectric filter of claim 9, wherein at least one of said resonators of said first and second sets is of a different design from other said resonators.

14. The advanced duplexer dielectric filter of claim 9, wherein at least one of said resonators coupled between said input and output resonators of said first and second sets is reversed in orientation as compared to other of said resonators of said filter.

15. The advanced duplexer dielectric filter of claim 9, wherein at least one of said resonators coupled between said input and output resonators of said first and second sets is reversed in orientation electronically by employing electrode coupling on a top and bottom surface of said filter.

16. The advanced duplexer dielectric filter of claim 15, wherein said filter is formed from a single block of dielectric material and includes a top, bottom and sides; wherein said sides are covered by and interconnected by an electrode coating which acts as a ground; wherein each of said resonators of said first and second sets includes coupling electrodes which allows electrode coupling between each resonator; wherein said input resonators include an input electrode; wherein said output resonators include an output electrode; and wherein positioning of said input electrode, output electrode, coupling electrodes, grounding electrode coating effect an electronic reversing of the orientation of at least one resonator of said first and second sets.

17. An advanced dielectric filter made up of resonators, such that said filter resonates a design frequency, said filter comprising:

a input resonator connected to an input;

a output resonator connected to an output;

at least one resonator coupled between said input and output resonators;

wherein said input and output resonators are coupled together and where there is an odd number of resonators between said input and said output, such that the coupling of said input and output resonators is negative.

18. The advanced dielectric filter of claim 17, wherein at least one of said resonators is of a different design from other said resonators.

19. The advanced dielectric filter of claim 17, wherein at least one of said resonators coupled between said input and output resonators is physically reversed in orientation as compared to other of said resonators of said filter.

20. The advanced dielectric filter of claim 17, wherein said filter is formed from a single block of dielectric material.

21. The advanced dielectric filter of claim 17, wherein said filter is formed from a single block of dielectric material and includes a top, bottom and sides; wherein said sides are covered by and interconnected by an electrode coating which acts as a ground; wherein each of said resonators includes coupling electrodes which allows electrode coupling between each resonator; wherein said input resonator includes an input electrode; wherein said output resonator includes an output electrode; and wherein positioning of said input electrode, output electrode, coupling electrodes, grounding electrode coating effect an electronic reversing of the orientation of at least one resonator.

22. The advanced dielectric filter of claim 17, wherein at least one of said resonators coupled between said input and output resonators is reversed in orientation as compared to other of said resonators of said filter.

23. The advanced dielectric filter of claim 22, wherein at least one of said resonators coupled between said input and output resonators is reversed in orientation electronically by employing electrode coupling on a top and bottom surface of said filter.

24. The advanced dielectric filter of claim 17, wherein said coupling of said input and output resonators is a weak coupling as compared to other couplings between resonators of said filter.

25. The advanced dielectric filter of claim 24, wherein said weak coupling is an inductive coupling groove.

26. The advanced dielectric filter of claim 17, wherein there is only one resonator between said input and output resonators creating a three-pole filter.

27. The advanced dielectric filter of claim 26, wherein said coupling of said input and output resonators is a weak coupling as compared to other couplings between resonators of said filter.

28. The advanced dielectric filter of claim 27, wherein said weak coupling is an inductive coupling groove.

29. The advanced dielectric filter of claim 26, wherein said only one resonator is of a different design from other said resonators.

30. The advanced dielectric filter of claim 26, wherein said only one resonator coupled between said input and output resonators is physically reversed in orientation as compared to other of said resonators of said filter.

31. The advanced dielectric filter of claim 26, wherein said three pole filter is formed in an upside down T-shape and wherein said input and output resonators are at a bottom of said upside down T-shape and said only one resonator is at a top of said upside down T-shape.

32. The advanced dielectric filter of claim 31, wherein said filter is formed from a single block of dielectric material.

33. The advanced dielectric filter of claim 26, wherein said filter is formed from a single block of dielectric material and includes a top, bottom and sides; wherein said sides are covered by and interconnected by an electrode coating which acts as a ground; wherein each of said resonators includes coupling electrodes which allows electrode coupling between each resonator; wherein said input resonator includes an input electrode; wherein said output resonator includes an output electrode; and wherein positioning of said input electrode, output electrode, coupling electrodes, grounding electrode coating effect an electronic reversing of the orientation of at least one resonator.

34. The advanced dielectric filter of claim 26, wherein at least one of said resonators coupled between said input and output resonators is reversed in orientation as compared to other of said resonators of said filter.

35. The advanced dielectric filter of claim 34, wherein at least one of said resonators coupled between said input and output resonators is reversed in orientation electronically by employing electrode coupling on a top and bottom surface of said filter.

36. An advanced duplexer dielectric filter for a device comprising:

an antenna connection for said filter that serves as an input and output to a device via said filter;

an output connection that serves as a connection from said device to said filter;

an input connection that serves as a connection to said device from said filter;

a first set of at least three resonators coupled together between said input and antenna connections, said first set having a input resonator connected to said antenna connection, a output resonator connected to said input connection, and at least one resonator coupled between said input and output resonators, wherein said input and output resonators are coupled together and where there is an odd number of resonators between said input and said output, such that the coupling of said input and output resonators is negative;

a second set of at least three two resonators between said output and antenna connections, said second set having a input resonator connected to said output connection, a output resonator connected to said antenna connection, and at least one resonator coupled between said input and output resonators, wherein said input and output resonators are coupled together and where there is an odd number of resonators between said input and said output, such that the coupling of said input and output resonators is negative.

37. The advanced duplexer dielectric filter of claim 36, wherein said filter is formed from a single block of dielectric material.

38. The advanced duplexer dielectric filter of claim 36, wherein at least one of said resonators of said first and second sets is of a different design from other said resonators.

39. The advanced duplexer dielectric filter of claim 36, wherein at least one of said resonators coupled between said input and output resonators of said first and second sets is reversed in orientation as compared to other of said resonators of said filter.

40. The advanced duplexer dielectric filter of claim 36, wherein said coupling of said input and output resonators of said first and second sets is a weak coupling as compared to other couplings between resonators of said filter.

41. The advanced duplexer dielectric filter of claim 40, wherein said weak coupling of said first and second sets is an inductive coupling groove.

42. The advanced duplexer dielectric filter of claim 36, wherein at least one of said resonators coupled between said input and output resonators of said first and second sets is reversed in orientation electronically by employing electrode coupling on a top and bottom surface of said filter.

43. The advanced duplexer dielectric filter of claim 42, wherein said filter is formed from a single block of dielectric material and includes a top, bottom and sides; wherein said sides are covered by and interconnected by an electrode coating which acts as a ground; wherein each of said resonators of said first and second sets includes coupling electrodes which allows electrode coupling between each resonator; wherein said input resonators include an input electrode; wherein said output resonators include an output electrode; and wherein positioning of said input electrode, output electrode, coupling electrodes, grounding electrode coating effect an electronic reversing of the orientation of at least one resonator of said first and second sets.

44. The advanced dielectric filter of claim 36, wherein there is only one resonator between input and output resonators for each of said first and second sets creating a three-pole filter for each of said first and second sets.

45. The advanced duplexer dielectric filter of claim 44, wherein said filter is formed from a single block of dielectric material.

46. The advanced dielectric filter of claim 44, wherein said coupling of said input and output resonators of said first and second sets is a weak coupling as compared to other couplings between resonators of said filter.

47. The advanced duplexer dielectric filter of claim 46, wherein said weak coupling of said first and second sets is an inductive coupling groove.

48. The advanced duplexer dielectric filter of claim 44, wherein at least one of said resonators of said first and second sets is of a different design from other said resonators.

49. The advanced duplexer dielectric filter of claim 44, wherein at least one of said resonators coupled between said input and output resonators of said first and second sets is reversed in orientation as compared to other of said resonators of said filter.

50. The advanced duplexer dielectric filter of claim 44, wherein at least one of said resonators coupled between said input and output resonators of said first and second sets is reversed in orientation electronically by employing electrode coupling on a top and bottom surface of said filter.

51. The advanced duplexer dielectric filter of claim 50, wherein said filter is formed from a single block of dielectric material and includes a top, bottom and sides; wherein said sides are covered by and interconnected by an electrode coating which acts as a ground; wherein each of said resonators of said first and second sets includes coupling electrodes which allows electrode coupling between each resonator; wherein said input resonators include an input electrode; wherein said output resonators include an output electrode; and wherein positioning of said input electrode, output electrode, coupling electrodes, grounding electrode coating effect an electronic reversing of the orientation of at least one resonator of said first and second sets.

52. The advanced dielectric filter of claim 44, wherein said three pole filter of each of said first and second sets is formed in an upside down T-shape and wherein said input and output resonators are at a bottom of said upside down T-shape and said only one resonator is at a top of said upside down T-shape.

53. The advanced duplexer dielectric filter of claim 52, wherein said coupling of said input and output resonators of said first and second sets is a weak coupling as compared to other couplings between resonators of said filter.

54. The advanced duplexer dielectric filter of claim 53, wherein said weak coupling of said first and second sets is an inductive coupling groove.

55. The advanced duplexer dielectric filter of claim 52, wherein at least one of said resonators of said first and second sets is of a different design from other said resonators.

56. The advanced duplexer dielectric filter of claim 52, wherein at least one of said resonators coupled between said input and output resonators of said first and second sets is reversed in orientation as compared to other of said resonators of said filter.

57. The advanced duplexer dielectric filter of claim 52, wherein at least one of said resonators coupled between said input and output resonators of said first and second sets is reversed in orientation electronically by employing electrode coupling on a top and bottom surface of said filter.

58. The advanced duplexer dielectric filter of claim 57, wherein said filter is formed from a single block of dielectric material and includes a top, bottom and sides; wherein said sides are covered by and interconnected by an electrode coating which acts as a ground; wherein each of said resonators of said first and second sets includes coupling electrodes which allows electrode coupling between each resonator; wherein said input resonators include an input electrode; wherein said output resonators include an output electrode; and wherein positioning of said input electrode, output electrode, coupling electrodes, grounding electrode coating effect an electronic reversing of the orientation of at least one resonator of said first and second sets.

59. The advanced duplexer dielectric filter of claim 52, wherein said filter is formed from a single block of dielectric material.

* * * * *